US008156690B2

(12) United States Patent
Higley

(10) Patent No.: US 8,156,690 B2
(45) Date of Patent: Apr. 17, 2012

(54) ENCLOSED STRUCTURE

(75) Inventor: Dean Higley, Titusville, FL (US)

(73) Assignee: LRM Industries International, Inc., Rockledge, FL (US)

( * ) Notice: Subject to any disclaimer, the term of this patent is extended or adjusted under 35 U.S.C. 154(b) by 860 days.

(21) Appl. No.: 12/165,692

(22) Filed: Jul. 1, 2008

(65) Prior Publication Data

US 2011/0162292 A1 Jul. 7, 2011

Related U.S. Application Data

(60) Provisional application No. 60/961,742, filed on Jul. 24, 2007.

(51) Int. Cl.
*E04H 1/02* (2006.01)

(52) U.S. Cl. ..... 52/79.5; 52/286; 52/271; 52/284; 52/91.3; 52/169.5; 52/302.3

(58) Field of Classification Search ..... 52/79.5, 52/286, 270, 271, 284, 90.1, 91.1, 91.3, 169.5, 52/302.1, 302.3
See application file for complete search history.

(56) References Cited

U.S. PATENT DOCUMENTS 2,653,553 A * 9/1953 Jacobs ..... 52/641
4,133,149 A 1/1979 Angress
4,343,117 A 8/1982 Shemitz
4,603,518 A 8/1986 Fennes
4,784,172 A 11/1988 Yacoboni
5,083,410 A 1/1992 Watson
5,184,436 A 2/1993 Sadler
5,447,000 A 9/1995 Larsen
5,615,640 A 4/1997 Luiz
5,647,177 A * 7/1997 Hwang ..... 52/79.5
5,771,639 A 6/1998 Wood et al.
D397,445 S 8/1998 Thorbeck et al.
5,930,961 A 8/1999 Beaudet
5,946,870 A * 9/1999 Bifano et al. ..... 52/254
6,216,410 B1 * 4/2001 Haberman ..... 52/591.1
6,250,021 B1 * 6/2001 Ferrara, Jr. ..... 52/71
6,298,619 B1 * 10/2001 Davie ..... 52/293.3
6,308,466 B1 10/2001 Moriarty
6,470,638 B1 * 10/2002 Larson ..... 52/302.1
6,601,598 B2 8/2003 Clee et al.
6,892,498 B1 * 5/2005 Roman ..... 52/79.5
6,981,347 B1 1/2006 Walburger
2003/0033769 A1 * 2/2003 Record ..... 52/270
2003/0182886 A1 * 10/2003 Parrish ..... 52/293.3

* cited by examiner

*Primary Examiner* — Robert Canfield
*Assistant Examiner* — Jessie Fonseca
(74) *Attorney, Agent, or Firm* — Michael A. Ervin; M.A. Ervin & Associates

(57) ABSTRACT

An enclosed structure includes a base perimeter structure with a plurality of base plates, an exterior wall structure and a roof structure. The exterior wall structure includes a plurality of sidewall panels. The roof structure includes a plurality of roof panels. The enclosed structure has a substantially enclosed interior structure space. The enclosed structure can be prepared using plastic molding methods and may be used as a temporary emergency structure, such as a temporary emergency dwelling.

22 Claims, 31 Drawing Sheets

ENCLOSED STRUCTURE

CROSS REFERENCE TO RELATED PATENT APPLICATION

The present non-provisional patent application is entitled to and claims, under 35 U.S.C. §119(e), the benefit of U.S. Provisional Patent Application Ser. No. 60/961,742, filed Jul. 24, 2007, which is hereby incorporated herein in its entirety by reference.

FIELD OF THE INVENTION

The present invention relates to an enclosed structure, such as a temporary or emergency dwelling, that includes: a base perimeter structure having a base perimeter channel; an exterior wall structure that includes wall panels that are received within and extend upwardly from the base perimeter channel; and a roof structure that includes roof panels that abut and extend upwardly with a roof gradient angle from the upper sidewall edge of at least one sidewall panel. Each base plate of the base perimeter structure includes an outwardly extending exterior base portion having an upper exterior surface that slopes downwardly and outwardly from the upwardly extending exterior flange of the base plate. The sidewall panels and roof panels each include side tabs that overlappingly abut and are fixedly attached to the side tabs of a neighboring sidewall/roof panel. The components (e.g., base plates, sidewall panels and roof panels) of the enclosed structure may each be independently fabricated from suitable materials, such as thermoplastic materials.

BACKGROUND OF THE INVENTION

Natural disasters, such as storms, tornadoes, hurricanes, earthquakes, tsunamis and volcanic eruptions, and human conflicts, such as war, often result in the displacement of large numbers of people, who are typically referred to as "refugees". As the result of the loss of and/or geographic displacement from their original housing, refugees often require temporary structures, such as temporary housing and storage facilities, until they are able to rebuild and/or return to their original dwellings. In addition, personnel providing aid (e.g., food, medical care and logistical support) to the refugees may also require temporary housing and storage facilities for their own use.

In the past, tents have been used to provide temporary shelter for refugees, aid personnel and materials. While typically light weight, low in cost, and relatively easy to transport, erect and break-down, tents typically provide less than desirable protection from environmental elements, such as rain, snow, wind and hot and/or cold ambient temperatures.

Temporary housing and storage structures that provide more substantial protection from environmental elements have been developed. For example, U.S. Pat. No. 5,083,410 describes a double-walled emergency housing structure that includes separate inner and outer wall panels that are snap fastened to the exterior of upwardly facing U-shaped bottom channels and downwardly facing U-shaped top channels. The U-shaped bottom channels of the emergency housing structure of the '410 patent are further described as being fastened to a base or foundation.

It would be desirable to develop new enclosed structures that may be used to provide temporary or emergency shelters or dwellings for use by, for example, displaced persons and aid personnel. It would be further desirable that such newly developed enclosed structures provide a desirable balance of:

logistical concerns, such as, cost, ease of construction and break-down, and efficient transport and storage of components; and physical attributes, such as, sturdiness, sufficient interior space, weather resistance and weather imperviousness.

SUMMARY OF THE INVENTION

In accordance with the present invention, there is provided an enclosed structure that comprises:

(a) a base perimeter structure comprising a plurality of base plates, each base plate comprising:

(i) a base, (ii) an interior flange extending upwardly from said base, (iii) an exterior flange extending upwardly from said base, said interior flange, said exterior flange and a channel base portion of said base extending between said exterior flange and said interior flange together defining a channel, said base having an exterior base portion extending outwardly from said exterior flange, said exterior base portion having an upper exterior surface that slopes downwardly and outwardly from said exterior flange, said base having a first side base edge and a second side base edge, said plurality of base plates being arranged with said first side base edge adjacent (e.g., aligned substantially parallel with) the second side base edge of a neighboring base plate, and each channel being aligned so as to form a base perimeter channel;

(b) an exterior wall structure comprising a plurality of sidewall panels each comprising an upper sidewall edge, a lower sidewall portion, a first sidewall edge, a second sidewall edge, an interior sidewall side and an exterior sidewall side, each sidewall panel having at least one first sidewall tab extending outwardly from said first sidewall edge, and at least one second sidewall tab extending outwardly from said second sidewall edge, said lower sidewall portion of each sidewall panel being received within said base perimeter channel, each sidewall panel extending upwardly from said base perimeter channel, said plurality of sidewall panels being arranged such that said first sidewall tab and the second sidewall tab of a neighboring sidewall panel overlappingly abut and are fixedly attached to each other; and (c) a roof structure comprising a plurality of roof panels each having an upper roof panel portion, a lower roof panel portion, a first roof panel side edge, a second roof panel side edge, an interior roof panel side and an exterior roof panel side, each roof panel having at least one first roof panel tab extending outwardly from said first roof panel side edge, and at least one second roof panel tab extending outwardly from said second roof panel side edge, said plurality of roof panels being arranged such that said first roof panel tab and the second roof panel tab of a neighboring roof panel overlappingly abut and are fixedly attached to each other, a portion of said interior roof panel side of said lower roof panel portion of each roof panel abuts the upper sidewall edge of at least one sidewall panel, and each roof panel extends upwardly from at least one sidewall panel and independently has a roof gradient angle that is greater than 0° and less than 90°, wherein said interior sidewall side of each sidewall panel and said interior roof panel side of each roof panel together define a substantially enclosed interior structure space.

In further accordance with the present invention, there is also provided an enclosed structure, as described above, in which:

(i) the exterior base portion of each base plate, of the base perimeter structure, further comprises, a raised lip extending upwardly from the upper exterior surface and along at least a portion of the first side base edge, and an interlock structure extending outwardly from the upper exterior surface and along at least a portion of the second base edge, said interlock structure having an interlock channel that is dimensioned for interlocking receipt of said raised lip therein, said interlock channel being downwardly facing, and said plurality of base plates are arranged with said first side base edge adjacent to (e.g., aligned substantially parallel with) the second side base edge of a neighboring base plate, and such that the raised lip of each base plate is interlockingly received within the interlock channel of said interlock structure of said neighboring base plate, thereby interlocking said plurality of base plates together, and said base perimeter structure thus being an interlocked base perimeter structure, and each channel being aligned so as to form a base perimeter channel; and (ii) with regard to the abutting association between the roof panels and the upper sidewall edge of the sidewall panels, at least one sidewall panel further comprises a plurality of extensions extending upward from the upper sidewall edge, and said interior roof panel side of said lower roof panel portion of at least one roof panel has a plurality of lower notches, said lower notches being dimensioned and positioned to receive (and do receive) said extensions therein, wherein receipt of the extensions within the lower notches thereby serves to, at least in part, attach the roof panel(s) and sidewall panel(s) together, while at the same time maintaining the roof gradient angle of the roof panel.

As used in the specification and claims, the term "gradient angle" (e.g., as applied to the roof gradient angle, base gradient angle, exterior chamfered edge portion gradient angle, forward extension surface gradient angle, rear extension surface gradient angle, forward notch surface gradient angle, rear notch surface gradient angle, first exterior cap flange gradient angle, first interior cap flange gradient angle, second exterior cap flange gradient angle, second interior cap flange gradient angle, first gable ledge gradient angle, and second gable ledge gradient angle) means a gradient angle as determined relative to horizontal.

The features that characterize the present invention are pointed out with particularity in the claims, which are annexed to and form a part of this disclosure. These and other features of the invention, its operating advantages and the specific objects obtained by its use will be more fully understood from the following detailed description and accompanying drawings in which preferred embodiments of the invention are illustrated and described.

As used herein and in the claims, terms of orientation and position, such as "upper", "lower", "inner", "outer", "right", "left", "vertical", "horizontal", "top", "bottom", and similar terms, are used to describe the invention as oriented in the drawings. Unless otherwise indicated, the use of such terms is not intended to represent a limitation upon the scope of the invention, in that the invention may adopt alternative positions and orientations.

Unless otherwise indicated, all numbers or expressions, such as those expressing structural dimensions, quantities of ingredients, etc., as used in the specification and claims are understood as modified in all instances by the term "about".

BRIEF DESCRIPTION OF THE DRAWINGS

In FIGS. 1 through 31, like reference numerals designate the same components and structural features, unless otherwise indicated.

DETAILED DESCRIPTION OF THE INVENTION

Figure 1:
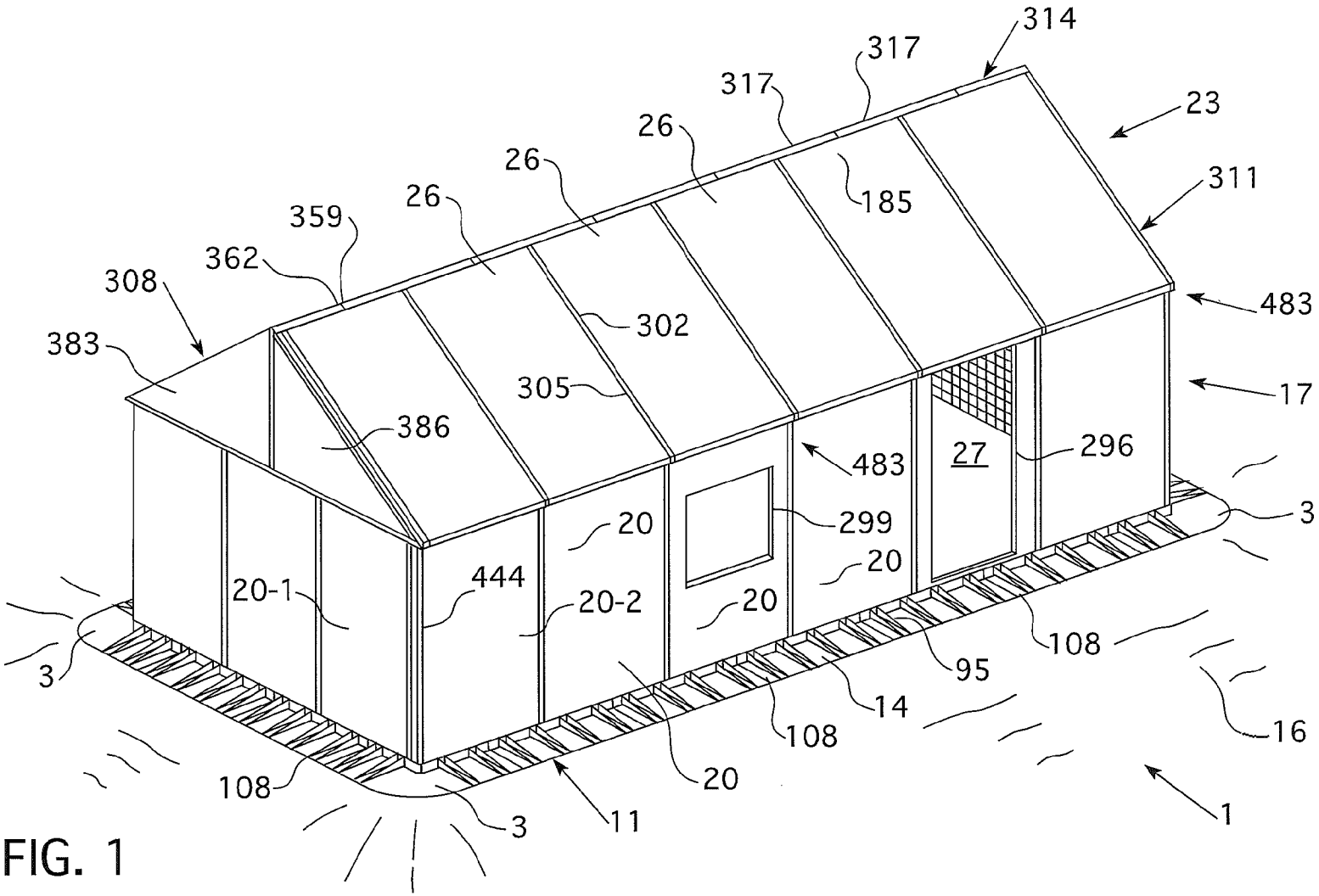
FIG. 1 is a representative perspective view of an enclosed structure according to the present invention.

With reference to FIG. 1, the enclosed structure 1 of the present invention includes: a base perimeter structure 11 that includes a plurality of base plates 14; an exterior wall structure 17 that includes a plurality of sidewall panels 20; and a roof structure 23 that includes a plurality of roof panels 26. Enclosed structure 1 has a substantially enclosed interior structure space 27 that is defined by the interior surfaces of the sidewall panels 20 and roof panels 26.

Figure 2:
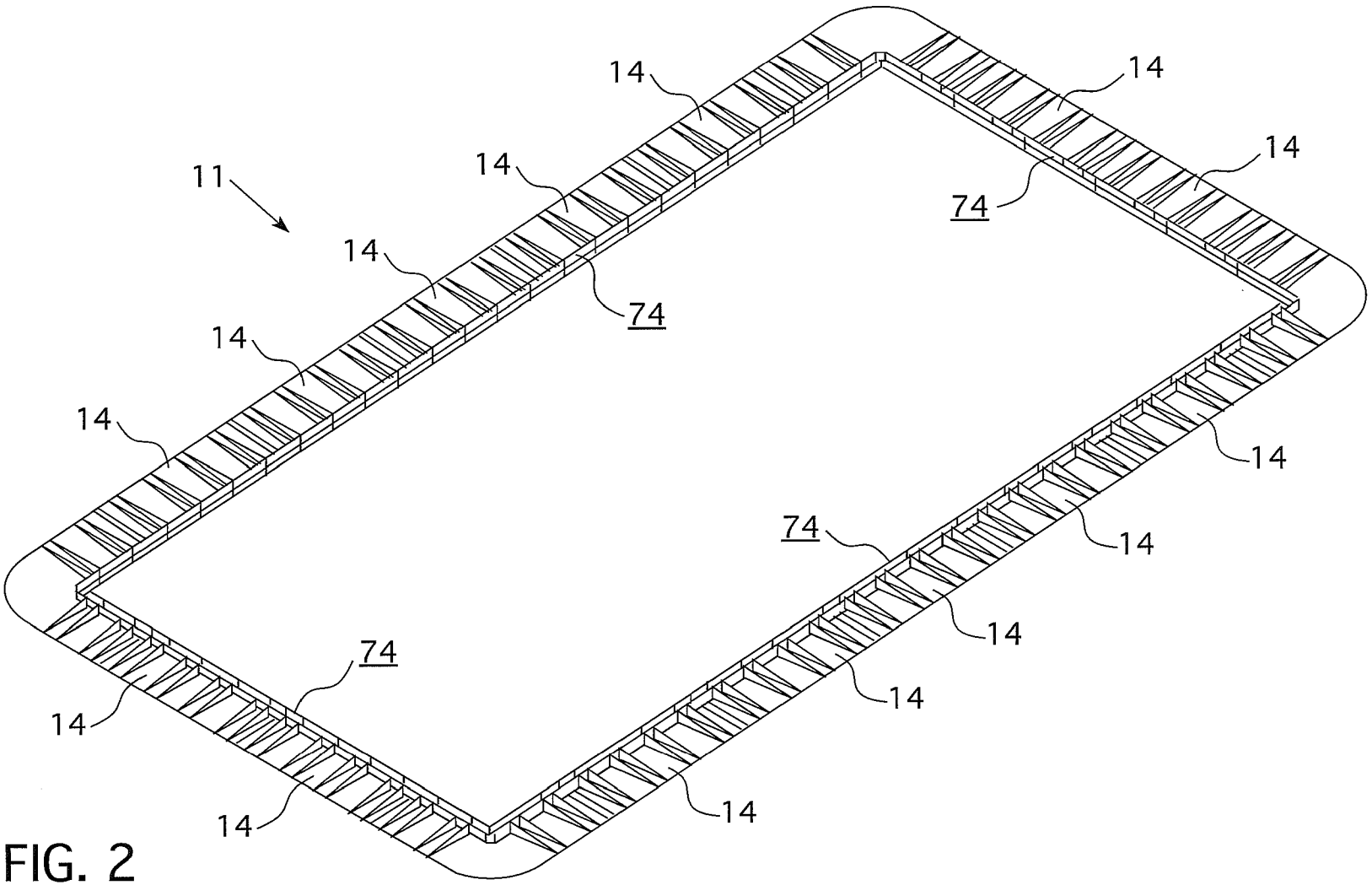
FIG. 2 is a representative perspective view of the base perimeter structure of the enclosed structure of FIG. 1.

The base perimeter structure of the enclosed shelter of the present invention is typically a substantially continuous base perimeter structure. For example, base perimeter structure 11 of enclosed shelter 1, which is depicted alone in FIG. 2, is a substantially continuous base perimeter structure.

Figure 3:
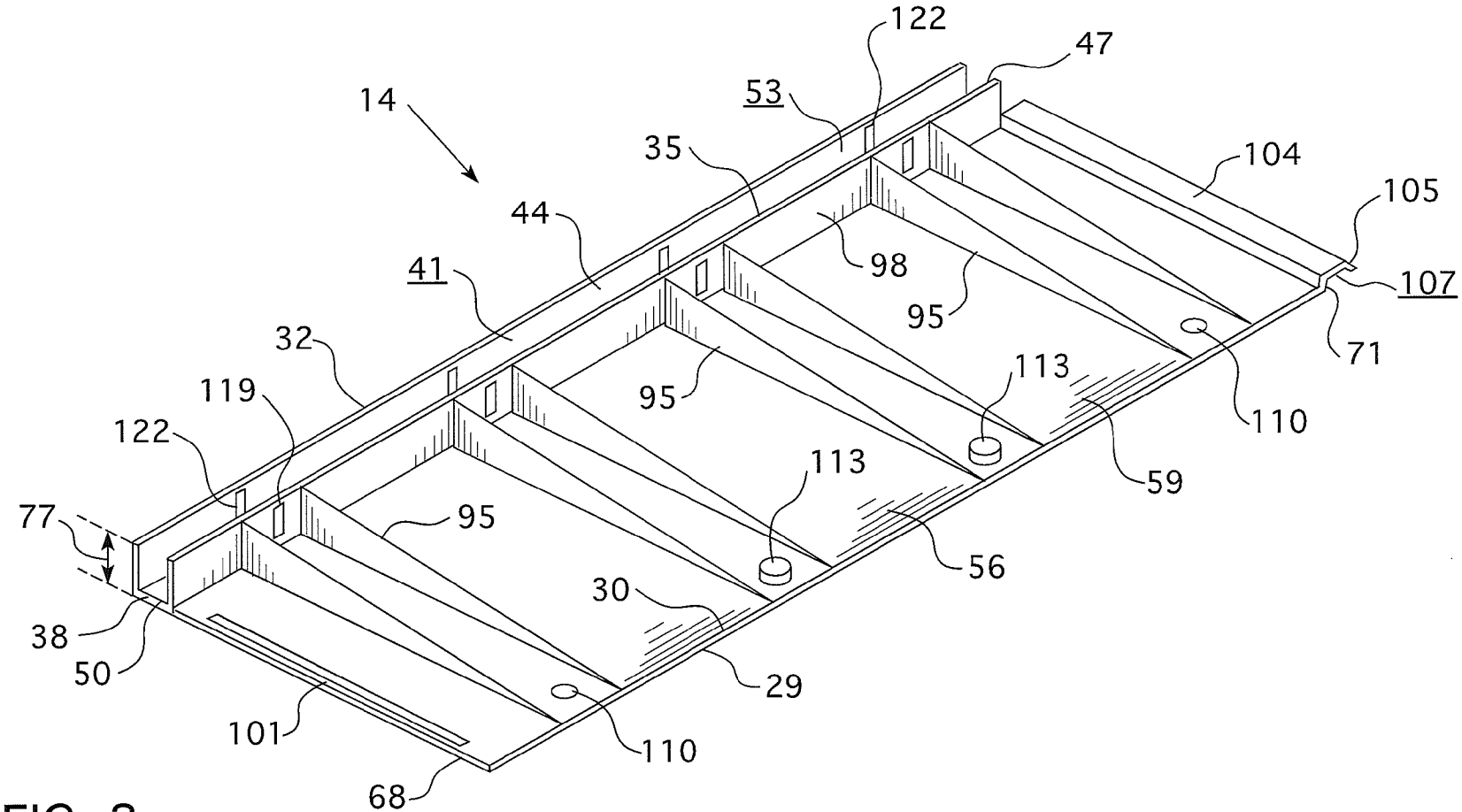
FIG. 3 is a representative perspective view of a base plate according to the present invention.

With reference to FIG. 3, each base plate 14 of base perimeter structure 11 includes a base 29, an interior flange 32 that extends upwardly from base 29, and an exterior flange 35 that extends upwardly from base 29. Interior flange 32, exterior flange 35 and a base channel portion 38 of base 29 together define a channel 41. Base channel portion 38 is that portion of base 29 that extends between interior flange 32 and exterior flange 35. More particularly, interior surface 44 of interior flange 32, interior surface 47 of exterior flange 35, and upper surface 50 of base channel portion 38 together define channel 41. Channel 41 has an upward facing open upper portion 53.

Interior flange 32 and exterior flange 35 may each independently form an angle with base 29 that is greater than 0° and less than 180°, provided that open upper portion 53 of channel 41 faces generally upward. More typically, interior flange 32 and exterior flange 35 may each independently form an angle with base 29 that is greater than 0° and less than or equal to 90°. As depicted in the drawing figures, interior flange 32 and exterior flange 35 each form an angle that is substantially 90° relative to base 29, and accordingly, channel 41 is a substantially U-shaped channel with open upper end 53 facing upward. The shape of channel 41 may vary widely (e.g., it may be generally V-shaped, parabolic or semicircular shaped, not shown), provided that it is capable of receiving the lower sidewall portion of a sidewall therein, and providing support for the sidewall extending upwards therefrom, as will be discussed in further detail herein.

Interior flange 32 and exterior flange 35 may each independently extend upwardly from base 29 the same distance or a different distance. Typically, interior flange 32 and exterior flange 35 both extend the same distance upwardly from base 29. The height 77 (FIG. 3) of interior flange 32, the height 80 (FIG. 5) of exterior flange 35, and the distance between interior surface 44 of interior flange 32 and interior surface 47 of exterior flange 35 as represented by width 83 (FIG. 6) of base channel portion 38, are each selected such that channel 41 (and correspondingly base perimeter channel 74) is dimensioned so as to be capable of receiving the lower sidewall portion of a sidewall therein, and providing support for the sidewall extending upwards therefrom.

Typically, height 77 of interior flange 32 and height 80 of exterior flange 35 each independently have a value of from 0.5 cm to 7.5 cm, more typically from 2.25 cm to 6 cm, and further typically from 3 cm to 5 cm. Base channel portion 38 typically has a width 83 of from 1.5 cm to 7.5 cm, more typically from 2 cm to 6 cm, and further typically from 3 cm to 5 cm. In an embodiment of the present invention, height 77 of interior flange 32 has a value of 4.5 cm, height 80 of exterior flange 35 has a value of 4.0 cm, and base channel portion 38 has a width 83 of 4.5 cm.

Figure 4:
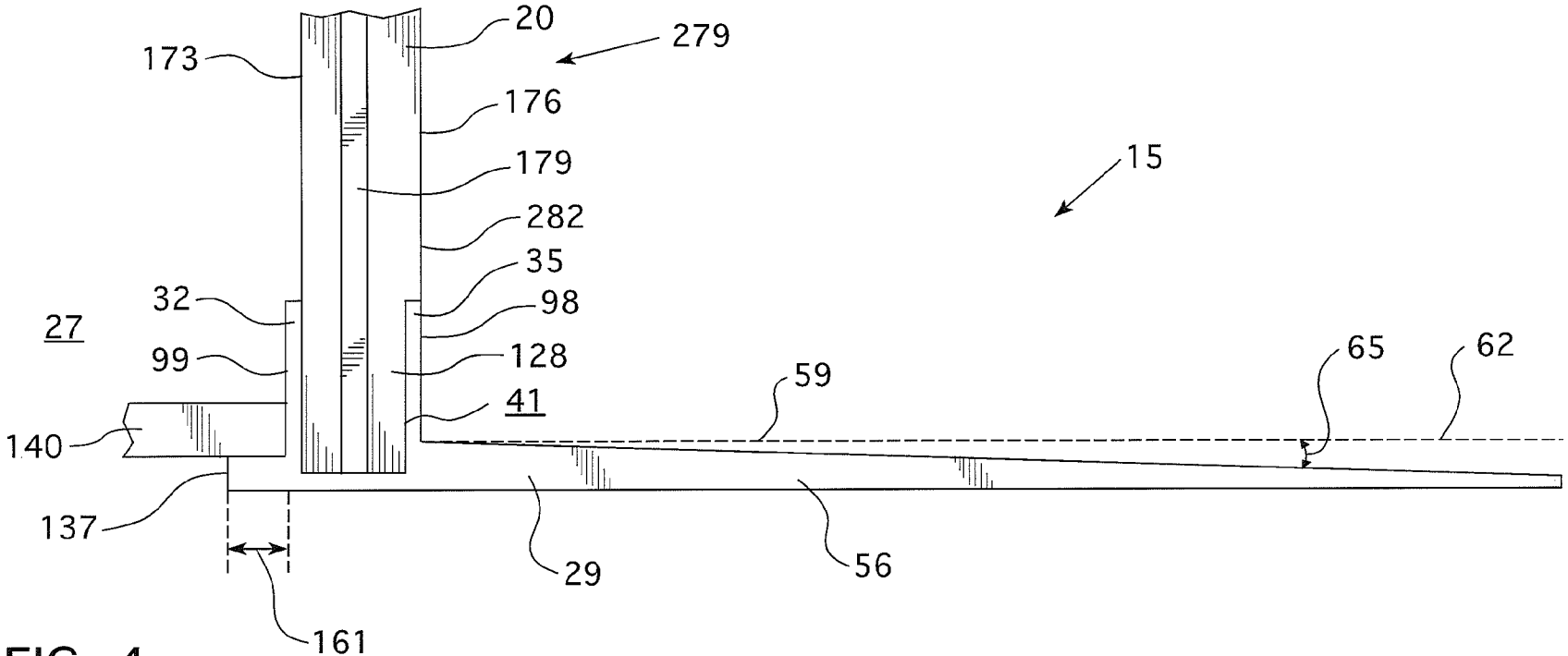
FIG. 4 is a representative side elevational view of a base plate according to the present invention that further includes a sidewall panel and a floor panel.

Base 29 of base plate 14 has an exterior base portion 56 that extends outwardly from exterior flange 35. Exterior base portion 56 has an upper exterior surface 59 that slopes downwardly and outwardly from exterior flange 35. The outward and downward slope of upper exterior surface 59 may be described more particularly with reference to FIG. 4 in which a base plate 15, that is similar to base plate 14, is depicted. With reference to FIG. 4, upper exterior surface 59 of exterior base portion 56 extends outwardly and downwardly from exterior flange 35, and forms a base gradient angle 65, relative to horizontal (as depicted by dashed line 62), that is greater than 0° and less than 90°. More typically, base gradient angle 65 is greater than 0° and less than or equal to 45° (e.g., greater than or equal to 5° and less than or equal to 30°, such as 15°). Base gradient angle 65 is typically selected so that liquids, such as water (e.g., water resulting from rain) that enclosed structure 1 is exposed to (e.g., by means of rain showers or storms) flows outward and away from base perimeter structure 11. Ensuring that rain water flows outward and away from base perimeter structure 11 is important for reasons including, but not limited to, minimizing the ingress of water into the interior of enclosed structure 1. In addition, ensuring that rain water flows outward and away from base perimeter structure 11, also serves to desirably minimize or prevent undercutting of the base perimeter structure by water, which otherwise could result in structural destabilization of the base perimeter structure, the sidewall structure extending upward therefrom, and the roof structure (e.g., destabilization of the whole enclosed structure or a portion thereof).

Figure 5:
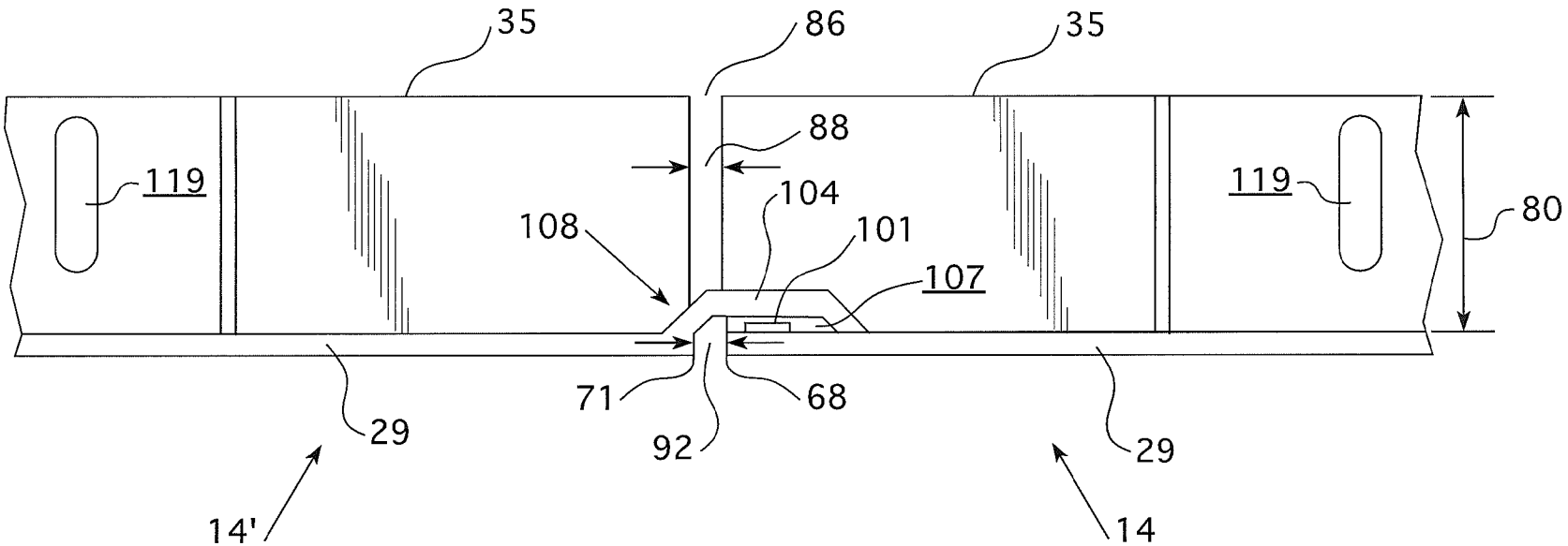
FIG. 5 is a representative front elevational view of two interlocked neighboring base plates showing the raised lip of one base plate interlockingly received within the interlock structure of the other base plate.

Base plate 14 further includes a first side base edge 68 and a second side base edge 71. With reference to FIG. 5, the base plates of base perimeter structure 1 are arranged such that first side base edge 68 of each base plate (e.g., base plate 14) is adjacent to second side base edge 71 of a neighboring base plate (e.g., neighboring base plate 14'). With base perimeter structure 11, each base plate 14: (i) has a neighboring base plate adjacent thereto; and (ii) is itself a neighboring base plate relative to an adjacent base plate. For example, base plate 14' is a neighbor of base plate 14, and, at the same time, base plate 14 is a neighbor of base plate 14'. As used herein and in the claims, the term "adjacent" with regard to the first and second side base edges (and neighboring base plates)

means that the first and second side base edges of neighboring base plates may be in abutting relationship and/or separated from each other. As depicted in FIG. 5, first side base edge 68 of base plate 14 and second base edge 71 of neighboring base plate 14' are separated from each other. With the base perimeter structure of the present invention: each pair of adjacent first and second side base edges may be separated from each other; each pair of adjacent first and second side base edges may abut each other; or some adjacent first and second side base edges may be separated from each other, while at the same time some of the other adjacent first and second side base edges abut each other.

Arranging or positioning the base plates such that first 68 and second 71 base edges of neighboring base plates are adjacent to each other, also results in the channels 41 of neighboring base plates being aligned so as to form a base perimeter channel 74 (FIG. 2). Typically, base perimeter channel 74 is a substantially continuous base perimeter channel (e.g., as depicted in FIG. 2). The base perimeter channel may have at least one vertical break resulting from a pair of adjacent first and second base edges of at least one pair of neighboring base plates being separated from each other (rather than abutting each other). With reference to FIG. 5, first 68 and second 71 base edges of neighboring base plates 14 and 14' are adjacent but separated from each other, which results in the formation of a vertical break (or separation) 86 between the adjacent terminal edges of exterior flanges 35 (and the adjacent terminal edges of interior flanges 32, not shown in FIG. 5).

The width of a vertical break may be the same as or different than the distance of separation between adjacent first 68 and second 71 base edges of neighboring base plates. The vertical breaks (e.g., 86) and separation between adjacent first 68 and second 71 base edges of neighboring base plates may be present in the base perimeter structure, provided that the dimensional stability of the base perimeter structure, and, in particular, the base perimeter channel, is not compromised, and further particularly such that the ability of the base perimeter channel to support the exterior wall structure is not compromised.

Typically, the width 89 of vertical break 86 and the distance of separation 92 between adjacent first 68 and second 71 base edges of neighboring base plates each independently have a value of from 3 mm to 20 mm, more typically from 4 mm to 15 mm, and further typically from 5 mm to 12.5 mm. In an embodiment of the present invention, the width 89 of vertical break 86 and the distance 92 of separation between adjacent first 68 and second 71 base edges of neighboring base plates are substantially the same, each having a value of 6 mm.

At least one base plate of the base perimeter structure may further include at least one support rib extending outward from the exterior flange of the base plate. Support ribs are typically included for purposes of providing the base plate with improved rigidity, and providing improved support for the exterior flange thereof. As will be discussed in further detail herein, the roof panels of the enclosed structure abut and extend upwardly (at a roof gradient angle) from the upper edge of at least some of the sidewall panels. As such, the roof structure exerts both downward and outward forces on the sidewalls. Since the lower portions of the sidewalls are received and held within the channels of the base plates, an outward force may also be exerted by the lower portion of the sidewall against the exterior flange of the base plate, causing the exterior flange to tilt or bend outward. The support ribs serve, in part, to counteract the outward force that may be exerted upon the exterior flange, and thus prevent dimensional distortion thereof.

With reference to FIG. 3, exterior base portion 56 of base 29 of base plate 14 further includes a plurality of support ribs 95 that extend outwardly from exterior flange 35, and more particularly from exterior surface 98 of exterior flange 35. Each support rib 95 is continuous with: upper exterior surface 59 of exterior base portion 56; and exterior flange 35 (more particularly exterior surface 98 of exterior flange 35). The support ribs of exterior base portion 56 may each independently have any suitable shape (e.g., rectangular, square, irregular and/or triangular). Support ribs 95 as depicted in the drawings have a triangular shape, and in particular a right triangular shape with the hypotenuse thereof tapering downward and away from exterior flange 35. In addition, support ribs 95 may have perforations there-through (not shown), for purposes of reducing the weight of the base plate.

Figure 8:
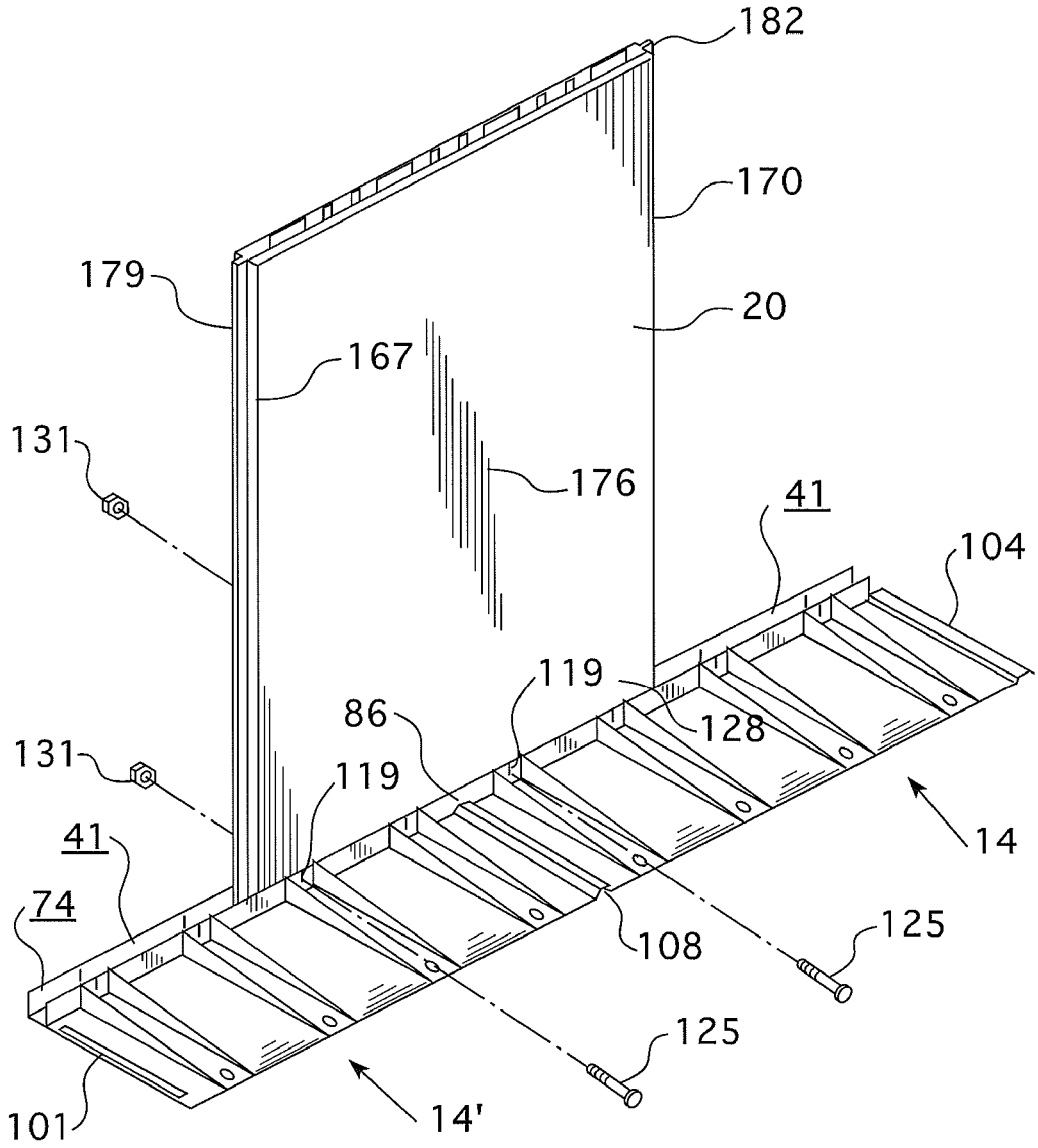
FIG. 8 is a representative perspective view of two interlocked base plates and a sidewall panel received within the aligned channels (base perimeter channel) thereof.

In an embodiment of the present invention, each base plate further includes elements that allow neighboring base plates to be interlocked together, thereby forming an interlocked base perimeter structure. With reference to FIGS. 3, 5 and 8, base plate 14 includes a raised lip 101 that extends upwardly from upper exterior surface 59, and along at least a portion of first side base edge 68 of exterior base portion 56. The raised lip may be continuous (as depicted in the drawings) or segmented, e.g., in the form of a plurality of raised lips (not shown). As used herein and in the claims, the phrase, "extending/extends along at least a portion of the first side base edge [68]" and similar phrases means that raised lip 101 extends substantially parallel and proximate to first side base edge 68. Raised lip 101 may extend right along (i.e., without separation from) edge 68. Alternatively, raised lip 101 may extend along and with some separation from edge 68 (as depicted in FIGS. 3 and 5). The amount of separation (if any) between raised lip 101 and first side base edge 68 is typically small (e.g., between 3 mm and 12 mm), and is typically selected such that raised lip 101 is capable of engaging interlockingly with interlock structure 104, as will be discussed further herein.

To provide for interlocking engagement, base plate 14 further includes an interlock structure 104 that extends laterally outward from upper exterior surface 59 and along at least a portion of second base edge 71 of exterior base portion 56. The interlock structure may be continuous (as depicted in the drawings) or segmented, e.g., in the form of a plurality of interlock structures (not shown). As used herein and in the claims, the phrase, "extending/extends laterally outward along at least a portion of the second side base edge [71]" and similar phrases means that interlock structure 104 extends substantially parallel and proximate to second side base edge 71. Interlock structure 104 may extend right along (i.e., without separation from) edge 71 (as depicted in FIGS. 3 and 5). Alternatively, raised interlock structure 104 may extend along and with some separation from edge 71. The amount of separation (if any) between interlock structure 104 and second side base edge 71 is typically small (e.g., between 2.5 mm and 5 mm), and is typically selected such that interlock structure 104 is capable of engaging interlockingly with raised lip 101, as will be discussed further herein.

Interlock structure 104 further includes a downwardly facing interlock channel 107. Interlock channel 107 is dimensioned for interlocking receipt of raised lip 101 (of a neighboring base plate) therein. Interlock channel 107 extends substantially longitudinally along the length of interlock structure 104. Interlock channel 107 may be dimensioned for a tight interlocking receipt of raised lip 101 therein, in which case, lateral movement between interlocked neighboring base plates is substantially prevented. Alternatively, interlock channel 107 may be dimensioned for a loose interlocking receipt of raised lip 101 therein (as depicted in FIG. 5), thus allowing for some lateral movement between interlocked neighboring base plates. Providing for some lateral movement between interlocked neighboring base plates may be desirable for purposes of allowing for minor lateral adjustments between interlocked neighboring base plates during on-site construction of the enclosed structure of the present invention (e.g., when sidewall panels are received and fixed within the base perimeter channel). In addition, providing for some lateral movement between interlocked neighboring base plates also desirably allows for thermal expansion and/or contraction of and between the base plates and/or the sidewall panels received and held within the channels thereof.

Interlock structure 104 typically extends laterally out from second side base edge 71 to outer edge 105 of interlock structure 104 over a distance, i.e., a width, 155 (FIG. 31) having a value typically from 10 mm to 50 mm, more typically from 20 mm to 40 mm, and further typically from 20 mm to 30 mm. In an embodiment of the present invention, distance/width 155 of interlock structure 104 has a value of 25 mm.

The plurality of base plates are arranged such that the raised lip 101 of each base plate is interlockingly received within the interlock channel 107 of the interlock structure 104 of a neighboring base plate, thereby forming an interlock arrangement 108 (FIG. 5). Such an interlocking arrangement of neighboring base plates allows for the plurality of base plates to be interlocked together, in which case base perimeter structure 11 is an interlocked base perimeter structure 11.

The interlocking receipt of raised lip 101 within interlock channel 107 of interlock structure 104 may optionally be further augmented by fasteners (e.g., screws, bolts, rivets and combinations thereof—not shown) extending at least partially through interlock structure 104 and raised lip 101. Further, alternatively, or in addition to fasteners, the interlocking receipt of raised lip 101 within interlock channel 107 of interlock structure 104 may be augmented by the presence of an adhesive (not shown) interposed there-between. For example, an adhesive may be introduced into interlock channel 107 prior to raised lip 101 being received therein. The adhesive may be selected from art-recognized adhesives, e.g., thermoplastic adhesives, such as glues comprising polyvinylacetate, or thermosetting adhesives, such as 2-component polyurethane adhesives.

Figure 6:
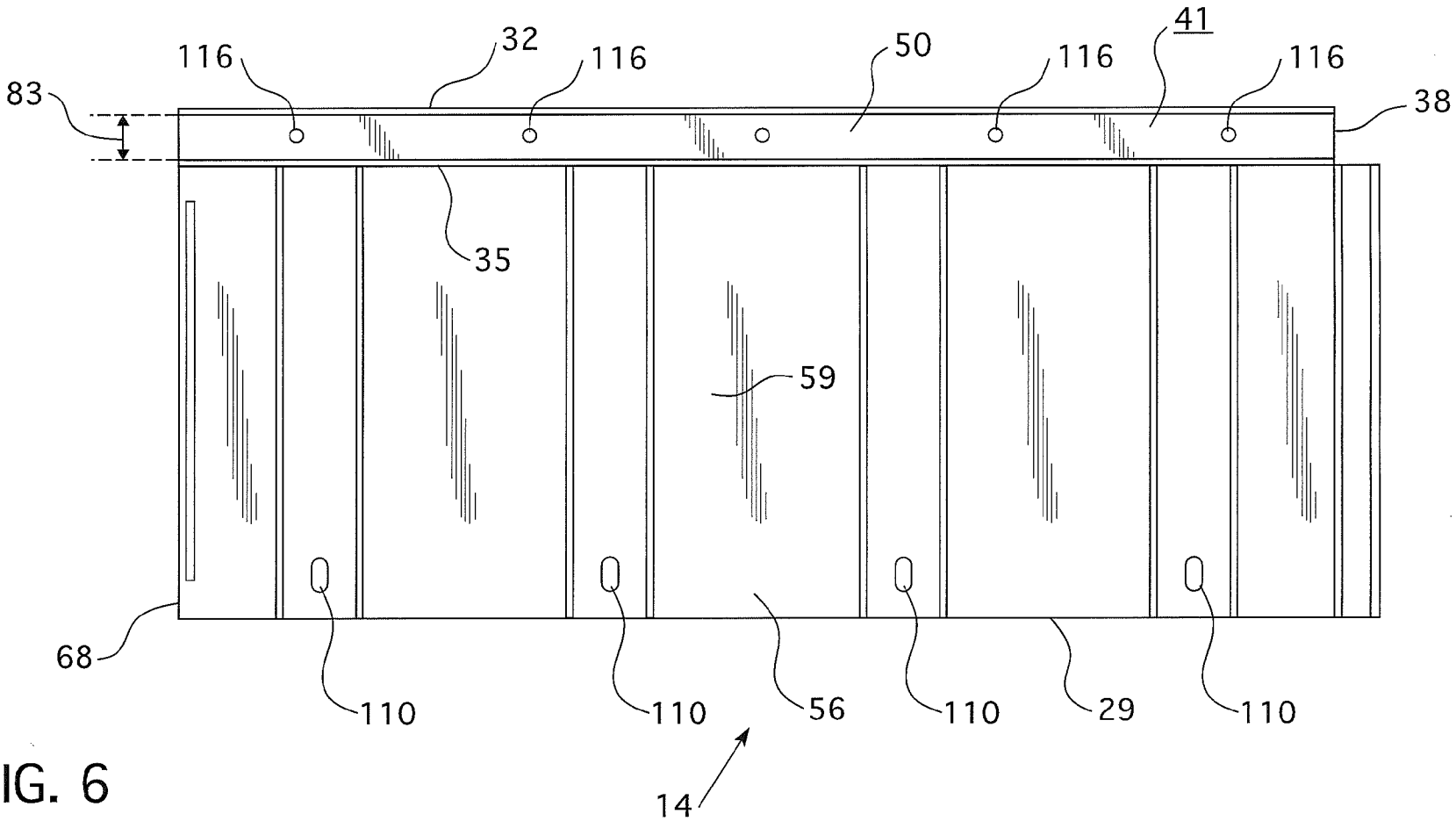
FIG. 6 is a representative top plan view of the base plate of FIG. 3.

To assist in securing the base perimeter structure, and correspondingly the enclosed structure of the present invention, to an underlying support, each base plate may include at least one anchor hole, and at least one anchor extending there-through, thereby anchoring the base perimeter structure to the underlying support. With reference to FIGS. 3 and 6, exterior base portion 56 of base plate 14 includes a plurality of anchor holes 110 therethrough. Anchor holes 110 may be located anywhere in exterior base portion 56. As depicted in FIGS. 3 and 6, anchor holes 110 are located near the outer terminus (terminal edge 30) of exterior base portion 56, laterally separated from outer flange 35. In FIG. 3, two of anchor holes 110 have an anchor 113 extending there-through. Each anchor 113 extends through an anchor hole 110 and fixedly secures the base plate (and correspondingly base perimeter structure 11) to an underlying support, such as the ground 16 depicted in FIG. 1. The underlying support may be selected from: for example, the ground (or earth), including soil, clay, sand, rock and combinations thereof; a separate foundation, e.g., fabricated from concrete, metal and/or wood; a barrier material, such as plastic sheets or mats; and combinations thereof.

The anchors may be selected from art-recognized anchors, such as spikes, bolts, rivets and combinations thereof. Each anchor may independently be fabricated from metals (e.g., steel, nickel, iron, copper, etc.), plastic (thermoplastic and/or thermoset plastic materials), wood and combinations thereof. An example of an anchor that may be used with the enclosed structure of the present invention, in particular when securing the structure directly to the ground, is a PENETRATOR anchor, commercially available from American Earth Anchor, Inc., 16 or 18 inches (40.6 or 45.7 cm) in length, having an elongated auger-like shaft and a ½ inch (1.27 cm) square drive head.

When exposed to outdoor elements, such as rain and condensation, water may collect in the base perimeter channel of the enclosed structure. For example, when exposed to rain, water may run down the exterior surface of the sidewalls and collect in the base perimeter channel. Water collecting in the base perimeter channel may rise up over the top of interior flange 32 and into the interior of the enclosed structure. To prevent or minimize the collection of water (and other liquids) within the base perimeter channel, the channel of each base plate may be provided with seep holes. With reference to FIG. 6, channel base portion 38 of channel 41 of base plate 14 has a plurality of seep holes 116 therein. Seep holes 116 are sized to allow liquids, such as water, to flow out of channel 41, thereby minimizing or preventing the collection of liquid within channel 41 and accordingly base perimeter channel 74.

The lower portion of each sidewall panel is received within the base perimeter channel of the base perimeter structure. The lower portion of each sidewall panel may be retained within the base perimeter structure by gravity, friction (e.g., a very tight fit there-between), snap fittings (not shown), fasteners, adhesives (not shown) and combinations thereof. In the case of snap fittings, interior surface 44 of interior flange 32 and/or interior surface 47 of exterior flange 35 may have snap projections (not shown) extending into channel 41, which snap fittingly engage with aligned snap depressions (not shown) in the interior and/or exterior surfaces of the lower portion of the sidewall panel residing within the channel. Adhesives (e.g., thermoplastic adhesives, such as glues comprising polyvinylacetate, or thermosetting adhesives, such as 2-component polyurethane adhesives) may be applied to at least one of interior surface 44 of interior flange 32, interior surface 47 of exterior flange 35 and upper surface 50 of base channel portion 38, and/or the interior and/or exterior surfaces of the lower portion of the sidewall, before the sidewall is received within channel 41.

Fasteners, that may be used to secure the lower portion of the sidewall panel within the channel, may be selected from, for example, screws, bolts, rivets and combinations thereof. In an embodiment of the present invention and with reference to FIGS. 3, 4, 5 and 8, exterior flange 35 has at least one aperture 119, and interior flange 32 has at least one aperture 122. Each aperture 119 of exterior flange 35 is aligned with an aperture 122 of interior flange 32, thereby forming an aligned pair of flange apertures. The enclosed structure further includes a plurality of sidewall-base plate fasteners 125 (FIG. 8) that extend through: aperture 119 of exterior flange 35; lower sidewall portion 128 (FIGS. 4 and 11) of sidewall panel 20 (that resides within channel 41, and correspondingly base perimeter channel 74); and aperture 122 of interior flange 32, thereby fixedly securing/attaching sidewall panel 20 and base plate 14 together. Fasteners 125 are depicted in the form of bolts that threadingly engage with nuts 131 (FIG. 8).

Figure 12:
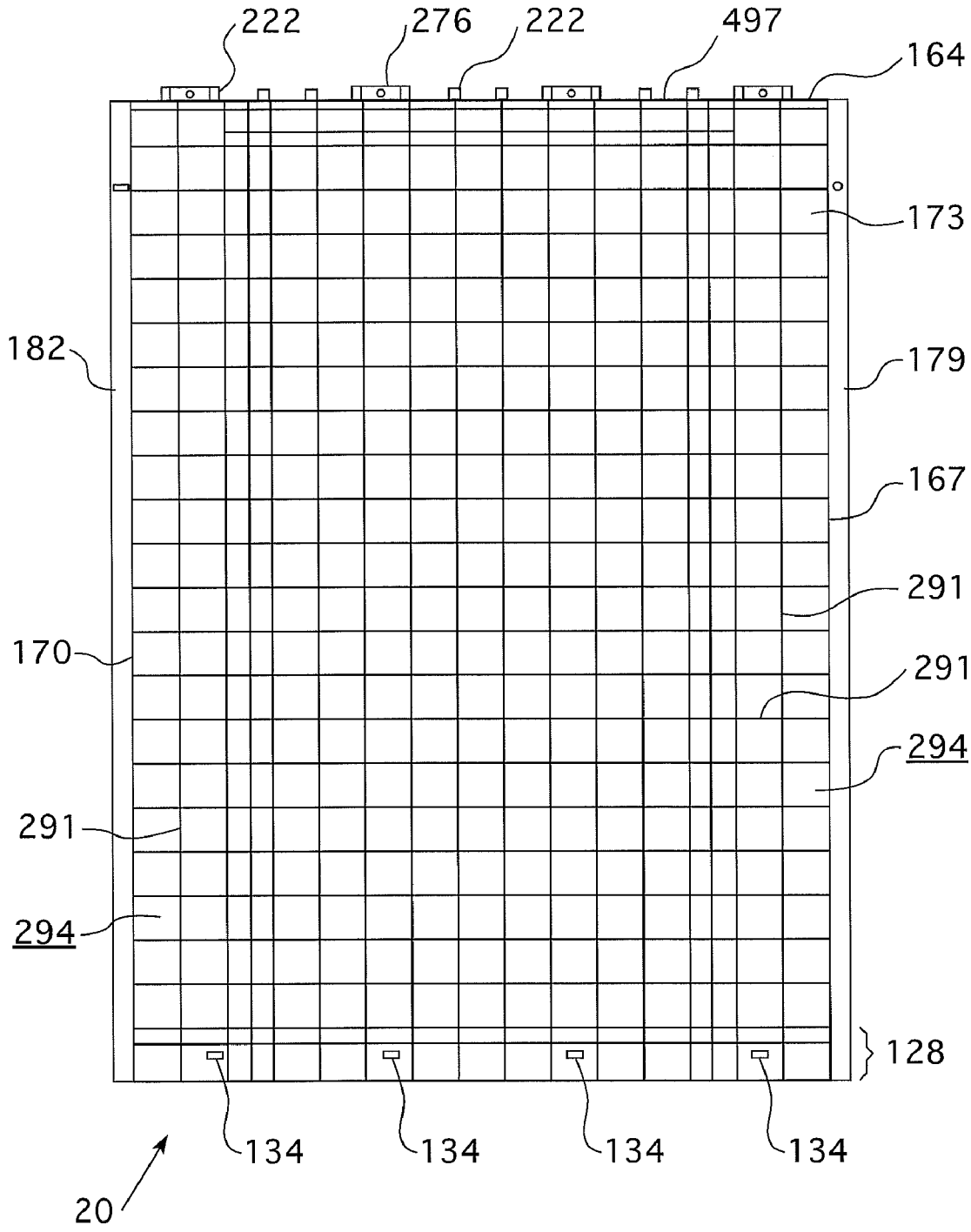
FIG. 12 is a representative plan view of the interior sidewall side of a sidewall according to the present invention that includes a plurality of intersecting ribs.

Lower sidewall portion 128 may optionally include lower sidewall apertures 134 (FIG. 12). Aperture 119 of exterior flange 32, lower sidewall aperture 134 and aperture 122 of interior flange 32 may be aligned, and sidewall-base plate fastener 125 passes and extends through the triumvirate of aligned apertures.

Each base plate may optionally further include, in an embodiment of the present invention, a support flange that extends inwardly into (or towards) the enclosed interior space of the enclosed structure. The support flange may provide support for a floor structure and/or additional support ribs (not shown) similar to support ribs 95, that provide support for the interior flange of the base plate. With reference to FIG. 4, base plate 15 (which is similar to base plate 14, but in which support ribs 95 are not shown), further includes a support flange 137 that extends inwardly into enclosed interior space 27 of the enclosed structure. More particularly, support flange 137 may extend inwardly from and optionally be continuous with: (i) interior flange 32; (ii) base 29; or (iii) a combination of (i) and (ii). In FIG. 4, support flange 137 is depicted as extending from and being continuous with both interior flange 32 and base 29 of base plate 15. Support flange 137 provides support for floor structure 140, a portion of which is depicted in FIG. 4. Floor structure 140 may be formed from a single continuous floor panel, or more typically from a plurality of floor panels (e.g., tongue-in-groove floor panels), in accordance with art-recognized methods.

The support flange of the base plate may have dimensions similar or equivalent to those of the exterior base portion of the base plate. Typically, the linear distance that the support flange extends into the enclosed interior space of the enclosed structure is less than the linear distance that the exterior base portion extends outward from the exterior flange (e.g., length 146 of exterior base portion 56—FIG. 31). In an embodiment of the present invention, support flange 137 extends a linear distance 161 (relative to interior surface 99 of interior flange 32—FIG. 4) having a value of from 0.5 cm to 10 cm, more typically from 1 cm to 7 cm, and further typically from 2 cm to 6 cm. In an embodiment of the present invention, linear distance 161 of support flange 137 has a value of 5 cm.

The dimensions associated with the interior flange 32, exterior flange 35, and base channel portion 38 of channel 53 of base plate 14 have been discussed previously herein. Further dimensions of the base plate will be discussed as follows with reference to FIG. 31. The dimensions of the base plate may vary widely, provided that the base plate (and base perimeter structure) is able to support the sidewall panels and sidewall structure of the enclosed structure of the present invention. The base plate may generally have a top plan view shape selected from rectangles (FIG. 6), squares, semicircle or curved shapes (e.g., base plate 3 of FIG. 7), irregular shapes, and combinations thereof.

Figure 31:
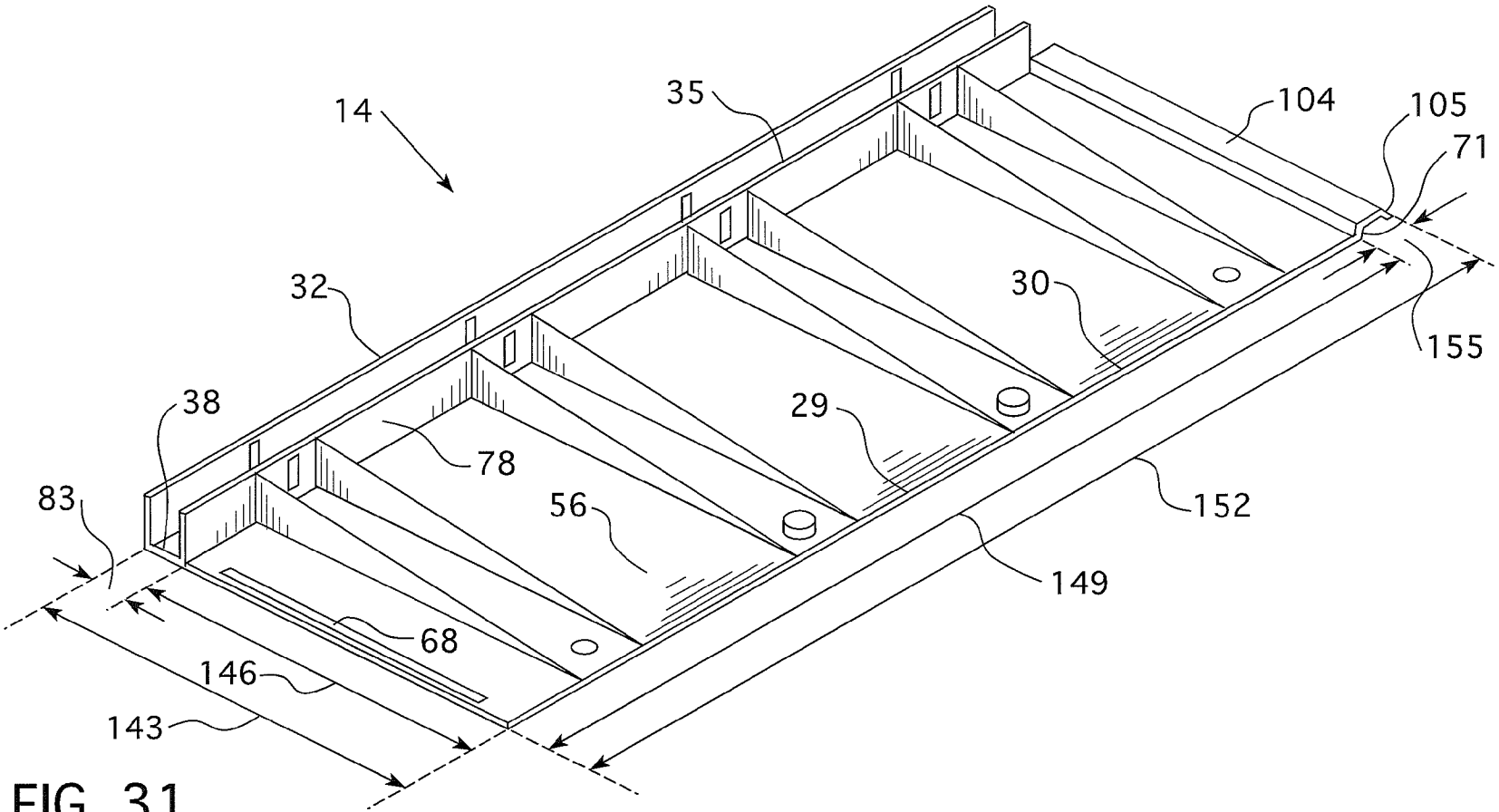
FIG. 31 is representative perspective view of the base plate of FIG. 3, which is presented for purposes of discussing the dimensions thereof.

With reference to FIG. 31, the width 143 of base 29 (from interior flange 32 to terminal end 30 of base 29) typically is from 15 cm to 100 cm, more typically from 20 cm to 60 cm, and further typically from 25 cm to 50 cm. In an embodiment of the present invention, width 143 of base 29 has a value of 40 cm. The width 146 of exterior base portion 56 (extending outward from exterior surface 98 of exterior flange 35 to the terminal end 30 of base 29) is typically from 10 cm to 90 cm, more typically from 15 cm to 55 cm, and further typically from 20 cm to 45 cm. In an embodiment of the present invention, width 146 of exterior base portion 56 has a value of 33 cm.

The length 149 of base 29 (from first side base edge 68 to second side base edge 71) is typically from 45 cm to 290 cm, more typically from 65 cm to 190 cm, and further typically from 75 cm to 120 cm. In an embodiment of the present invention, length 149 of base 29 has a value of 90 cm. The length 152 of base plate 14 (from first base edge 68 to outer edge 105 of interlock structure 104) is typically from 50 cm to 300 cm, more typically from 70 cm to 200 cm, and further typically from 80 cm to 130 cm. In an embodiment of the present invention, length 152 of base plate 14 has a value of 95 cm.

Figure 7:
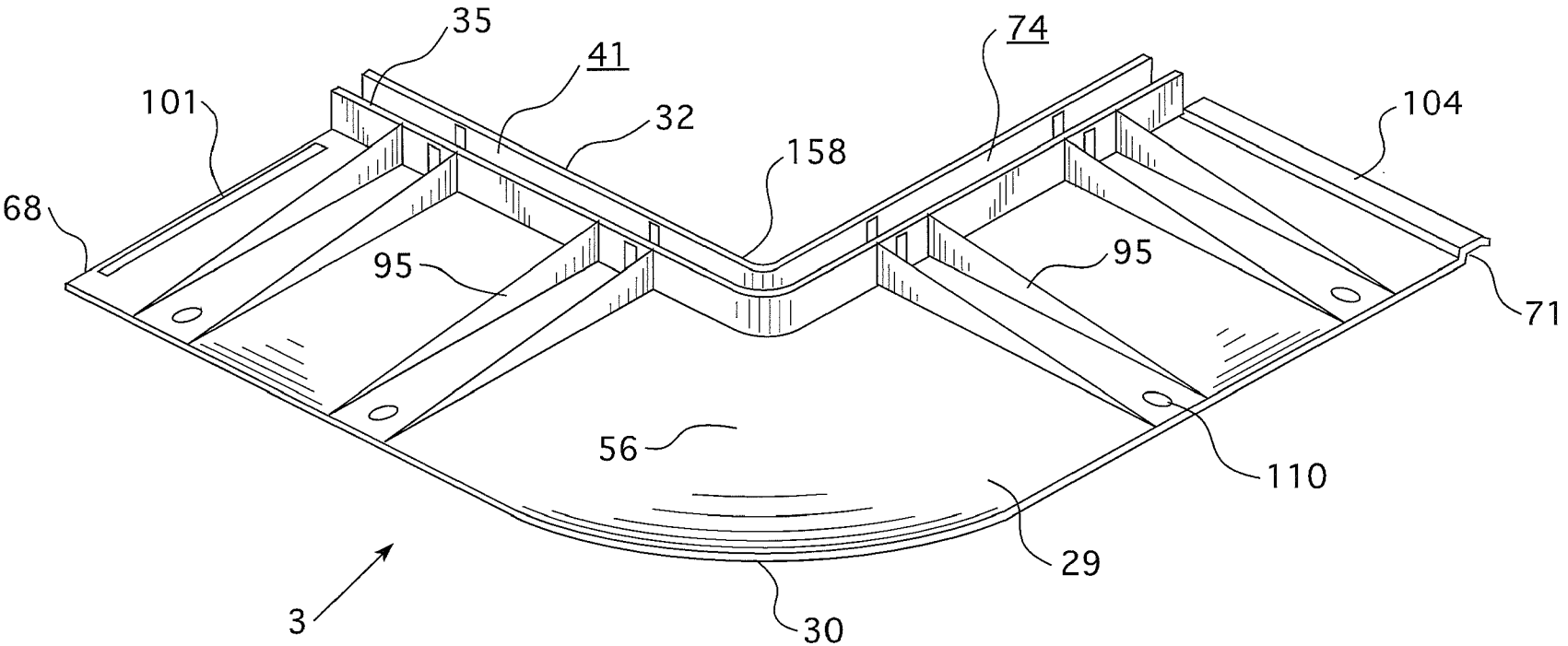
FIG. 7 is a representative perspective view of a corner base plate according to the present invention.
Figure 27:
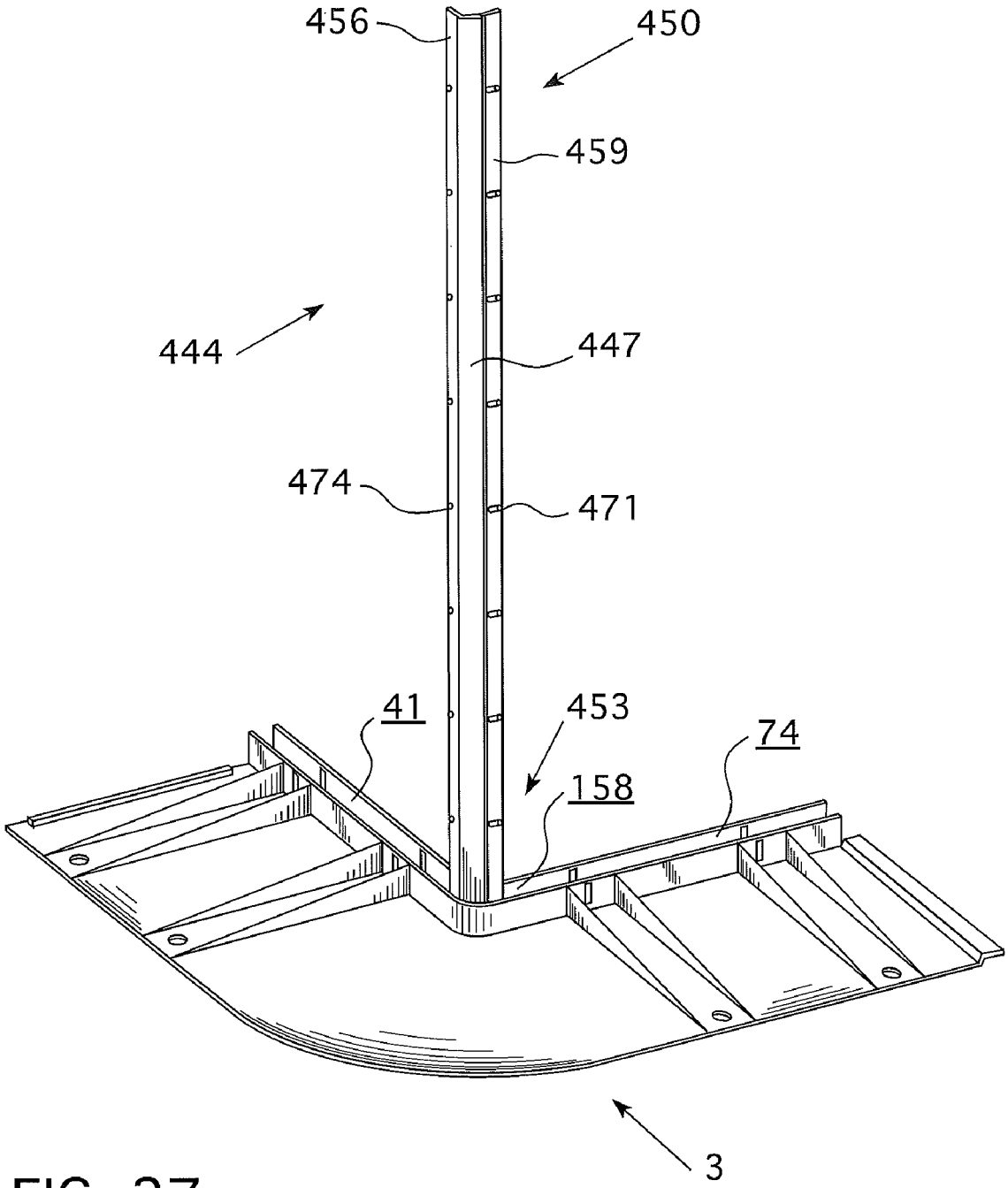
FIG. 27 is a representative perspective view of a corner structure extending upwardly from the channel of a corner base plate according to the present invention.

The base perimeter structure of the enclosed structure of the present invention may optionally include one or more corner base plates. The number of corner base plates may be selected based on the number of corners the enclosed structure has. With reference to FIGS. 1, 7 and 27, base perimeter structure 11 also includes corner base plates 3. Corner base plate 3 may be described with reference to base plates 14 and 15 previously herein, and includes, for example, interior flange 32, exterior flange 35 which together define channel 41, base 29 having exterior base portion 56, raised lip 101, interlock structure 104, support ribs 95 and anchor apertures 110. Interior flange 32 and exterior flange 35 of corner base plate 3 form a corner channel juncture 158 that has a corner angle of greater than 0° and less than 180°, typically from 30° to 90° (inclusive of the recited values). As depicted in FIG. 7, corner channel juncture 158 has a corner angle of substantially 90°. Corner channel juncture may be dimensioned to provide support for a corner structure extending upward therefrom, as will be discussed in detail further herein.

The exterior wall structure 17 of the enclosed structure 1 of the present invention includes a plurality of sidewall panels 20. Each sidewall panel 20 includes: an upper sidewall edge 164 a lower sidewall portion 128, a first sidewall edge 167, a second sidewall edge 170, an interior sidewall side 173 and an exterior sidewall side 176. Each sidewall panel 20 has a first sidewall tab 179 extending outwardly from first sidewall edge 167, and a second sidewall tab 182 extending outwardly from second sidewall edge 170.

With reference to FIGS. 4 and 8, lower sidewall portion 128 of sidewall 20 is received within channel 41 of at least one base plate 14 (and correspondingly base perimeter channel 74 of base perimeter structure 11). Sidewall panel 20 thus extends upwardly from channel 41 and correspondingly base perimeter channel 74.

As depicted in FIG. 8, lower portion 128 of sidewall panel 20 is received within the aligned channels 41 of two neighboring and interlocked base plates 14 and 14'. Such an arrangement of a single sidewall panel and two neighboring and interlocked base plates may be desirable for reasons of improved structural stability, in particular with regard to the neighboring and interlocked base plates. For example, when sidewall panel 20 and the neighboring base plates are fixedly attached together (e.g., by means of fasteners, such as sidewall-base plate fasteners 125) sidewall panel 20 serves to further connect the neighboring base plates together, in addition to interlock arrangement 108.

In addition, the arrangement of a single sidewall panel and two neighboring and interlocked base plates also serves to occlude any separation or vertical breaks between the adjacent terminal edges of the exterior and/or interior flanges of the base plates. With reference to FIGS. 5 and 8, lower portion 128 of sidewall panel 20 is received within the aligned channels 41 of neighboring and interlocked base plates 14 and 14' and occludes vertical break (or separation) 86 between the adjacent terminal edges of exterior flanges 35 (and the adjacent terminal edges of interior flanges 32, not shown in FIG. 5). Occlusion of vertical breaks between the interior and/or exterior flanges of neighboring base plates serves to better seal the substantially enclosed interior structure space 27 of the enclosed structure 1 of the present invention (e.g., minimizing or preventing the ingress of water into the interior structure space by means of such vertical breaks or separations).

Figure 29:
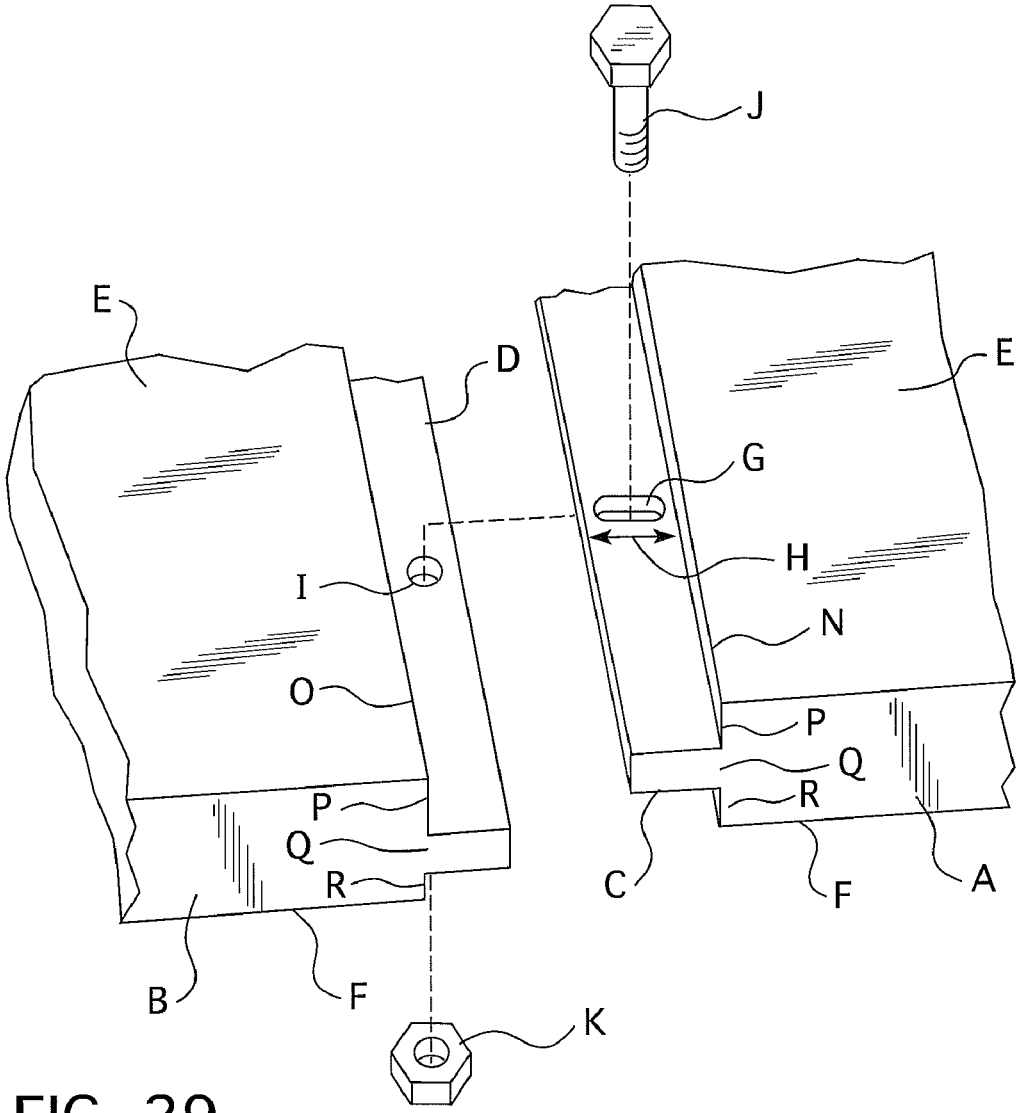
FIG. 29 is a representative exploded perspective view of a portion of overlapping panel tabs, in which an underlying circular tab aperture is aligned with a superposed elongated tab aperture.
Figure 30:
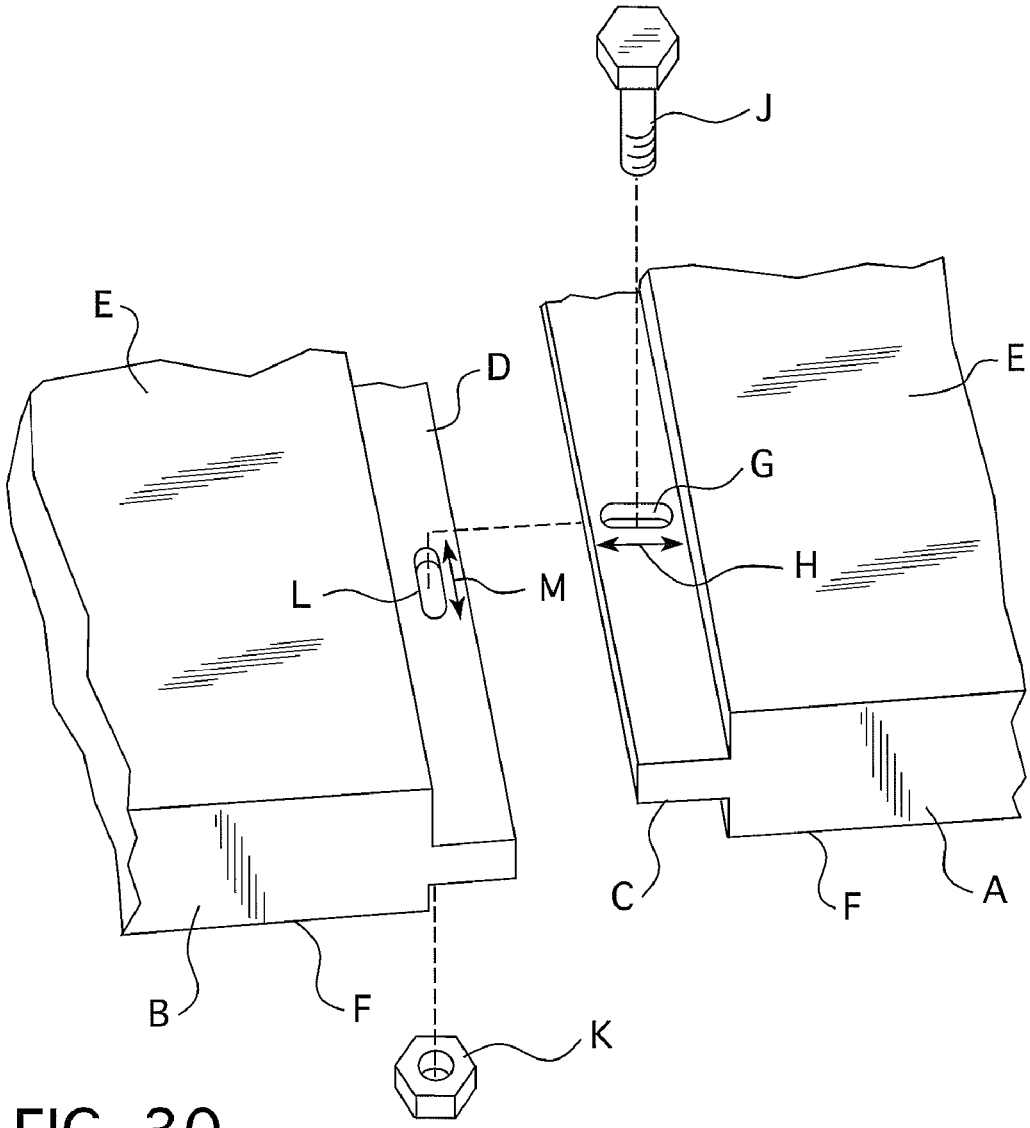
FIG. 30 is a representative exploded perspective view of a portion of the overlapping panel tabs of FIG. 29, in which an underlying elongated tab aperture is aligned with a superposed elongated tab aperture, the longitudinal axes of the aligned elongated tab apertures being orthogonal to each other.

The sidewall panels 20 of the sidewall structure 17 are arranged and positioned such that the first sidewall tab 179 and the second sidewall tab 182 of a neighboring sidewall panel overlappingly abut and are fixedly attached to each other. In FIGS. 29 and 30, the overlapping abutment and fixed attachment of a first panel tab C of one panel A, and a second panel tab D of a neighboring panel B is depicted in an exploded perspective view. The panel portions and tabs are presented in FIGS. 29 and 30 in a general format, so as to provide descriptions relative to the overlapping abutment and fixed attachment of the first and second tabs of neighboring panels, such as neighboring sidewall panels, neighboring roof panels, and first and second gable panels, as will be discussed further herein.

For purposes of the present discussion, and with further reference to FIGS. 29 and 30: panel A is representative of sidewall panel 20; first tab C is representative of first sidewall panel tab 179; neighboring panel B is representative of a neighboring sidewall panel 20'; second tab D is representative of second sidewall panel tab 182; side E is representative of exterior sidewall side 176; and side F is representative of interior sidewall side 173. In FIGS. 29 and 30, first tab C overlaps and abuts underlying second tab D. Alternatively, second tab D may overlap and abut first tab C, in which case, first tab C would be underlying relative to second tab D. First tab C and second tab D may be fixedly attached to each other by means of one or more adhesives interposed there-between (not shown), one or more fasteners passing there-through (e.g., screws, bolts, rivets and combinations thereof), snap fittings (not shown) and combinations thereof.

In an embodiment of the present invention, the first and second sidewall tabs of neighboring sidewall panels are fixedly attached together by one or more sidewall panel-sidewall panel fasteners passing through at least one pair of aligned sidewall panel tab apertures. In this particular embodiment, the first sidewall panel tab includes one or more apertures selected from circular apertures, elongated apertures and combinations thereof; and the second sidewall panel tab includes one or more apertures selected from circular apertures, elongated apertures and combinations thereof. At least one aperture of the first sidewall panel tab is aligned with at least one aperture of the second sidewall panel tab (of the neighboring sidewall panel), thereby forming at least one pair of aligned sidewall panel tab apertures. Each pair of aligned sidewall panel tab apertures, however, are free of (i.e., do not include): (i) aligned circular apertures; and (ii) aligned elongated apertures having parallel longitudinal axes. That is, each pair of aligned sidewall panel tab apertures is composed of only: (a) a circular aperture aligned with an elongated aperture; or (b) an elongated aperture aligned with an elongated aperture, in which the longitudinal axes of the aligned elongated apertures are not parallel to each other.

Selecting each pair of aligned sidewall panel tab apertures such that they are free of aligned circular apertures, and aligned elongated apertures having parallel longitudinal axes, provides a desirable balance of physical properties. Such a desirable balance of physical properties includes, for example, fixedly attaching neighboring sidewall panels together, while at the same time allowing the fixedly attached neighboring sidewall panels to move slightly relative to each other so as to compensate for thermal expansion and/or contraction of the materials from which the sidewall panels are fabricated. In the absence of such compensative movement, the sidewall tabs may become overly stressed as the result of thermal expansion and/or contraction, resulting in cracking and catastrophic failure of the tabs. A pair of aligned circular apertures typically provides too little compensative movement. A pair of aligned elongated apertures having parallel longitudinal axes typically allows too much movement between the overlapping and abutting sidewall tabs, thus rendering the sidewall structure dimensionally unstable.

Further reference is made to FIGS. 29 and 30 in which panel A is representative of sidewall panel 20, neighboring panel B is representative of a neighboring sidewall panel 20', and the remaining Latin characters are as described above with regard to the sidewall panels. In FIG. 29, first sidewall panel tab C of sidewall panel A includes an elongated aperture G (in the form of a slot) having a longitudinal axis H (which is substantially horizontal), that is aligned with circular aperture I of second sidewall panel tab D. A fastener J, in the form of a threaded bolt, extends or passes through the pair of aligned apertures G and I, and is threadingly engaged with nut K. The aligned pair of circular aperture I and elongated aperture G allows for compensative horizontal movement between first sidewall panel tab C and second sidewall panel tab D, and correspondingly first sidewall panel A and second sidewall panel B. Longitudinal axis H of elongated slot G (of FIG. 29) may also be aligned substantially vertically, or any angle between vertical and horizontal alignments.

In FIG. 30, first sidewall panel tab C of sidewall panel A includes an elongated aperture G (in the form of a slot) having a longitudinal axis H (which is substantially horizontally oriented), that is aligned with elongated aperture L (in the form of a slot) having a longitudinal axis M (which is substantially vertically oriented). Longitudinal axis H of elongated aperture G and longitudinal axis M of elongated aperture L are substantially orthogonal to each other. Fastener J, in the form of a threaded bolt, extends or passes through the pair of aligned apertures G and L, and is threadingly engaged with nut K. The aligned pair of elongated apertures L and G allows for compensative movement in both the horizontal and vertical directions between first sidewall panel tab C and second sidewall panel tab D, and correspondingly first sidewall panel A and second sidewall panel B. The longitudinal axes H and M of the aligned pair of elongated apertures G and L may be aligned relative to each other so as to form any angle other than 0° (i.e., such that the axes are not parallel).

The first and second sidewall tabs may each independently comprise a plurality of separate (or discontinuous) tabs that together define the sidewall tab, or be a substantially unitary (or continuous) sidewall tab. In an embodiment of the present invention, first sidewall tab 179 is a substantially unitary first sidewall tab that extends outward from and substantially longitudinally along first sidewall edge 167, and second sidewall tab 182 is a substantially unitary second sidewall tab that extends outward from and substantially longitudinally along second sidewall edge 170, as depicted in the drawing figures (e.g., FIGS. 9 and 12). The sidewall tabs typically have a thickness that is less than the thickness of the sidewall panel (e.g., the thickness of the sidewall panel as determined from sidewall panel exterior side 176 to sidewall panel interior side 173). In an embodiment, the sidewall panel tabs each individually have a thickness that is from 20 percent to 50 percent that of the thickness of the sidewall panel, inclusive of the recited values.

Overlapping abutment of the first sidewall tab and the second sidewall tab of a neighboring sidewall panel is achieved by positioning the sidewall tabs in an offset fashion along the inner, middle or outer portions of the respective sidewall edge (whether the sidewall tabs are continuous, discontinuous or a combination thereof). In an embodiment of the present invention, and with further reference to FIGS. 29 and 30, first sidewall edge N (167) of sidewall panel A (20), and second sidewall edge O (170) of neighboring sidewall panel B (20') each have an outer portion P, a middle portion Q and an inner portion R. Outer portion P being proximate to exterior sidewall side E (176), inner portion R being proximate to interior sidewall side F (173), and middle portion Q of each sidewall edge being interposed there-between. Substantially unitary first sidewall tab C (179) extends from middle portion Q of first sidewall edge N (167) of sidewall panel A (20), and accordingly substantially unitary second sidewall tab D (182) may extend from either outer portion P or inner portion R of second sidewall edge O (170) of neighboring sidewall panel B (20'), thereby facilitating abutting overlap between the first and second neighboring sidewall tabs. As depicted in FIGS. 29 and 30, second sidewall tab D (182) of neighboring sidewall panel B (20') extends from inner portion R of sidewall edge O (170) thereof. Equivalently, the second sidewall tab may extend from the middle portion of the sidewall edge of the neighboring sidewall panel, while the first sidewall tab extends from the outer or inner portion of the sidewall edge of the other neighboring sidewall panel (e.g., sidewall panel A/20). While not depicted in FIGS. 29 and 30, a sidewall tab may extend from outer portion P or inner portion R so as to be flush (e.g., aligned or continuous) with sidewall exterior side E or sidewall interior side F, respectively.

The sidewall panels of the enclosed structure may have a wide range of dimensions. Typically, each sidewall panel independently has a length (or height) of from 50 cm to 300 cm, more typically from 100 cm to 250 cm, and further typically from 150 cm to 230 cm. Each sidewall panel may independently have a width (inclusive of the first and second sidewall tabs) of from 50 cm to 200 cm, more typically from 80 cm to 150 cm, and further typically from 100 cm to 125 cm. The first and second sidewall tabs may each extend out from the respective first or second sidewall edges a distance of from 1.25 cm to 7.5 cm, more typically from 2 cm to 5 cm, and further typically from 3 cm to 4 cm. Each sidewall tab typically has a thickness of from 3 mm to 15 mm, more typically from 4 mm to 12 mm, and further typically from 5 mm to 10 mm. Upper portion 279 of each sidewall panel typically has a thickness 285 (FIG. 11) of from 1.5 cm to 7.5 cm, more typically from 2 cm to 6 cm, and further typically from 4 cm to 5.5 cm. Lower portion 128 of each sidewall panel typically has a thickness 288 (FIG. 11) of from 1.25 cm to 7.25 cm, more typically from 1.75 cm to 5.75 cm, and further typically from 3.75 cm to 4.75 cm. In an embodiment of the invention, each sidewall panel has a length (or height) of 180 cm, a width of 90 cm, an upper portion thickness (285) of 5 cm, and a lower portion thickness (288) of 4.5 cm; and the first and second sidewall tabs each extend out from the respective first or second sidewall edges a distance of 3 cm, and have a thickness of 6 mm.

Figure 18:
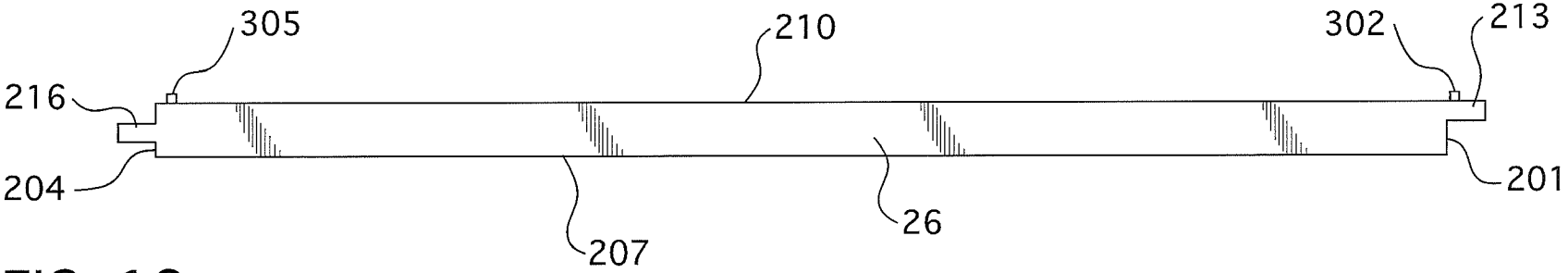
FIG. 18 is a representative plan view of the upper edge of a roof panel according to the present invention.
Figure 19:
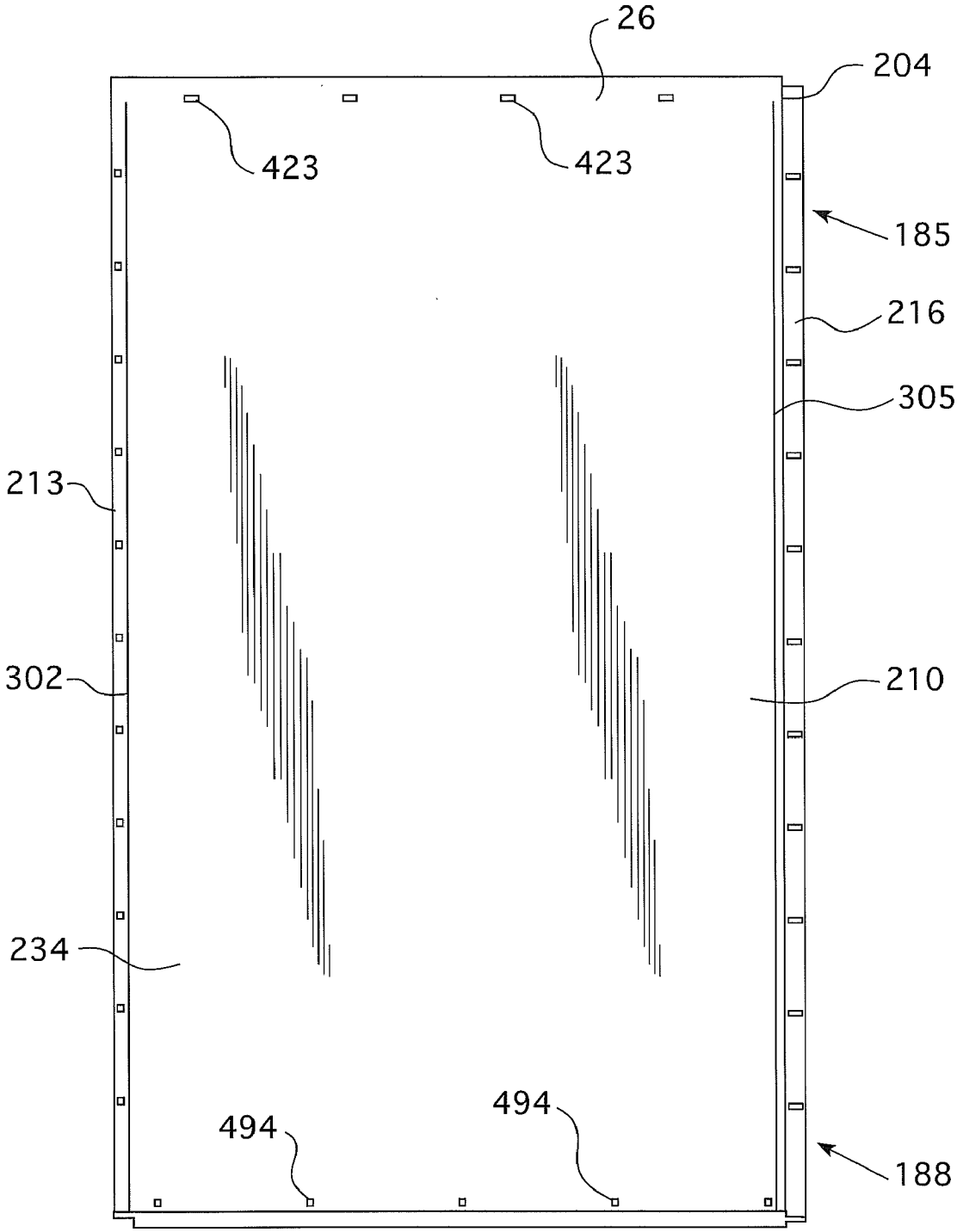
FIG. 19 is a representative plan view of the exterior side of a roof panel according to the present invention.

As discussed previously herein, enclosed structure 1 includes a roof structure 23 that comprises a plurality of roof panels 26. With reference to FIGS. 18 and 19, each roof panel 26 has an upper roof panel portion 185, a lower roof panel portion 188, a first roof panel side edge 201, a second roof panel side edge 204, an interior roof panel side 207, and an exterior roof panel side 210. Each roof panel 26 further includes at least one first roof panel tab 213 extending outwardly from first roof panel side edge 201, and at least one second roof panel tab 216, extending outwardly from said second roof panel side edge 204.

The roof panels 20 are arranged such that first roof panel tab 213 and second roof panel tab 216 of a neighboring roof panel overlappingly abut and are fixedly attached to each other. The overlapping abutment of the first and second roof panel tabs will be discussed herein with reference to FIGS. 29 and 30. As discussed previously herein, FIGS. 29 and 30 are presented in a general format, so as to provide descriptions of the overlapping abutment of the various panel tabs of the enclosed structure of the present invention. For purposes of the present discussion of the roof panel tabs, in FIGS. 29 and 30: panel A is representative of roof panel 26; first tab C is representative of first roof panel tab 213; neighboring panel B is representative of a neighboring roof panel 26'; second tab D is representative of second roof panel tab 216; side E is representative of exterior roof panel side 210; and side F is representative of interior roof panel side 207. In FIGS. 29 and 30, first tab C overlaps and abuts underlying second tab D. Alternatively, second tab D may overlap and abut first tab C, in which case first tab C would be underlying relative to second tab D. First tab C and second tab D may be fixedly attached to each other by means of one or more adhesives interposed there-between (not shown), one or more fasteners passing there-through (e.g., screws, bolts, rivets and combinations thereof), snap fittings (not shown) and combinations thereof.

In an embodiment of the present invention, the first and second roof panel tabs of neighboring roof panels are fixedly attached together by one or more roof panel-roof panel fasteners passing through at least one pair of aligned roof panel tab apertures. In this particular embodiment, the first roof panel tab includes one or more apertures selected from circular apertures, elongated apertures and combinations thereof; and the second roof panel tab includes one or more apertures selected from circular apertures, elongated apertures and combinations thereof. At least one aperture of the first roof panel tab is aligned with at least one aperture of the second roof panel tab (of the neighboring roof panel), thereby forming at least one pair of aligned roof panel tab apertures. Each pair of aligned roof panel tab apertures, however, are free of (i.e., do not include): (i) aligned circular apertures; and (ii) aligned elongated apertures having parallel longitudinal axes. That is, each pair of aligned roof panel tab apertures is composed of only: (a) a circular aperture aligned with an elongated aperture; or (b) an elongated aperture aligned with an elongated aperture, in which the longitudinal axes of the aligned elongated apertures are not parallel to each other.

Selecting each pair of aligned roof panel tab apertures such that they are free of aligned circular apertures, and aligned elongated apertures having parallel longitudinal axes, provides a desirable balance of physical properties. Such a desirable balance of physical properties includes, for example, fixedly attaching neighboring roof panels together, while at the same time allowing the fixedly attached neighboring roof panels to move slightly relative to each other so as to compensate for thermal expansion and/or contraction of the materials from which the roof panels are fabricated. In the absence of such compensative movement, the roof panel tabs may become overly stressed as the result of thermal expansion and/or contraction, resulting in cracking and catastrophic failure of the tabs. A pair of aligned circular apertures typically provides too little compensative movement. A pair of aligned elongated apertures having parallel longitudinal axes typically allows too much movement between the overlapping and abutting roof panel tabs, thus rendering the roof structure dimensionally unstable.

In FIG. 30, first roof panel tab C of roof panel A includes an elongated aperture G (in the form of a slot) having a longitudinal axis H (which is substantially horizontally oriented), that is aligned with elongated aperture L (in the form of a slot)

having a longitudinal axis M (which is substantially vertically oriented). Longitudinal axis H of elongated aperture G and longitudinal axis M of elongated aperture L are substantially orthogonal to each other. Fastener J, in the form of a threaded bolt, extends or passes through the pair of aligned apertures G and L, and is threadingly engaged with nut K. The aligned pair of elongated apertures L and G allows for compensative movement in both the horizontal and vertical directions between first roof panel tab C and second roof panel tab D, and correspondingly first roof panel A and second roof panel B. The longitudinal axes H and M of the aligned pair of elongated apertures G and L may be aligned relative to each other so as to form any angle other than 0° (i.e., such that the axes are not parallel).

The first and second roof panel tabs may each independently comprise a plurality of separate (or discontinuous) tabs that together define the roof panel tab, or be a substantially unitary (or continuous) roof panel tab. In an embodiment of the present invention, first roof panel tab 213 is a substantially unitary first sidewall tab that extends outwardly from and substantially longitudinally along first roof panel edge 201, and second roof panel tab 216 is a substantially unitary second sidewall tab that extends outwardly from and substantially longitudinally along second roof panel edge 204, as depicted in the drawing figures (e.g., FIG. 19). The roof panel tabs typically have a thickness that is less than the thickness of the roof panel (e.g., the thickness of the roof panel as determined from roof panel exterior side 210 to roof panel interior side 207). In an embodiment, the roof panel tabs each individually have a thickness that is from 20 percent to 50 percent that of the thickness of the roof panel, inclusive of the recited values.

Overlapping abutment of the first roof panel tab and the second roof panel tab of a neighboring roof panel is achieved by positioning the roof panel tabs in an offset fashion along the inner, middle or outer portions of the respective roof panel edge (whether the roof panel tabs are continuous, discontinuous or a combination thereof). In an embodiment of the present invention, and with further reference to FIGS. 29 and 30, first roof panel edge N (201) of roof panel A (26), and second roof panel edge O (204) of neighboring sidewall panel B (26') each have an outer portion P, a middle portion Q and an inner portion R. Outer portion P being proximate to exterior roof panel side E (210), inner portion R being proximate to interior roof panel side F (207), and middle portion Q of each sidewall edge being interposed there-between. In FIGS. 29 and 30, substantially unitary first roof panel tab C (213) extends from middle portion Q of first roof panel edge N (201) of roof panel A (26), and accordingly substantially unitary second roof panel tab D (216) may extend from either outer portion P or inner portion R of second roof panel edge O (204) of neighboring sidewall panel B (26'), thereby facilitating abutting overlap between the first and second neighboring roof panel tabs. As depicted in FIGS. 29 and 30, second roof panel tab D (216) of neighboring roof panel B (26') extends from inner portion R of second roof panel edge O (204) thereof. Equivalently, the second roof panel tab may extend from the middle portion of the roof panel edge of the neighboring roof panel, while the first roof panel tab extends from the outer or inner portion of the roof panel edge of the other neighboring roof panel (e.g., roof panel A/26). While not depicted in FIGS. 29 and 30, a roof panel tab may extend from outer portion P or inner portion R so as to be flush (e.g., aligned or continuous) with roof panel exterior side E or roof panel interior side F, respectively.

The roof panels of the enclosed structure may have a wide range of dimensions. Typically each roof panel independently has a length (or height) of from 100 cm to 400 cm, more typically from 150 cm to 350 cm, and further typically from 200 cm to 250 cm. Each roof panel typically has a width (inclusive of the first and second roof panel tabs) of from 50 cm to 200 cm, more typically from 80 cm to 150 cm, and further typically from 100 cm to 125 cm. The first and second roof panel tabs may each extend out from the respective first or second roof panel edges a distance of from 1.25 cm to 7.5 cm, more typically from 2 cm to 5 cm, and further typically from 3 cm to 4 cm. Each roof panel tab typically has a thickness of from 3 mm to 15 mm, more typically from 4 mm to 12 mm, and further typically from 5 mm to 10 mm. Each roof panel typically has a thickness (from exterior side 210 to interior side 207) of from 1.25 cm to 7.6 cm, more typically from 2 cm to 5 cm, and further typically from 3 cm to 4 cm. In an embodiment, each roof panel has a length (or height) of 220 cm, a width of 90 cm, and a thickness of 5 cm; and the first and second roof panel tabs each extend out from the respective first or second roof panel edges a distance of 3 cm, and have a thickness of 6 mm.

Figure 20:
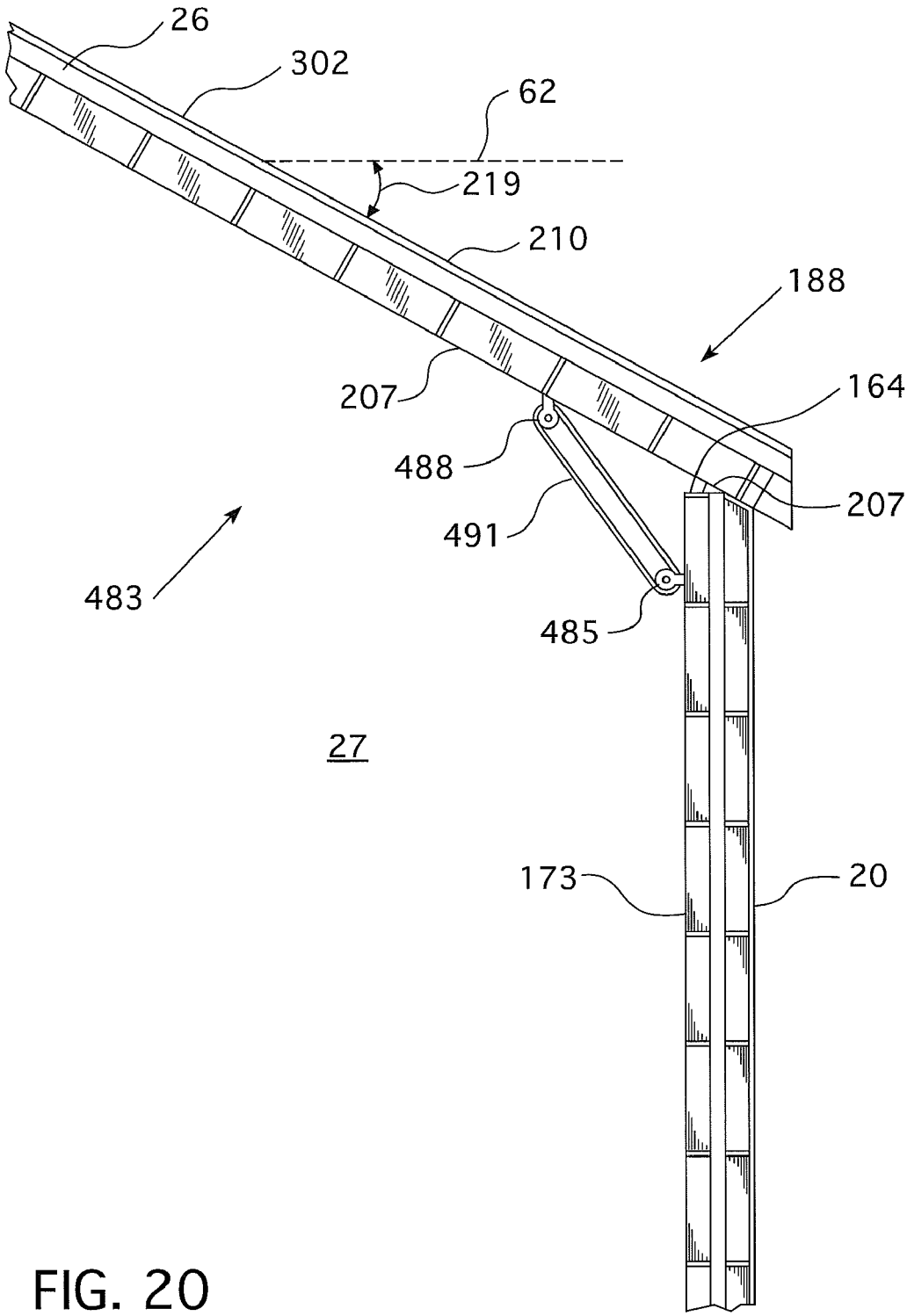
FIG. 20 is a representative side elevational view of a roof panel-sidewall panel arrangement according to the present invention, which includes a retainer that maintains the panel arrangement in abutting relationship.

With reference to FIG. 20, the roof and sidewall panels of the enclosed structure of the present invention are arranged such that a portion (i.e., a lower portion) of interior roof panel side 207 of lower roof panel portion 188 abuts upper sidewall edge 164 of at least one sidewall panel 20. Each roof panel 26 extends upwardly from at least one sidewall panel 20 and independently has a roof gradient angle 219 that is greater than or equal to 0° and less than 90°. Roof gradient angle 219 is determined relative to horizontal, as represented by dashed line 62, and more particularly the angle (219) formed between exterior roof panel side 210 and horizontal 62. Roof gradient angle 219 typically has a value of 5° to 60°, 10° to 50° or 20° to 45°, inclusive of the recited values. In an embodiment, roof gradient angle 219 is 30°.

The interior sides of the sidewall and roof panels together define the substantially enclosed interior structure space of the enclosed structure of the present invention. More particularly, and with further reference to FIG. 20, interior sidewall side 173 of sidewall panel 20 and interior roof panel side 207 of roof panel 26 together define substantially enclosed interior structure space 27.

Figure 9:
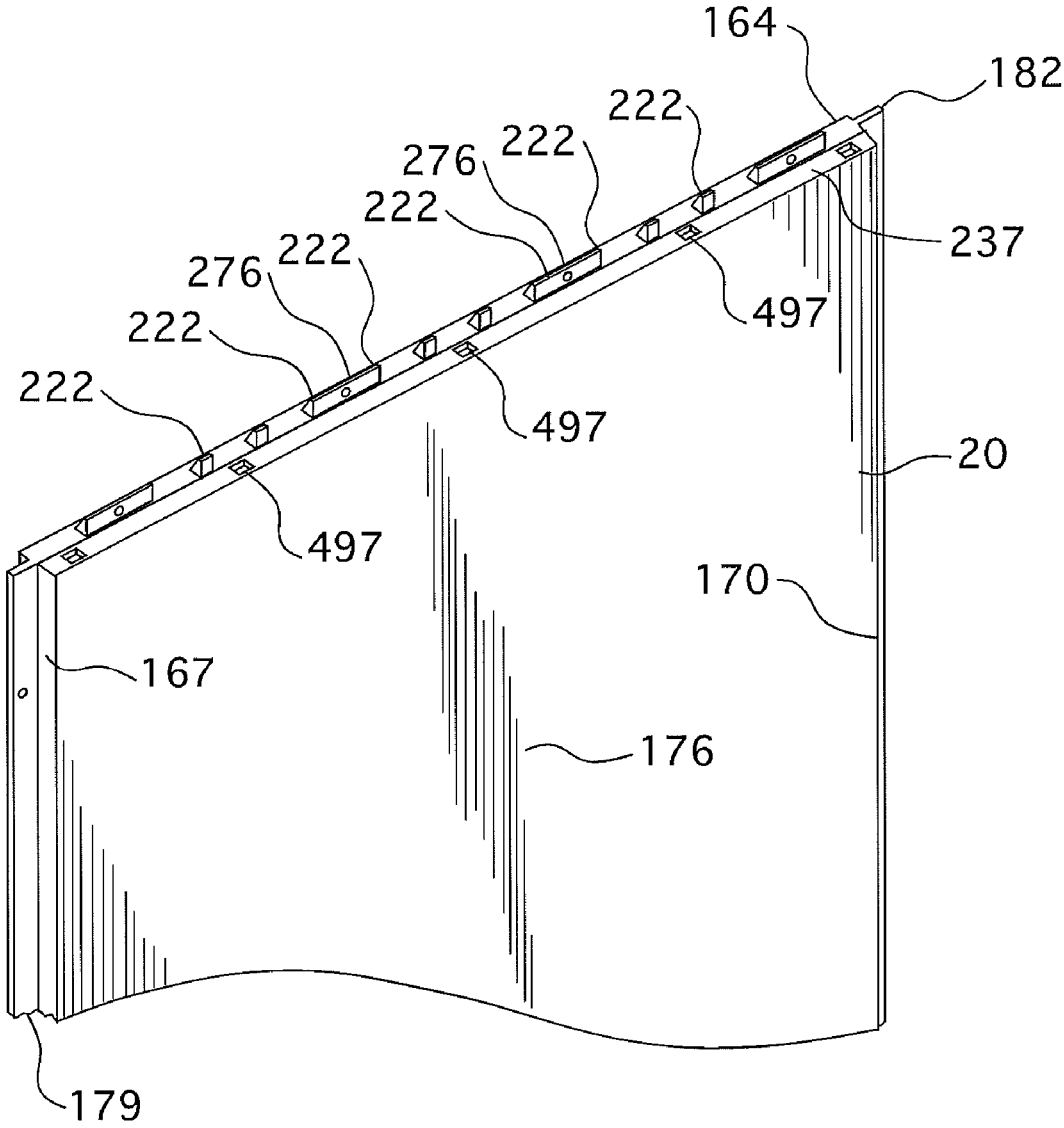
FIG. 9 is a representative perspective view of the upper sidewall edge of a sidewall panel according to the present invention that further includes a plurality of extensions.
Figure 10:
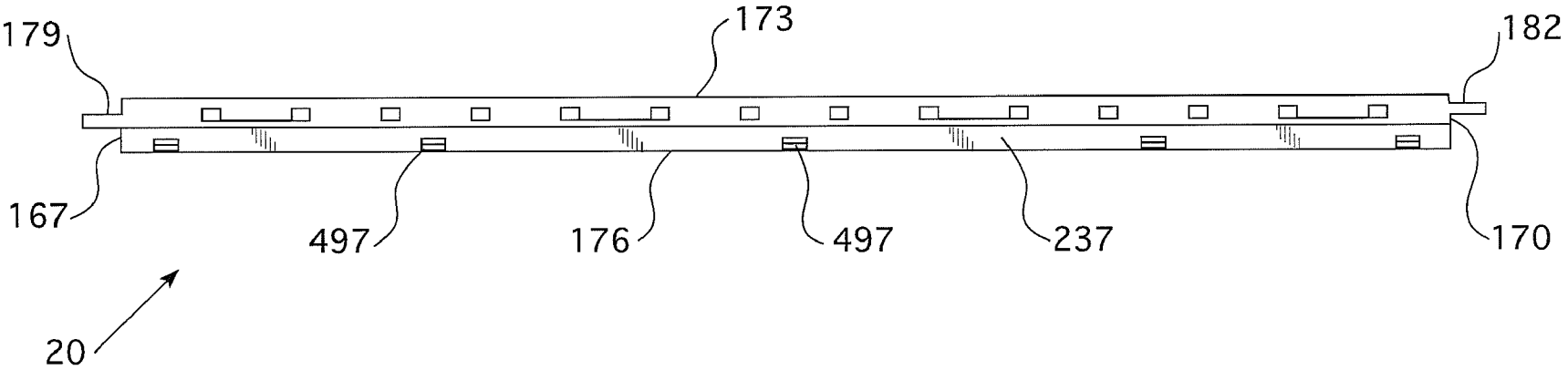
FIG. 10 is a representative top plan view of the upper sidewall edge of the sidewall panel of FIG. 9.
Figure 13:
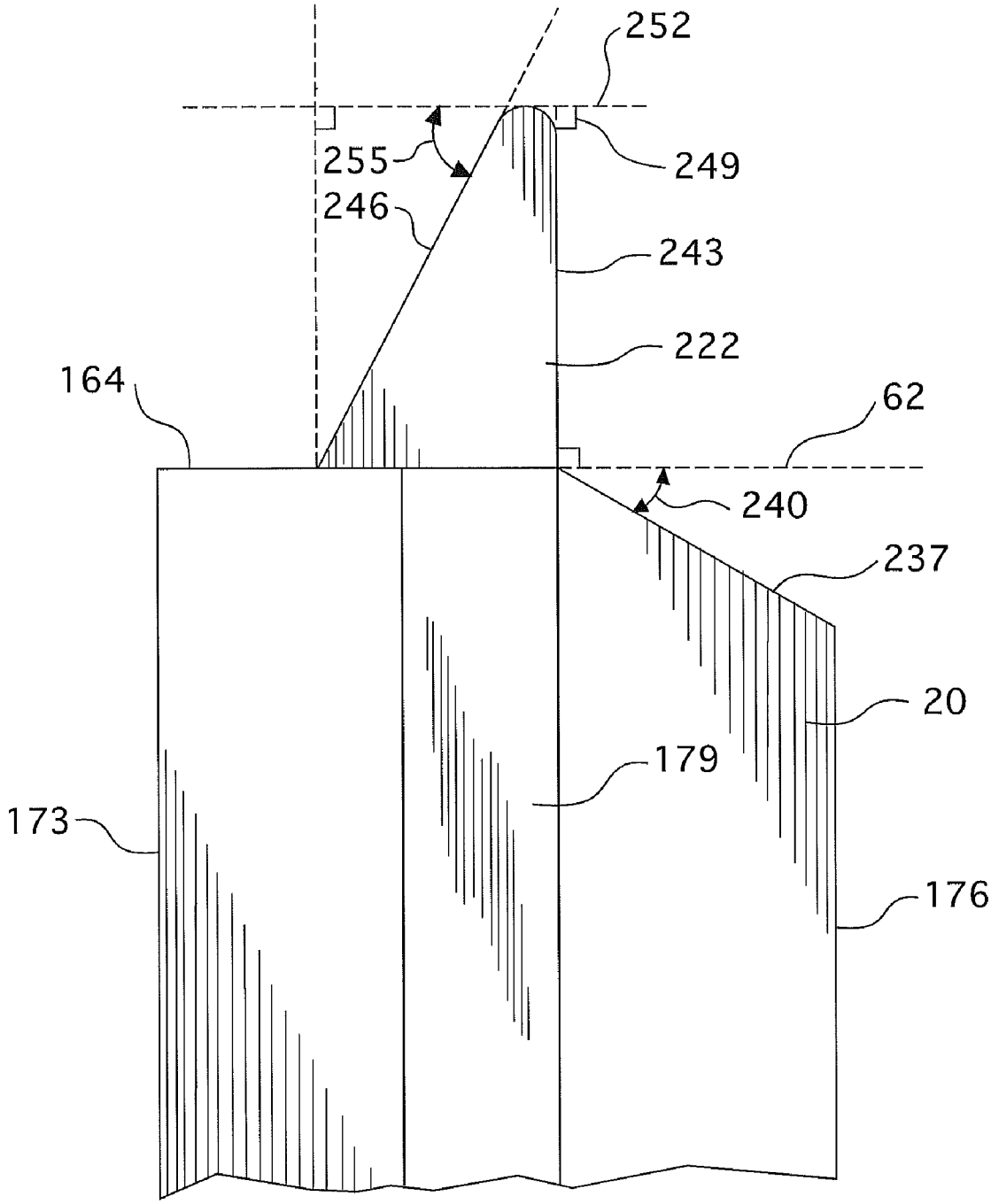
FIG. 13 is a representative side view of an extension extending upwardly from the upper sidewall edge of a sidewall according to the present invention.
Figure 14:
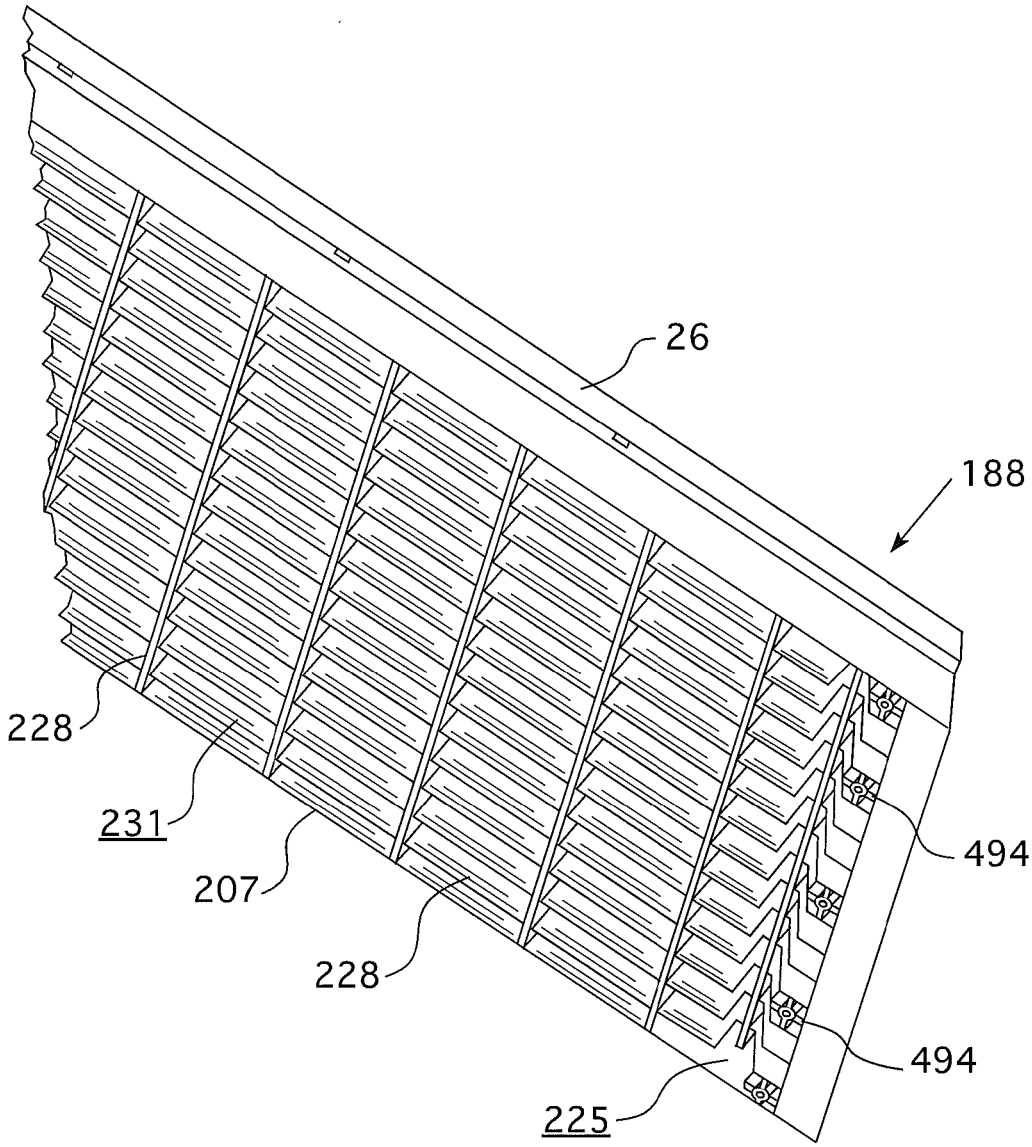
FIG. 14 is a representative perspective view of the interior side of a roof panel according to the present invention that includes a plurality of intersecting ribs, and a plurality of lower notches.
Figure 15:
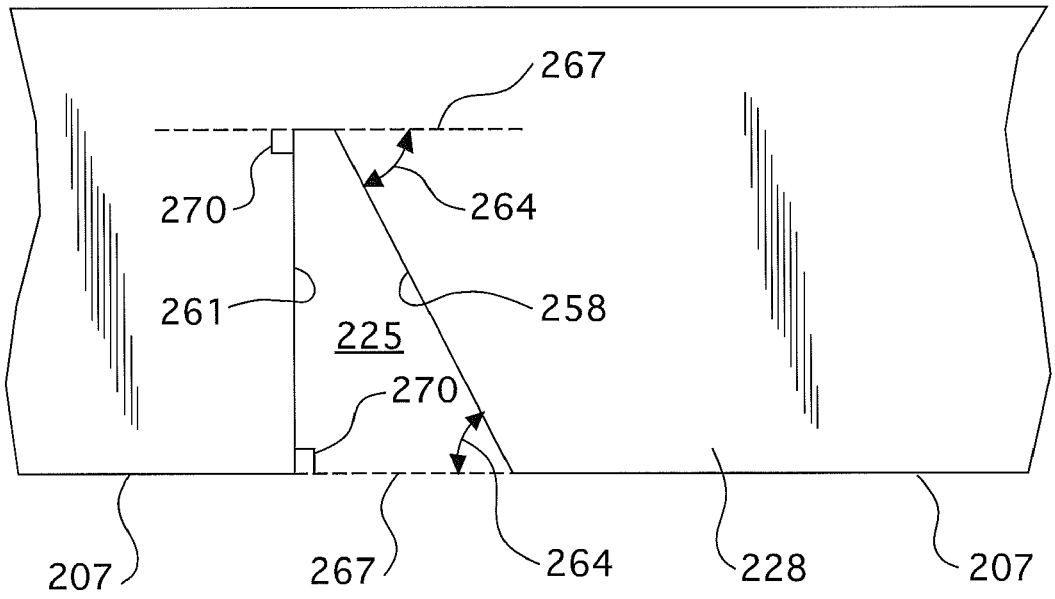
FIG. 15 is a representative isolated side view of a lower notch of the interior side of a roof panel according to the present invention.
Figure 16:
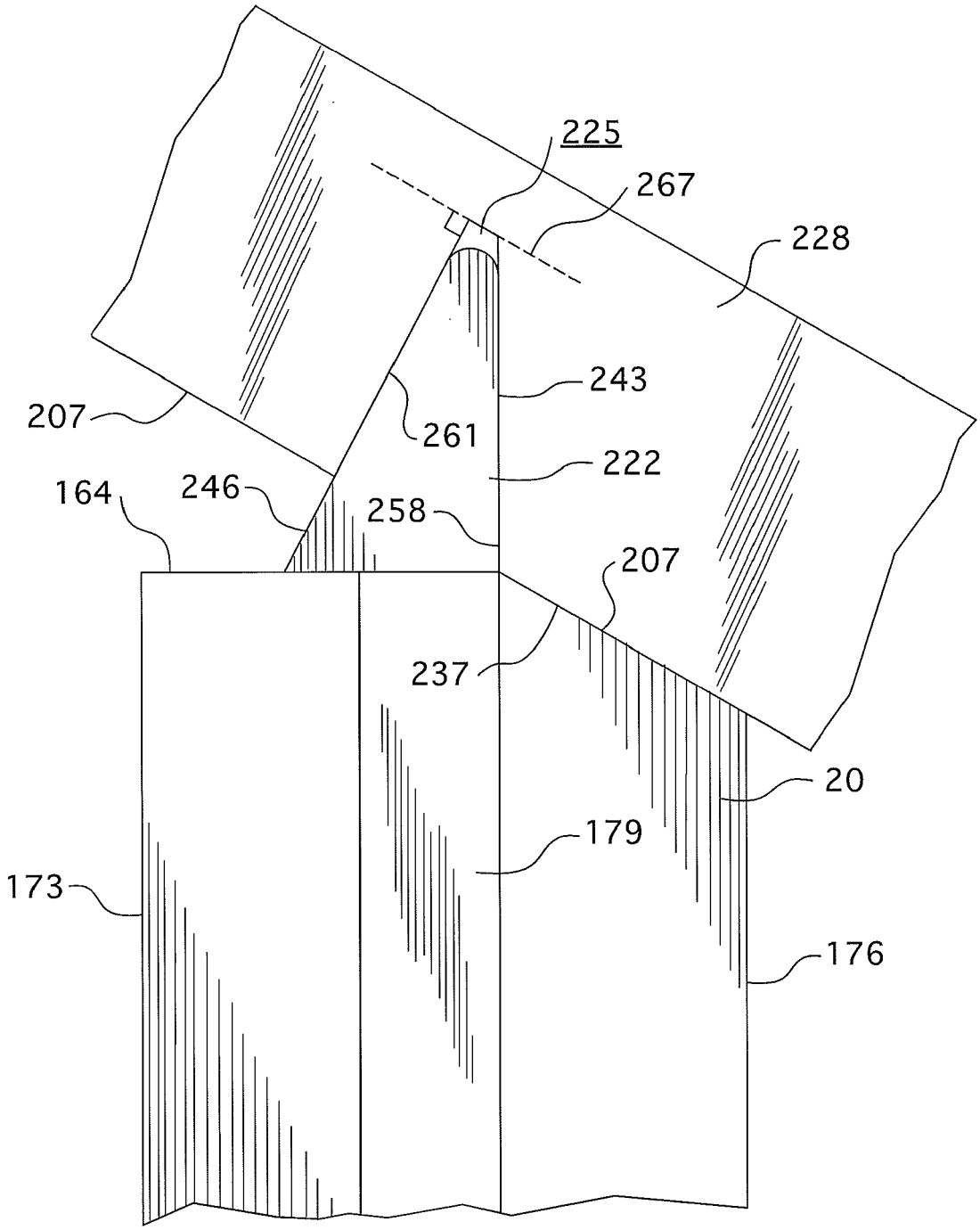
FIG. 16 is a representative side view of an extension of the upper sidewall edge of a sidewall panel being received within a lower notch of a roof panel.

To assist alignment between and engagement of the roof panels and sidewall panels, the upper sidewall edge of at least one sidewall panel further includes a plurality of extensions extending upward therefrom, and the lower interior roof panel side of at least one roof panel has a plurality of notches that are dimensioned and positioned to receive the sidewall extensions therein. Receipt of the sidewall extensions within the roof lower panel notches serves to maintain the roof gradient angle of the roof panel. With reference to FIGS. 9 and 13 through 17, sidewall panel 20 has a plurality of extensions 222 extending upwardly from upper sidewall edge 164 (FIGS. 9 and 13). Interior roof panel side 207 of lower roof panel portion 188 has a plurality of lower notches 225 (FIGS. 14 and 15). Each lower notch 225 is positioned and dimensioned to receive a sidewall extension 222 therein (FIG. 16).

Extensions 222 may extend singly upward from upper sidewall edge 164. Alternatively, sidewall panel 20 may further include an extension support rib 276 extending between at least two extensions 222, as depicted in FIG. 9. The inclusion of support rib 276 serves to further stabilize the extensions 222 connected thereby, for example, when a portion of the weight of the roof panel is transferred through extensions 222.

Lower notches 225 of the roof panel may be formed directly in interior roof panel side 207 when roof panel 20 is substantially solid, and interior roof panel side 207 is defined by a substantially continuous surface. In an embodiment of the present invention, interior roof panel side 207 comprises and is defined by a plurality of intersecting ribs 228 (FIG. 14), and exterior roof panel side 210 comprises (or is defined by) a substantially continuous surface 234 (FIG. 19). A plurality of intersecting ribs is desirable because it allows for a reduction in the weight of the roof panel without compromising the dimensional integrity thereof. Intersecting ribs 228 may have any suitable configuration, for example, forming inter-rib spaces 231 having shapes selected from polygons (e.g., triangles, rectangles, squares, pentagons, hexagons, heptagons, octagons, etc., and combinations thereof), circles, ovals (e.g., elliptical shapes), irregular shapes, and combinations thereof. As depicted in FIG. 14, intersecting ribs 228 define inter-rib spaces 231 having substantially rectangular shapes. Intersecting ribs 228 of roof panel 26 are typically continuous with each other and the roof panel itself, thus together forming a substantially continuous and unitary roof panel. In an embodiment of the present invention, and as depicted in the drawings, intersecting ribs 228 (i.e., a portion thereof) define lower notches 225 of roof panel 26. In addition, when present, intersecting ribs 228 also define interior roof panel side 207.

Receipt of sidewall extensions 222 within lower notches 225 of roof panel 26 serves to maintain roof gradient angle 219. In addition, such receipt of the sidewall extensions within the lower notches of the roof panel further serves to prevent the roof panel from sliding down and across the upper sidewall edge 164. Sidewall extensions 222 and lower roof panel notches 225 also provide for easier assembly of the enclosed structure of the present invention by, for example, allowing on-site assemblers to more quickly and efficiently connect the sidewall and roof panels together, while at the same time setting the roof gradient angle.

To better provide for maintaining the roof gradient angle, the upper sidewall edge, and optionally the surfaces of the sidewall extensions, and further optionally the surfaces defining the lower notches of the roof panel may be modified so as to possess selected angled surfaces. In an embodiment, and with reference to FIG. 13, upper sidewall edge 164 of at least one sidewall panel 20 has an exterior chamfered edge portion 237. Exterior chamfered edge portion 237 of upper sidewall edge 164 extends outward and downward from extensions 222 (toward exterior sidewall side 176 of sidewall panel 20), and has an exterior chamfered edge portion gradient angle 240. Exterior chamfered edge portion gradient angle 240 is the angle that exterior chamfered edge portion 237 drops (or forms) relative to horizontal (as represented by dashed line 62 in FIG. 13). Extensions 222 are received within lower notches 225 of roof panel 26 such that a portion of interior roof panel side 207 abuts exterior chamfered edge portion 237 of upper sidewall edge 164 (FIG. 16). In an embodiment, exterior chamfered edge portion gradient angle 240 (FIG. 13), and roof gradient angle 219 (FIG. 20) are substantially equivalent angles.

In a further embodiment, the extensions of at least one sidewall panel have forward and rear surfaces that are selected so as to possess specific angled surfaces. With reference to FIG. 13, extension 222 has a forward extension surface 243, and a rear extension surface 246. Forward extension surface 243 faces towards (in the same direction as) exterior sidewall side 176 of sidewall panel 20, and has a forward extension surface gradient angle 249 of 90° (relative to horizontal line 252). Rear extension surface 246 faces towards (in the same direction as) interior sidewall side 173 of sidewall panel 20, and has a rear extension surface gradient angle 255 (relative to horizontal 252) that is determined by the following equation, (90°−roof gradient angle)

The selection of the forward extension surface gradient angle 249 and the rear extension surface gradient angle 255, serves to maintain the roof gradient angle, in particular, when the lower notches of the roof panel into which the sidewall extensions are received also have selected angled forward and rear notch surfaces. With reference to FIG. 15, lower notch 225 of roof panel 26 is defined by a forward notch surface 258 and a rear notch surface 261. Forward notch surface 258 has a forward notch surface gradient angle 264 as determined by the following equation, (90°−roof gradient angle)

Rear notch surface 261 has a rear notch surface gradient angle 270 of 90°. Forward notch surface gradient angle 264 and rear notch surface gradient angle 270 are each determined relative to horizontal (as represented by dashed line 267 in FIG. 15). With reference to FIG. 16, at least a portion of rear notch surface 261 abuts at least a portion of rear extension surface 246 of sidewall extension 222, when extension 222 is received within lower notch 225 of roof panel 26.

Figure 17:
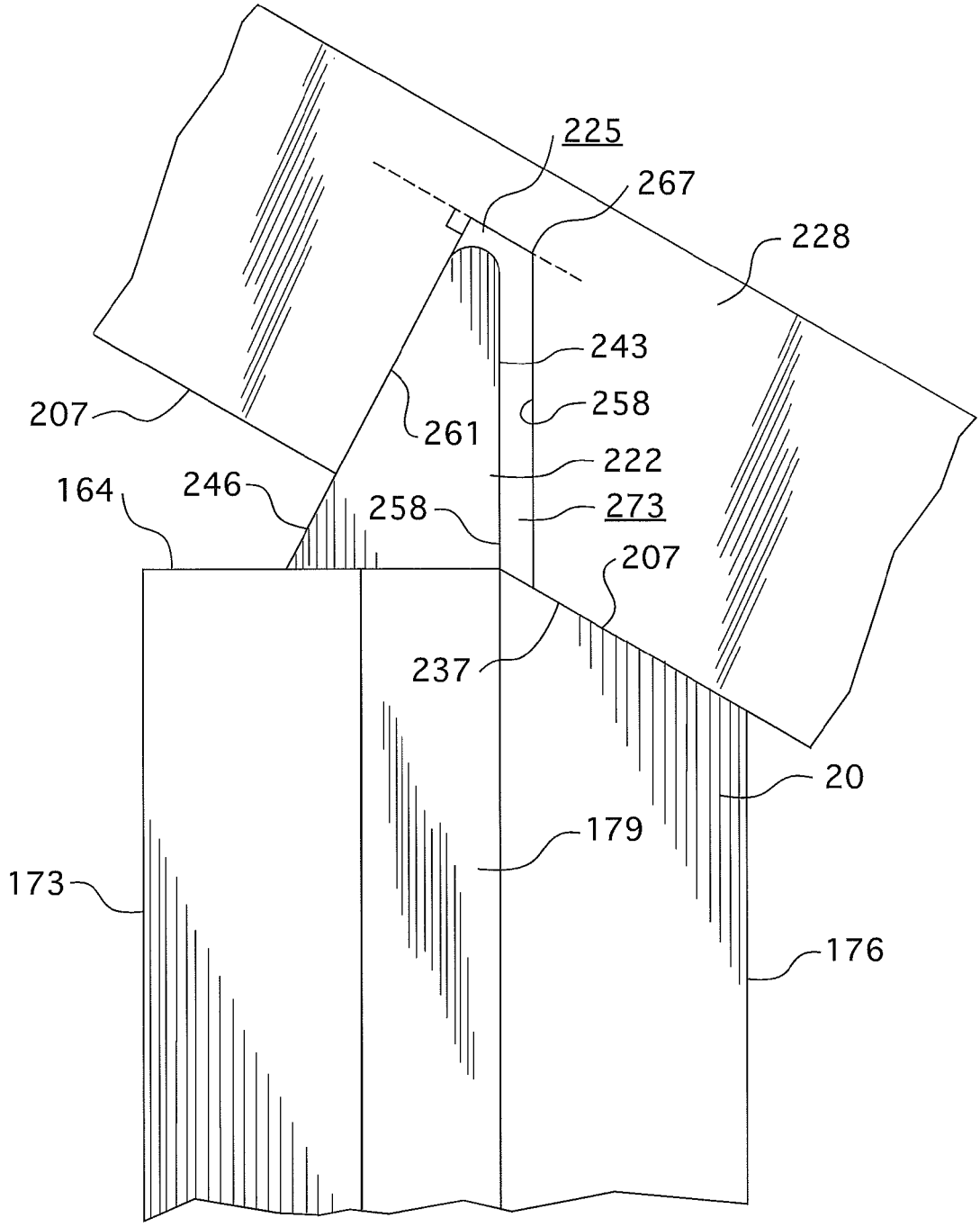
FIG. 17 is a representative side view of an extension of the upper sidewall edge of a sidewall panel being received within a lower notch of a roof panel, in which the forward surface of the lower notch does not abut the sidewall extension.

When the forward 243 and rear 246 extension surfaces and associated gradient angles (249 and 255), and the forward 258 and rear 261 notch surfaces and associated gradient angles (264 and 270) are selected as described above, abutment between forward notch surface 258 and forward extension surface 243 is optional. That is, there may be a separation 273 between forward notch surface 258 and forward extension surface 243, when extension 222 is received within lower notch 225, as depicted in FIG. 17. The presence of separation 273 may be desirable for purposes, including but not limited to, ease of assembling the roof panel and sidewall panels together, and allowing for thermal induced expansion and contraction between lower notch 225 and extension 222. In an embodiment of the present invention, forward notch surface 258 of lower notch 225 abuts at least a portion of forward extension surface 243 of sidewall extension 222, as depicted in FIG. 16.

To minimize or prevent the ingress of fluids, such as water, into channel 41 of base plate 14 (and correspondingly base perimeter channel 74 of base perimeter structure 11), the width of the upper portion of the sidewall is selected such that the exterior upper sidewall surface thereof either: extends out beyond or is substantially flush with the exterior surface of the exterior flange of the base plate. When a fluid, such as rain, runs down the exterior upper sidewall surface, such a relationship between the exterior upper sidewall surface and the exterior flange surface results in the fluid dropping beyond or flowing over the exterior flange surface, rather than behind the exterior flange and into channel 41.

Figure 11:
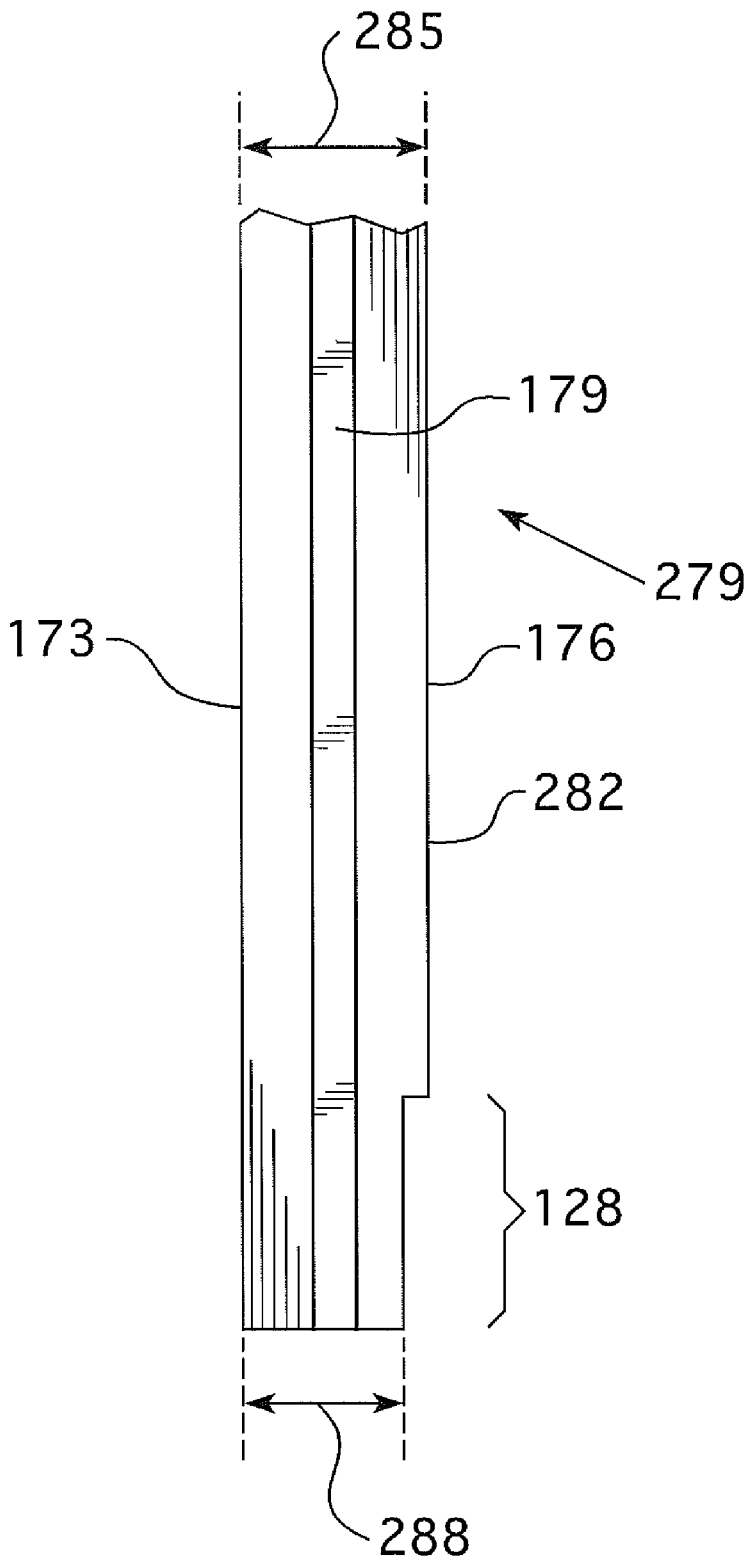
FIG. 11 is a representative side elevational view of a sidewall edge of the lower sidewall portion of a sidewall according to the present invention, and a portion of the upper sidewall portion extending upward therefrom.

More particularly, and with reference to FIGS. 4 and 11, sidewall panel 20 has an upper sidewall portion 279 that extends upwardly from lower sidewall portion 128. Upper sidewall portion 279 has an exterior upper sidewall surface 282 and a width 285. As discussed previously herein, exterior flange 35 of base plate 41 has an exterior flange surface 98. Lower sidewall portion 128 has a width 288 that is less than width 285 of upper sidewall portion 279. Width 288 of lower sidewall portion 128 and width 285 of upper sidewall portion 279 are each selected such that: (i) exterior upper sidewall surface 282 extends out beyond exterior flange surface 98 of exterior flange 35; or (ii) exterior upper sidewall surface 282 is substantially flush (e.g., aligned) with exterior flange surface 98 of exterior flange 35.

The interior side of the sidewall panels, of the enclosed structure of the present invention, may be defined by a substantially continuous surface (e.g., when the sidewall is substantially solid), or by a plurality of intersecting ribs. A plurality of intersecting ribs is desirable because it allows for a reduction in the weight of the sidewall panel without compromising the dimensional integrity thereof. With reference to FIG. 12, interior sidewall side 173 comprises and is defined by a plurality of intersecting ribs 291. Intersecting ribs 291 may have any suitable configuration, for example, forming inter-rib spaces 294 having shapes selected from polygons (e.g., triangles, rectangles, squares, pentagons, hexagons, heptagons, octagons, etc., and combinations thereof), circles, ovals (e.g., elliptical shapes), irregular shapes, and combinations thereof. As depicted in FIG. 12, intersecting ribs 291 define inter-rib spaces 294 having substantially rectangular shapes. Intersecting ribs 291 of sidewall panel 20 are typically continuous with each other and the sidewall panel itself, thus together forming a substantially continuous and unitary sidewall panel.

At least one sidewall panel of the enclosed structure of the present invention may include a door and/or window. With reference to FIG. 1, enclosed structure 1 includes a sidewall panel that includes a door 296, and a sidewall panel that includes a window 299. The door and window may each be in the form of an opening alone, as depicted in FIG. 1. Alternatively, the door and window may, in addition to an opening, each independently further include a door structure or a window structure (not shown). Door and window structures may be selected from such structures that are known to the skilled artisan. Art recognized door structures typically include a door frame (e.g., positioned within door opening 296), a door panel, and hinges connecting the door panel to the door frame (not shown). The door structure may alternatively include a retractable door that is reversibly pulled down over door opening 296 from a tubular container positioned above the door opening, in accordance with art recognized methods and materials (not shown). Art recognized window structures typically include a window frame (e.g., positioned within window opening 299), a window panel, and hinges (e.g., recessed hinges) connecting the window panel to the window frame (not shown). The window panel may additionally or alternatively be fitted with a window panel frame that is slidingly positionable within the window frame, as is known to the skilled artisan.

With reference to FIGS. 1, 18, 19 and 20, the roof panels 26 of the enclosed structure of the present invention may each further include a first raised roof lip 302 that extends outwardly from exterior roof panel side 210 (or first roof panel tab 213), and which is substantially parallel with and extends longitudinally along first roof panel side edge 201. Each roof panel 26 may also further include a second raised roof lip 305 that extends outwardly from exterior roof panel side 210 (or second roof panel tab 216), and which is substantially parallel with and extends longitudinally along second roof panel side edge 204. The first and second raised roof lips (302, 305) may each independently comprise a plurality of separate roof lip segments that together define the respective raised roof lip. More typically, and as depicted in the drawings, the first and second raised roof lips (302, 305) are each independently a continuous and elongated raised roof lip, that extends substantially along the length of the roof panel. The first and second raised roof lips (302, 305) serve to channel fluids, such as rain water, away from the first and second roof panel tabs (213, 216). More particularly, the first and second raised roof lips (302, 305) serve to channel fluids, such as rain water, away from the overlappingly abutted and fixedly attached first and second roof panel tabs of neighboring roof panels, thus minimizing ingress of rain water through the overlapping tabs and into the enclosed interior structure space.

The roof structure of the enclosed structure of the present invention may be a gable roof structure. As used herein and in the claims, the term "gable roof structure" and similar terms means a double-sloping roof that forms a gable at least one end thereof, and the term "gable structure" and similar terms means a substantially vertical terminus or end of the gable roof structure having a shape selected from, but not limited to, triangular and/or arched shapes. With reference to FIG. 1, roof structure 23 is a gable roof structure comprising a first gable structure 308 and a second gable structure 311 (not visible in FIG. 1). The first 308 and second 311 gable structures each independently are substantially triangular gable structures.

Figure 21:
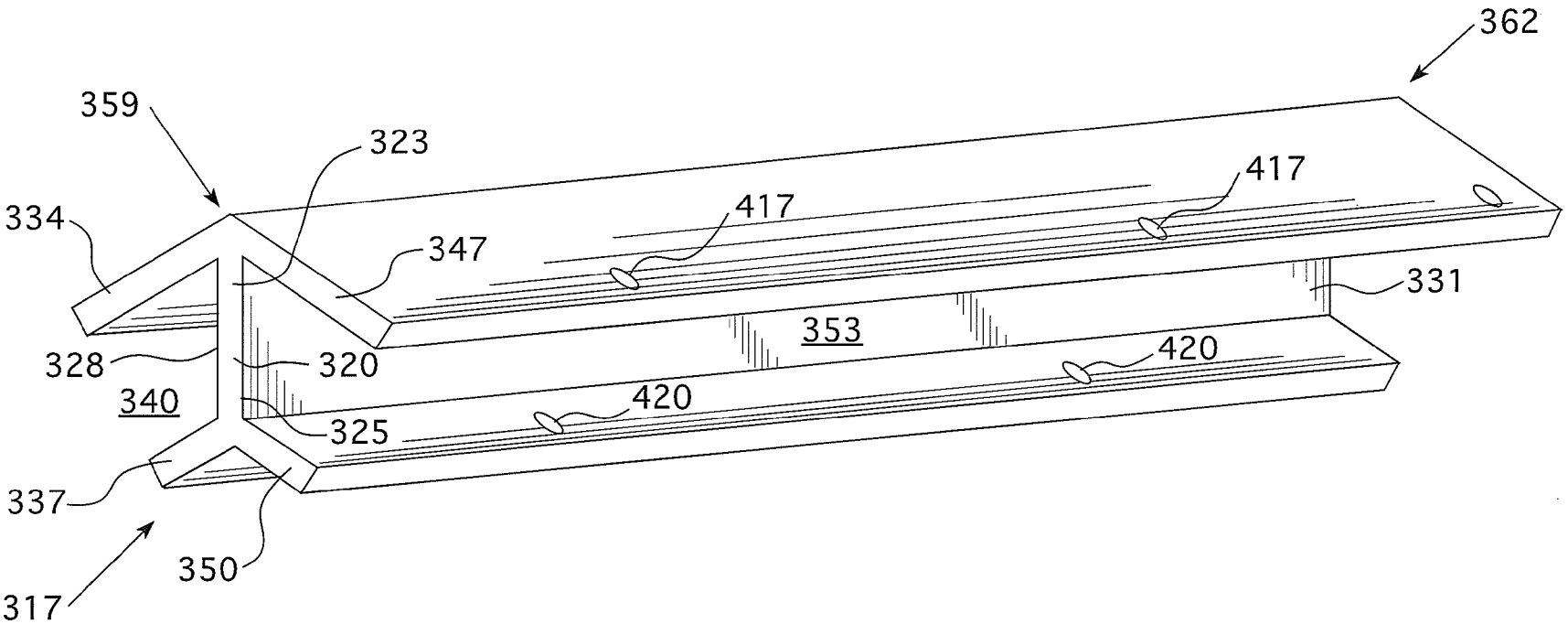
FIG. 21 is a representative perspective view of a top cap element according to the present invention.
Figure 22:
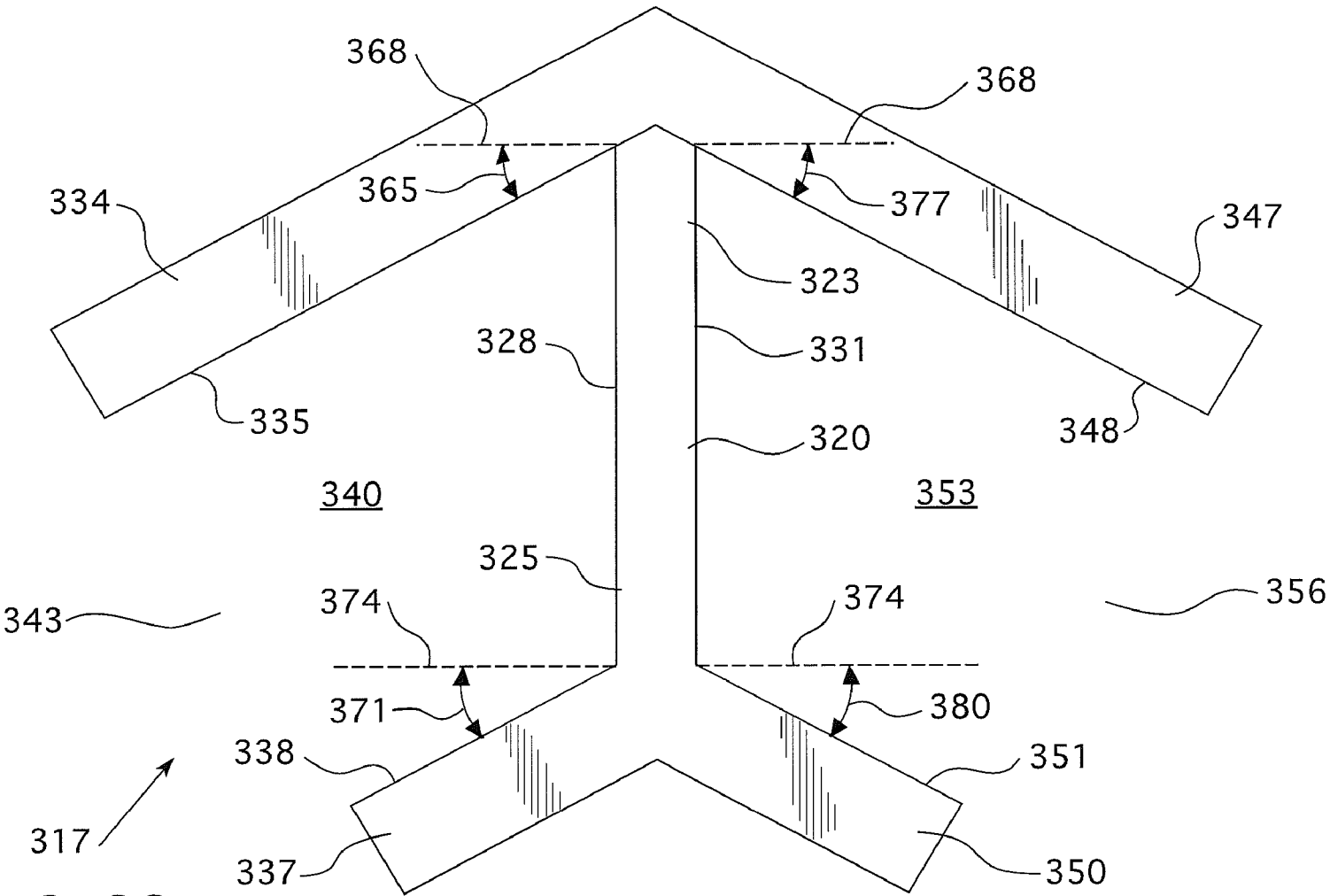
FIG. 22 is a representative end view of the top cap element of FIG. 21.

With reference to FIGS. 1, 21 and 22, the gable roof structure may include a top cap structure 314 that comprises a plurality of top cap elements 317. Each top cap element 317 includes an elongated central spine 320, which has an upper portion 323, a lower portion 325, a first side 328 and a second side 331. Each top cap element 317 further includes a first exterior cap flange 334, which extends outwardly and downwardly from and along first side 328 and upper portion 323 of the elongated spine 320. The first side 328 of each top cap element 317 also includes a first interior cap flange 337, which extends outwardly and downwardly from first side 328 and along lower portion 325 of elongated spine 320. First exterior cap flange 334 and first interior cap flange 337 together define a first cap channel 340. More particularly, interior surface 335 of first exterior cap flange 334 and interior surface 338 of first interior cap flange 337 together define first cap channel 340. First cap channel 340 is an elongated channel that extends along first side 328 of elongated central spine 320, and has an elongated opening 343.

Each top cap element 317 still further includes a second exterior cap flange 347, which extends outwardly and downwardly from and along second side 331 of upper portion 323 of elongated spine 320. The second side 331 of each top cap element 317 also includes a second interior cap flange 350, which extends outwardly and downwardly from and along second side 331 and lower portion 325 of the elongated spine 320. Second exterior cap flange 347 and second interior cap flange 350 together define a second cap channel 353. More particularly, the interior surface 348 of second exterior cap flange 347 and the interior surface 351 of second interior cap flange 350 together define second cap channel 353. Second cap channel 353 is an elongated channel that extends along second side 331 of elongated central spine 320, and has an elongated opening 356.

Each top cap element 317 is positioned vertically above the sidewall structure 17 of the enclosed structure 1, such that the first cap channel 340 of each top cap element 317 receives therein at least a portion of the upper roof panel portion 185 of at least one roof panel 26. In addition, second cap channel 353 of each top cap element 317 receives therein at least a portion of the upper roof panel portion 185 of at least one roof panel 26. See, for example, FIG. 1.

Each top cap element has a first end 359 and a second end 362. The top cap structure 314 comprises at least two top cap elements 317 that are arranged with the first end 359 of one top cap element abutting the second end 362 of a neighboring top cap element (i.e., being arranged abuttingly end-to-end). The top cap elements 317 may be fixedly held together end-to-end by art recognized means including, but not limited to: fasteners (e.g., self tapping screws, rivets, and nut and bolt combinations); brackets (e.g., fixed against first side 328 and second side 331 of elongated spine 320 by means of fasteners and/or adhesives); snap fittings; adhesives and combinations thereof (not shown).

The first exterior and interior cap flanges, and the second exterior and interior cap flanges, may each be independently configured so as to maintain the roof gradient angles of the roof panels received within the first and second cap channels respectively defined thereby. In particular, the interior surfaces of the exterior and interior cap flanges are so configured, such that the roof gradient angles of the roof panels received within the first and second cap channels respectively defined thereby, are maintained.

With reference to FIG. 22, first exterior cap flange 334 has a first exterior cap flange gradient angle 365 that is substantially equivalent to roof gradient angle 219 (FIG. 20). The first exterior cap flange gradient angle 365 is determined relative to interior surface 335 thereof and horizontal (as depicted by dashed line 368 in FIG. 22). First interior cap flange 337 has a first interior cap flange gradient angle 371 that is substantially equivalent to roof gradient angle 219. The first interior cap flange gradient angle 371 is determined relative to interior surface 338 thereof and horizontal (as depicted by dashed line 374 in FIG. 22). Second exterior cap flange 347 has a second exterior cap flange gradient angle 377 that is substantially equivalent to roof gradient angle 219. The second exterior cap flange gradient angle 377 is determined relative to interior surface 348 thereof and horizontal (as depicted by dashed line 368 in FIG. 22). Second interior cap flange 350 has a second interior cap flange gradient angle 380 that is substantially equivalent to roof gradient angle 219. The second interior cap flange gradient angle 380 is determined relative to interior surface 351 thereof and horizontal (as depicted by dashed line 374 in FIG. 22).

The interior and exterior cap flanges of each top cap element 317 may, in an embodiment of the present invention, further include apertures that may be aligned with apertures in the upper roof panel portions received within the cap channels thereof. The aligned apertures may be dimensioned to receive fasteners therethrough (e.g., screws, rivets, bolts and combinations thereof), so as to fixedly attach the roof panels and the top cap elements together. With reference to FIGS. 19 and 21, second exterior cap flange 347 includes apertures 417, and second interior cap flange 350 includes apertures 420. First exterior and interior cap flanges 334 and 337 include similar apertures, which are not visible in FIG. 21. Upper roof portion 185 of roof panel 26 includes apertures 423 (FIG. 19). When upper roof portion 185 is received within second cap channel 353, at least some of apertures 417 of second exterior cap flange 347, apertures 423 of upper roof portion 185 and apertures 420 of second interior cap flange 350 are aligned, and may receive fasteners therethrough (not shown), thereby fixedly attaching roof panel 26 and top cap element 317 together.

Each top cap element 317 typically has a length, from first end 359 to second end 362, of from 50 cm to 450 cm, more typically from 75 cm to 225 cm, and further typically from 90 cm to 180 cm. In an embodiment of the present invention, each top cap element has a length of 135 cm.

As discussed previously herein, the gable roof structure (e.g., roof structure 23) may include at least one gable structure 308. In an embodiment of the present invention, gable structure 308 includes a first gable panel 383 and a second gable panel 386 that each reside abuttingly on the upper sidewall edge 164 of at least one sidewall panel 20, and which are attached to each other by overlapping, abutting and fixedly attached gable tabs.

Since first gable panel 383 and second gable panel 386 are mirror images of each other, they are described herein with reference to second gable panel 386 as depicted in FIGS. 23, 24, 25 and 26. Each gable panel independently has, a gable exterior side 389, a gable interior side 392, a gable upper side 395, a gable side edge 398 and a gable bottom side 401. The gable upper side 395 has a gable ledge 404 that extends inward beyond gable interior side 392, and has a gable ledge gradient angle 407 that is substantially equivalent to roof gradient angle 219. The gable ledge gradient angle 407 is determined relative to horizontal (represented by dashed line 410 in FIG. 24). Each gable panel has at least one gable tab 413 that extends from gable side edge 398.

The gable bottom side (e.g., 401) of first gable panel 383, and the gable bottom side (e.g., 401) of second gable panel 386 each independently abut the upper sidewall edge 164 of at least one sidewall panel 20. The gable tab (e.g., 413) of the first gable panel 383, and the gable tab (e.g., 413) of the second gable panel 386 overlappingly abut, and are fixedly attached to each other. The gable ledge (e.g., 404) of first gable panel 383 resides beneath and supportively abuts either the first roof panel tab 213 or the second roof panel tab 216 of at least one adjacent roof panel 26. The gable ledge (e.g., 404) of second gable panel 386 resides beneath and supportively abuts either the first roof panel tab 213 or the second roof panel tab 216 of at least one adjacent roof panel 26.

The gable ledge (e.g., 404) of each gable panel and the roof panel tab supported thereby may be attached to each other by known attachment means including, but not limited to, fasteners (e.g., screws, rivets and bolts), adhesives, snap fittings, and combinations thereof (not shown). For example, and with reference to FIG. 23, gable ledge 404 may have a plurality of apertures 441, some of which are aligned with the apertures of the first or second roof panel tabs (e.g., apertures L, G or I of FIGS. 29 and 30). As described previously herein with regard to fixed attachment of the overlapping and abutting sidewall panel tabs, and roof panel tabs, the shapes of the aligned apertures of the gable ledge and roof panel tabs may be selected so as to be free of (i.e., so as not to include): (i) aligned circular apertures; and (ii) aligned elongated apertures having parallel longitudinal axes. That is, each pair of aligned gable ledge and roof panel tab apertures is composed of only: (a) a circular aperture aligned with an elongated aperture; or (b) an elongated aperture aligned with an elongated aperture, in which the longitudinal axes of the aligned elongated apertures are not parallel to each other. Selecting the aligned apertures of the gable ledge and roof panel tabs in this limited fashion allows for flexibility in assembly of the enclosed structure, and improved resistance to structural failures resulting from thermally induced expansions and contractions, as similarly discussed previously herein with regard to the aligned apertures of the overlapping and abutting sidewall panel tabs and roof panel tabs.

The gable tabs of the first and second gable panels may each independently comprise a plurality of separate (or discontinuous) tabs that together define the respective gable tab, or be in the form of a substantially unitary (or continuous) gable tab. In an embodiment of the present invention, the gable tab (e.g., 413) of the first gable panel 383 is a substantially unitary first gable tab that extends outwardly from and substantially longitudinally along the gable side edge (e.g. 398) of first gable panel 383. The gable tab (e.g., 413) of the second gable panel 386 is a substantially unitary second gable tab that extends outwardly from and substantially longitudinally along the gable side edge (e.g. 398) of second gable panel 386. The gable tabs typically have a thickness that is less than the thickness of the gable panel (e.g., the thickness of the gable panel as determined from gable exterior side 389 to gable interior side 392). In an embodiment, the gable tabs each individually have a thickness that is from 20 percent to 50 percent that of the thickness of the gable panel, inclusive of the recited values.

The first 383 and second 386 gable panels of the gable structure 308 are arranged and positioned such that the gable tabs (e.g., 413) of the neighboring gable panels thereof overlappingly abut and are fixedly attached to each other. In FIGS. 29 and 30, the overlapping abutment and fixed attachment of gable tab C of second gable panel A, and gable tab D of first gable panel B is depicted in an exploded perspective view. The gable panel portions and gable tabs are presented in FIGS. 29 and 30 in a general format, so as to provide descriptions relative to the overlapping abutment of the gable tabs of neighboring gable panels, as will be discussed further herein.

For purposes of the present discussion, and with further reference to FIGS. 29 and 30: gable panel A is representative of second gable panel 386; gable tab C is representative of the gable tab (e.g., 413) of second gable panel 386; neighboring gable panel B is representative of neighboring first gable panel 383; and gable tab D is representative of the gable tab (e.g., 413) of first gable panel 383. Side E is representative of the gable exterior side (e.g., 389) of each gable panel; and side F is representative of the gable interior side (e.g., 392) of each gable panel. In FIGS. 29 and 30, gable tab C overlaps and abuts underlying gable tab D. Alternatively, gable tab D may overlap and abut gable tab C, in which case gable tab C would be underlying relative to gable tab D. Gable tab C and gable tab D may be fixedly attached to each other by means of one or more adhesives interposed there-between (not shown), one or more fasteners passing there-through (e.g., screws, bolts, rivets and combinations thereof), snap fittings (not shown) and combinations thereof.

In an embodiment of the present invention, the overlapping gable tabs of the neighboring first and second gable panels are fixedly attached together by one or more gable panel-gable panel fasteners passing through at least one pair of aligned gable panel tab apertures. In this particular embodiment, the gable tab of the first gable panel includes one or more apertures selected from circular apertures, elongated apertures and combinations thereof; and the gable tab of the second gable panel includes one or more apertures selected from circular apertures, elongated apertures and combinations thereof. At least one aperture of the gable tab of the first gable panel is aligned with at least one aperture of the gable tab of the second gable panel, thereby forming at least one pair of aligned gable tab apertures. Each pair of aligned gable tab apertures, however, are free of (i.e., do not include): (i) aligned circular apertures; and (ii) aligned elongated apertures having parallel longitudinal axes. That is, each pair of aligned gable tab apertures is composed of only: (a) a circular aperture aligned with an elongated aperture; or (b) an elongated aperture aligned with an elongated aperture, in which the longitudinal axes of the aligned elongated apertures are not parallel to each other.

Selecting each pair of aligned gable tab apertures such that they are free of aligned circular apertures, and aligned elongated apertures having parallel longitudinal axes, provides a desirable balance of physical properties. Such a desirable balance of physical properties includes, for example, fixedly attaching neighboring first and second gable panels together, while at the same time allowing the fixedly attached neighboring first and second gable panels to move slightly relative to each other so as to compensate for thermal expansion and/or contraction of the materials from which the gable panels are fabricated. In the absence of such compensative movement, the gable tabs of the gable panels may become overly stressed as the result of thermal expansion and/or contraction, resulting in cracking and catastrophic failure of the gable tabs. A pair of aligned circular apertures typically provides too little compensative movement. A pair of aligned elongated apertures having parallel longitudinal axes typically allows too much movement between the overlapping and abutting gable tabs, thus rendering the gable structure dimensionally unstable.

In FIG. 30, gable tab C of second gable panel A includes an elongated aperture G (in the form of a slot) having a longitudinal axis H (which is substantially horizontally oriented), that is aligned with elongated aperture L (in the form of a slot) having a longitudinal axis M (which is substantially vertically oriented). Longitudinal axis H of elongated aperture G and longitudinal axis M of elongated aperture L are substantially orthogonal to each other. Fastener J, in the form of a threaded bolt, extends or passes through the pair of aligned apertures G and L, and is threadingly engaged with nut K. The aligned pair of elongated apertures L and G allows for compensative movement in both the horizontal and vertical directions between gable tab C of second gable panel A and gable tab D of first gable panel B, and correspondingly second gable panel A and first gable panel B. The longitudinal axes H and M of the aligned pair of elongated apertures G and L may be aligned relative to each other so as to form any angle other than 0° (i.e., such that the axes are not parallel).

Overlapping abutment of the gable tab of the first gable panel and the gable tab of the neighboring second gable panel is achieved by positioning the gable tabs in an offset fashion along the inner, middle or outer portions of the respective gable side edge (whether the gable tabs are continuous, discontinuous or a combination thereof). In an embodiment of the present invention, and with further reference to FIGS. 29 and 30, gable side edge N (e.g., 398) of second gable panel A (386), and gable side edge O of neighboring first gable panel B (383) each have an outer portion P, a middle portion Q and an inner portion R. Outer portion P is proximate to gable exterior side E (e.g., 389), inner portion R is proximate to gable interior side F (e.g., 392), and middle portion Q of each gable side edge is interposed there-between. In FIGS. 29 and 30, substantially unitary gable tab C extends from middle portion Q of gable side edge N (201) of roof of second gable panel A (386), and accordingly substantially unitary gable tab D may extend from either outer portion P or inner portion R of gable side edge O of neighboring first gable panel B (383), thereby facilitating abutting overlap between the gable tabs of the neighboring first and second gable panels. As depicted in FIGS. 29 and 30, gable tab D extends from inner portion R of first gable panel B (383) thereof. Equivalently, the gable tab of the first gable panel may extend from the middle portion of the gable side edge thereof, while the gable tab of the second gable panel extends from the outer or inner portion of the gable side edge thereof. While not depicted in FIGS. 29 and 30, a gable tab may extend from outer portion P or inner portion R so as to be flush (e.g., aligned or continuous) with gable exterior side E or gable interior side F, respectively.

In an embodiment of the present invention, the gable bottom side of each gable panel has a plurality of gable notches into which are received upward extending extensions of the sidewall panels residing there-under. Receipt of the upward extending sidewall panel extensions within the gable notches provides advantages including, but not limited to: proper aligning of the gable panels and sidewall panels; and minimizing the risk of the gable panels slipping or sliding off the top of the sidewall panels upon which they abuttingly rest.

As discussed previously herein, each sidewall panel 20 of sidewall structure 17 may include a plurality of extensions extending upward from the upper sidewall edge 164. The sidewall panel extensions may have any suitable shape or configuration, provided they are capable of being received within the gable notches of the gable bottom sides. For example, the sidewall panel extensions may have specific angled forward and rear surfaces, such as extensions 222, or they may have a substantially rectangular shape defined by exterior surfaces having orthogonal orientations relative to horizontal (not shown).

The gable bottom side of the first gable panel 383 and the gable bottom side of the second gable panel 386 each independently have a plurality of gable notches. At least some of the gable notches of the first gable panel and at least some of the gable notches of the second gable panel each independently receive the extensions, of the sidewall panels upon which they abuttingly rest, therein. For purposes of illustration, and with reference to FIGS. 23 and 24, gable bottom side 401 of second gable panel 386 has a plurality of gable notches 426 and 429. The gable notches may have the same or different dimensions. For example, gable notches 426 are dimensioned and positioned to receive therein two extensions 222 and the extension support rib 276 (FIG. 9) extending therebetween. Gable notches 429, however, are dimensioned and positioned to receive therein individual extensions 222 (in the absence of extension support rib 276).

The gable exterior side and the gable interior side of each gable panel may be defined by continuous surfaces. In an embodiment, the gable exterior side of the first gable panel, and the gable exterior side of the second gable panel each independently comprise (or are defined by) a substantially continuous surface, and the gable interior side of the first gable panel, and the gable interior side of the second gable panel each independently comprise (or are defined by) a plurality of intersecting ribs. A plurality of intersecting ribs is desirable because it allows for a reduction in the weight of the gable panel without compromising the dimensional integrity thereof.

Figure 23:
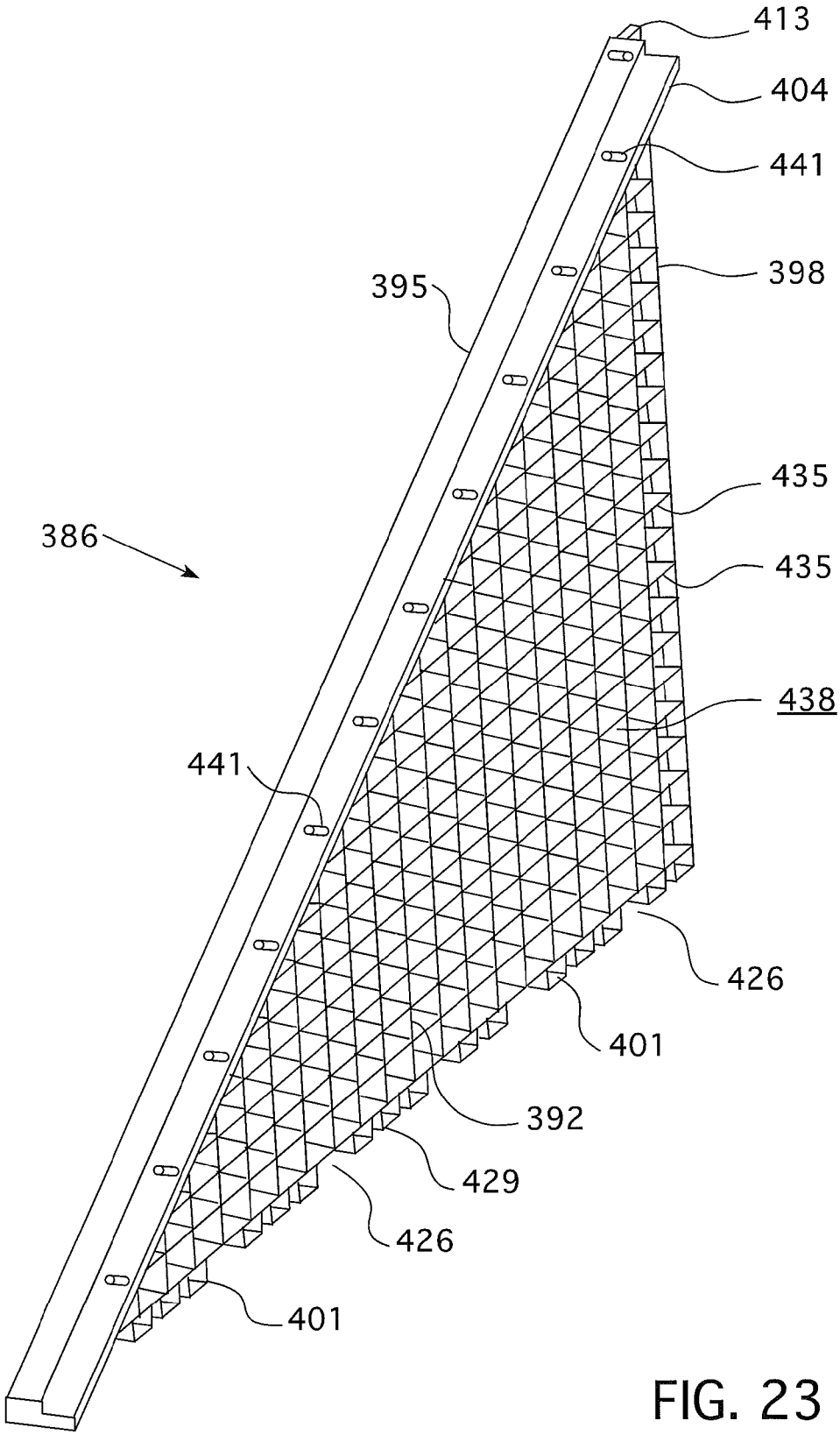
FIG. 23 is a representative perspective view of the interior side of a gable panel according to the present invention.
Figure 24:
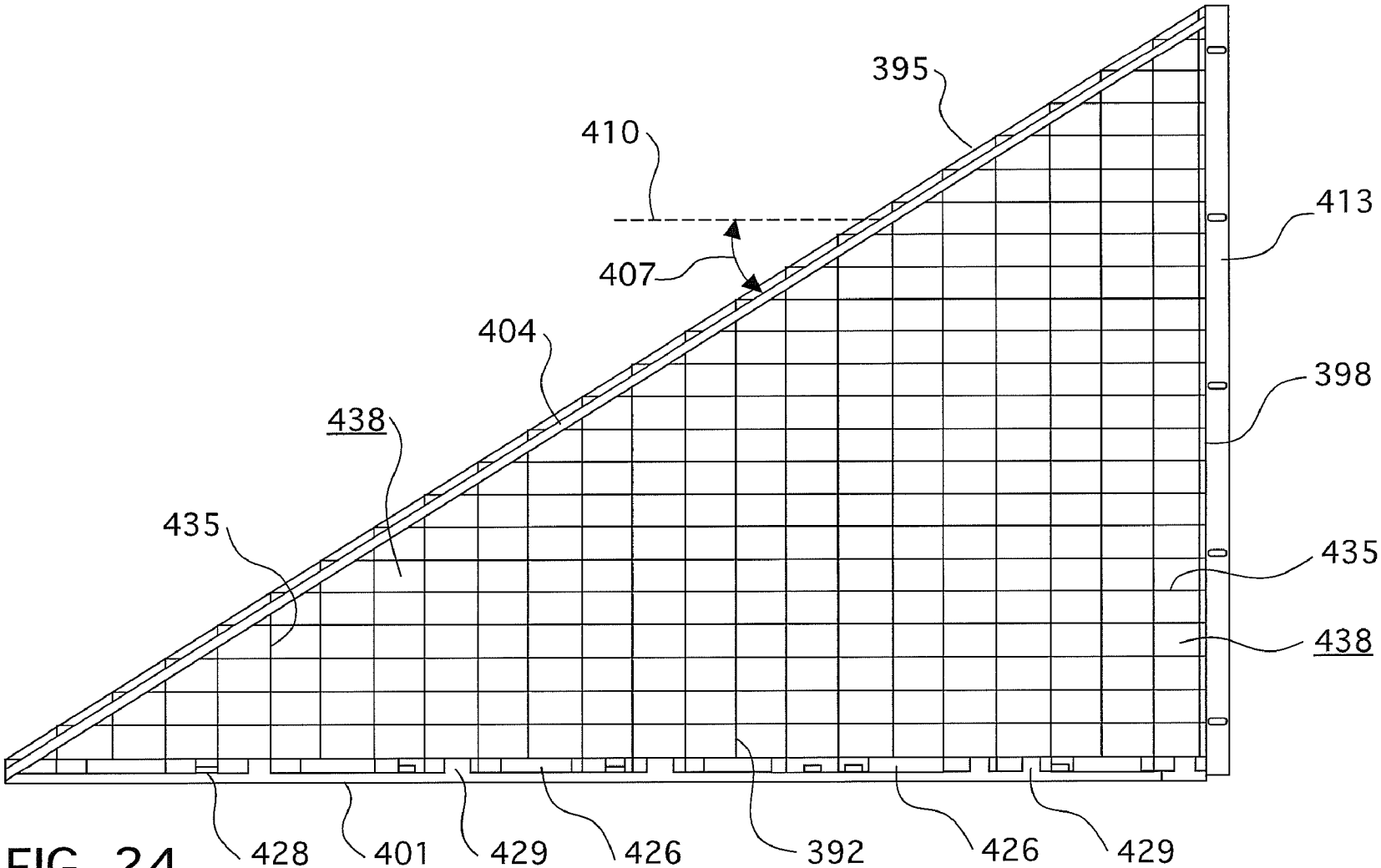
FIG. 24 is a representative plan view of the interior side of the gable panel of FIG. 23.
Figure 25:
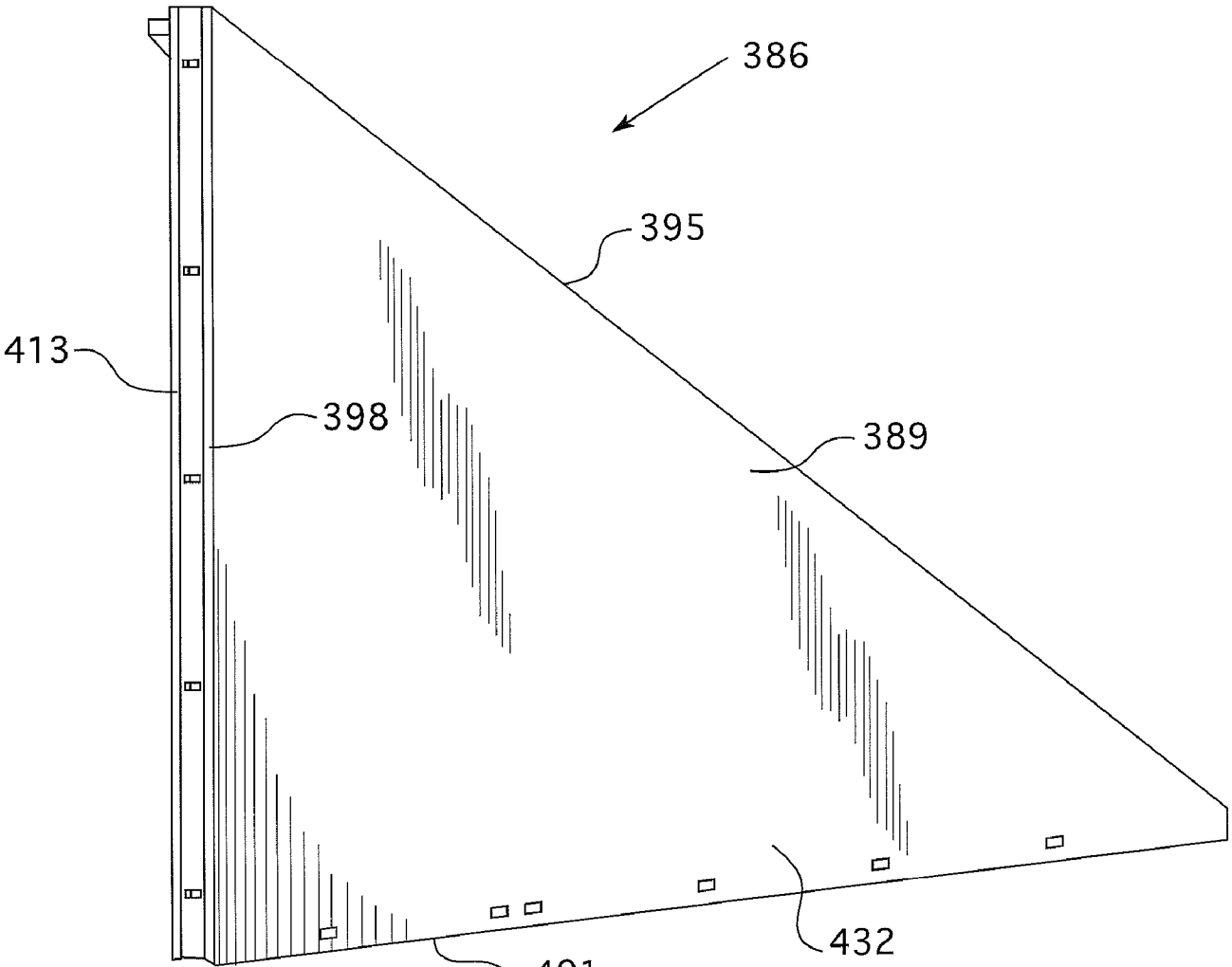
FIG. 25 is a representative perspective view of the exterior side of the gable panel of FIG. 23.
Figure 26:
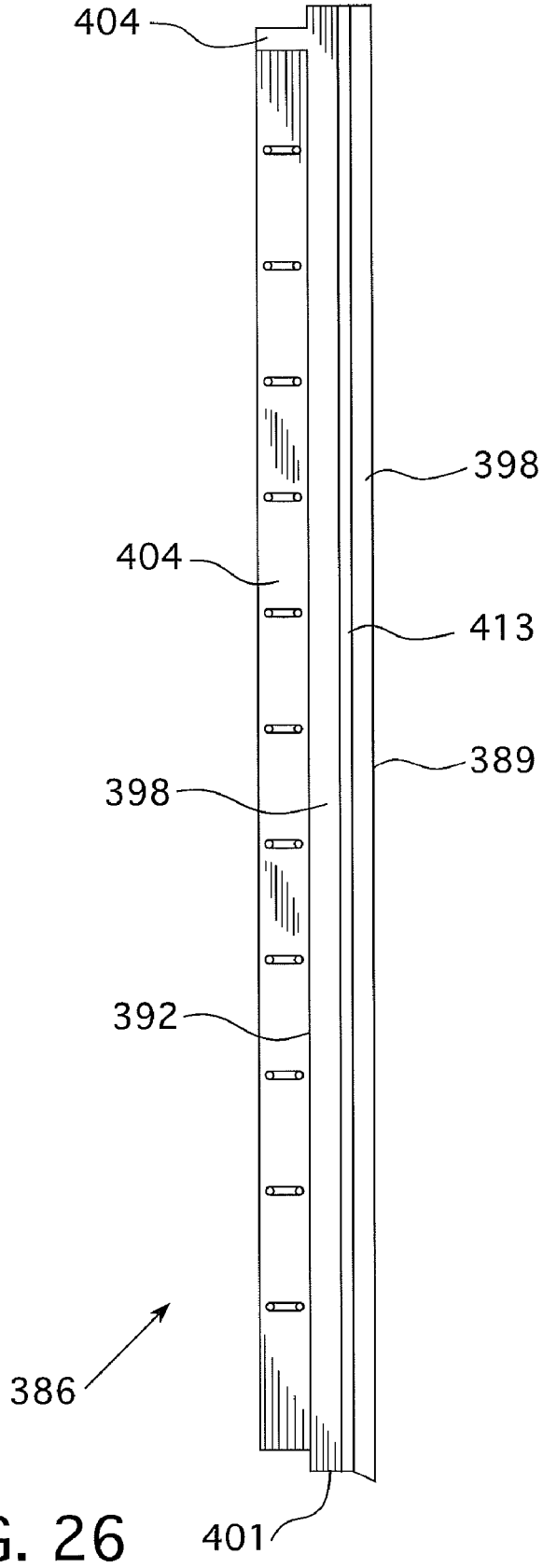
FIG. 26 is a representative side view of the side edge of the gable panel of FIG. 23.

For purposes of illustration, and with reference to FIGS. 23, 24 and 25, gable exterior side 389 of second gable panel 386 comprises and is defined by substantially continuous surface 432, and gable interior side 392 comprises and is defined by a plurality of intersecting ribs 435. Intersecting ribs 435 may have any suitable configuration, for example, forming inter-rib spaces 438 having shapes selected from polygons (e.g., triangles, rectangles, squares, pentagons, hexagons, heptagons, octagons, etc., and combinations thereof), circles, ovals (e.g., elliptical shapes), irregular shapes, and combinations thereof. As depicted in FIGS. 23 and 24, intersecting ribs 435 define inter-rib spaces 438 having substantially rectangular shapes. The intersecting ribs (e.g., 435) that define the second side (e.g., 392) of each gable panel are typically continuous with each other and the gable panel itself, thus together forming a substantially continuous and unitary gable panel.

The gable structure, and the gable panels thereof, of the enclosed structure may each independently have any suitable shape including, for example, arched shapes and/or triangular shapes. Typically each gable structure, and each gable panel thereof, independently has a triangular shape. In an embodiment, each gable panel has a substantially right triangular shape, for example as depicted in FIGS. 23 through 25. When having a substantially right triangular shape, the gable upper side 395 (or hypotenuse) typically has a length of from 100 cm to 400 cm, more typically from 150 cm to 350 cm, and further typically from 200 cm to 250 cm. Each gable panel typically and independently has a gable side edge 398 length of from 60 cm to 300 cm, more typically from 100 cm to 250 cm, and further typically from 125 cm to 200 cm. Each gable panel typically and independently has a gable bottom side 401 length of from 50 cm to 300 cm, more typically from 100 cm to 250 cm, and further typically from 150 cm to 230 cm. Each gable tab 413 typically extends out from gable side edge 398 a distance that is from 1.25 cm to 7.5 cm, more typically from 2 cm to 7 cm, and further typically from 3 cm to 6 cm. Each gable tab 413 typically has a thickness of from 3 mm to 15 mm, more typically from 4 mm to 12 mm, and further typically from 5 mm to 10 mm. Each gable panel typically has a thickness (from gable exterior side 389 to gable interior side 392) of from 2 cm to 10 cm, more typically from 3 cm to 8 cm, and further typically from 4 cm to 6 cm. Each gable ledge 404 extends inward beyond gable interior side 392 a distance that is typically from 10 mm to 30 mm, more typically from 15 mm to 25 mm, and further typically from 18 mm to 22 mm. In an embodiment, each gable panel is in the form of a substantially right triangular gable panel and has a gable upper side length of 225 cm, a gable side edge length of 150 cm, a gable bottom side length of 190 cm, a gable tab length (extending out from gable side edge 398) of 5 cm, a gable tab thickness of 6 mm, a gable panel thickness of 5 cm, and the gable ledge extends a distance of 20 mm (inward beyond the gable interior side).

The base perimeter and wall structures of the enclosed structure of the present invention may have a circular and/or oval shape, in which case the enclosed structure is free of corners. Typically, the enclosed structure includes at least one corner, in which case the enclosed structure may further include corner sidewall panels, a corner structure, and optionally a corner base plate.

Figure 28:
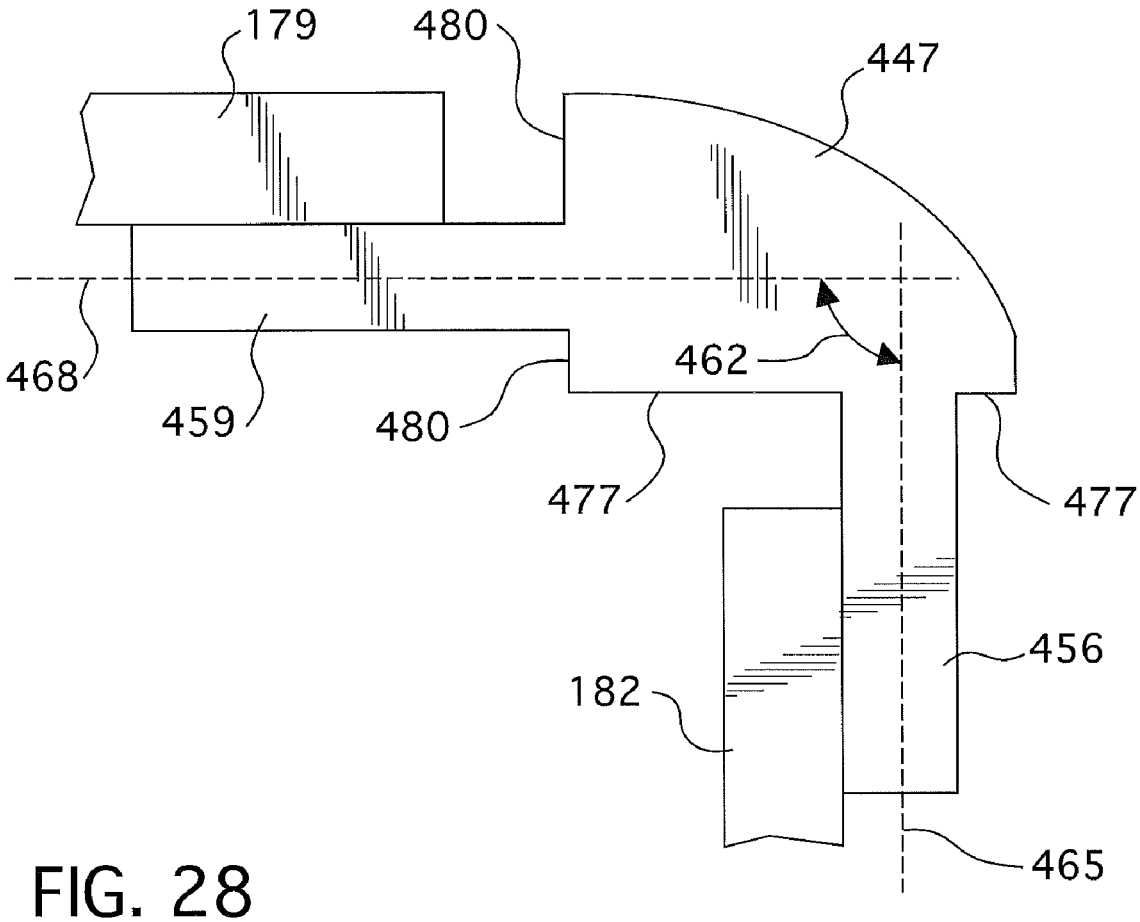
FIG. 28 is a representative top plan view of the top end of the corner structure of FIG. 27, further including portions of the sidewall tabs of the corner sidewall panels.

With reference to FIGS. 1, 27 and 28, enclosed structure 1 includes at least one first corner sidewall panel 20-1 and at least one second corner sidewall panel 20-2. The first and second corner sidewall panels are as described previously herein with regard to sidewall panel 20. In addition to the first and second corner sidewall panels, the enclosed structure may include at least one corner structure 444. Each corner structure 444 includes an elongated center member 447 having an upper portion 450 and a lower portion 453. Corner structure 444 further includes a first corner flange 456 that extends outward from elongated center member 447, and a second corner flange 459 that extends outward from elongated center member 447.

First corner flange 456 and second corner flange 459 extend out from elongated center member 447 such that they together form (or have) an internal angle 462 there-between that is greater than 0° and less than 180° (FIG. 28). Internal angle 462 is determined relative to centerlines of the first and second corner flanges, as represented by dashed lines 465 and 468 in FIG. 28, respectively. Typically, internal angle 462 formed by the first and second corner flanges (456, 459) has a value of from 10° to 170°, and more typically from 30° to 120°. In an embodiment, internal angle 462 has a value of substantially 90° (as depicted in FIG. 28).

Corner structure 444 is positioned such that lower portion 453 of elongated center member 447 resides within and upper portion 450 (of elongated center member 447) extends upwardly from a portion of base perimeter channel 74. More particularly, and as depicted in FIG. 27, corner structure 444 is positioned such that lower portion 453 of elongated center member 447 resides within corner channel juncture 158 of corner base plate 3. Relative to corner base plate 3, see also FIG. 7 and the description relating thereto as provided previously herein. Upper portion 450 of elongated center member 447 extends upwardly from corner channel juncture 158.

The corner sidewall panels and corner structure are arranged such that the sidewall tabs of the corner sidewall panels overlappingly abut and are fixedly attached to the corner flanges of the corner structure. More particularly, first corner flange 456 and first sidewall tab 179 or second sidewall tab 182 of first corner sidewall panel 20-1 overlappingly abut and are fixedly attached to each other. Further, second corner flange 459 and first sidewall tab 179 or second sidewall tab 182 of second corner sidewall panel 20-2 overlappingly abut and are fixedly attached to each other. The corner flanges and sidewall tabs may be fixedly attached to each other by art-recognized means including, but not limited to adhesives, fasteners (e.g., screws, rivets and/or bolts), snap fittings, and combinations thereof (not shown).

The first and second corner flanges may each independently and optionally further include a plurality of apertures (471, 474). The apertures of the corner flanges and the apertures of the sidewall tabs abutting therewith may together form aligned apertures through which fasteners may be passed, so as to fixedly attach the corner structure and corner sidewall panels together. As described previously herein with regard to fixed attachment of the overlapping and abutting sidewall panel tabs, and roof panel tabs (and with reference to FIGS. 29 and 30), the shapes of the aligned apertures of the corner flange and corner sidewall panel tabs may be selected so as to be free of (i.e., so as not to include): (i) aligned circular apertures; and (ii) aligned elongated apertures having parallel longitudinal axes. That is, each pair of aligned corner flange and corner sidewall panel tab apertures is composed of only: (a) a circular aperture aligned with an elongated aperture; or (b) an elongated aperture aligned with an elongated aperture, in which the longitudinal axes of the aligned elongated apertures are not parallel to each other. Selecting the aligned apertures of the corner flanges and corner sidewall panel tabs in this limited fashion allows for flexibility in assembly of the enclosed structure, and improved resistance to structural failures resulting from thermally induced expansions and contractions, as similarly discussed previously herein with regard to the aligned apertures of the overlapping and abutting sidewall panel tabs and roof panel tabs.

The first and second corner flanges of the corner structure may each independently comprise a plurality of separate (or discontinuous) flange elements that together define the respective corner flange, or be in the form of a substantially unitary (or continuous) corner flange. In an embodiment of the present invention, first corner flange 456 is a substantially unitary first corner flange that extends outwardly from and substantially longitudinally along elongated center member 447 of corner structure 444. More particularly, first corner flange 456 extends outwardly from and longitudinally along first side edge 477 of elongated center member 447 (FIG. 28). Second corner flange 459 is a substantially unitary second corner flange that extends outwardly from and substantially longitudinally along elongated center member 447 of corner structure 444. More particularly, second corner flange 459 extends outwardly from and longitudinally along second side edge 480 of elongated center member 447 (FIG. 28).

The corner flanges typically have a thickness that is less than the width of the side edge of the elongated center member from which they extend (e.g., first side edge 477 or second side edge 480). In an embodiment, the corner flanges each individually have a thickness that is from 20 percent to 50 percent of that of the thickness of the side edge of the elongated center member from which they extend, inclusive of the recited values. In a particular embodiment, the first and second corner flanges have a thickness that is substantially 25 percent of that of the thickness of the side edge of the elongated center member from which they extend, inclusive of the recited values.

Each corner flange may be positioned and extend outward from the elongated center member of the corner structure such that it resides underneath or overtop of the sidewall tab of the corner sidewall panels with which the corner flange is in abutting relationship. In an embodiment, the first corner flange resides abuttingly over the first sidewall tab or the second sidewall tab of said first corner sidewall panel, and the second corner flange resides abuttingly under the first sidewall tab or the second sidewall tab of said second corner sidewall panel. For example, and with reference to FIG. 28, first corner flange 456 resides abuttingly over second sidewall tab 182 of first corner sidewall panel 20-1, and second corner flange 459 resides abuttingly under first sidewall tab 179 of second corner sidewall panel 20-2.

The alternating over-under (or under-over) relationship between the first and second corner flanges and the corner sidewall tabs abuttingly associated therewith (e.g., as depicted in FIG. 28) is desirable in that it provides the corners of the enclosed structure of the present invention with improved dimensional stability. For example, thermally induced expansion and/or contraction, and/or bending/twisting of the corner sidewall panels may be compensated for by the described over-under/under-over arrangement. As, for example, second corner sidewall panel 20-2 and the first sidewall tab 179 thereof turn or twist inward relative to second corner flange 459, first corner sidewall panel 20-1 may at the same time turn or twist outward relative to first corner flange 456. The counteracting forces of the corner sidewall panels and associated sidewall tabs thus being absorbed and counteracted and/or compensated by corner structure 444.

Each corner structure (444) of the enclosed structure may have a wide range of dimensions provided that the corner structures are capable of providing sufficient support for the sidewall panels attached thereto, and any portion of the roof structure resting thereon. Each corner structure (and, in particular, elongated center member 447 thereof) typically has a length (or height) of from 50 cm to 300 cm, more typically from 100 cm to 250 cm, and further typically from 150 cm to 230 cm. The first and second corner flanges (456, 459) each independently and typically extend outwardly from the respective side edge of the elongated center member (477, 480) a distance of from 2.5 cm to 10 cm, more typically from 3.5 cm to 8 cm, and further typically from 4 cm to 7 cm. The first and second corner flanges (456, 459) each independently and typically have a thickness of from 6 mm to 40 mm, more typically from 10 mm to 30 mm, and further typically from 15 mm to 25 mm. In an embodiment, the corner structure (and, in particular, elongated center member 447 thereof) typically has a length (or height) of 180 cm, each corner flange (456, 459) extends outwardly from the respective side edge of the elongated center member (477, 480) a distance of 6 cm, and each corner flange has a thickness of 20 mm.

As described previously herein, a portion of the interior roof panel side 207 of the lower roof panel portion 188 abuts upper sidewall edge 164 of at least one sidewall panel 20 with the enclosed structure of the present invention. With reference to FIG. 20, the abutting relationship between the roof and sidewall panels serves to define a roof panel-sidewall panel arrangement 483, and the enclosed structure includes a plurality of such arrangements 483 (FIG. 1). In an embodiment, the roof panel-sidewall panel arrangement is further provided with a retainer on the interior side of the panels, which serves to tensionally maintain the roof and sidewall panels in abutting relationship.

With further reference to FIG. 20, sidewall panel 20, of the roof panel-sidewall panel arrangement 483, includes a sidewall mounting extension 485 that extends into interior structure space 27 from interior sidewall side 173. Sidewall mounting extension 485 is fixedly attached to interior sidewall side 173 of sidewall panel 20. The roof panel 26, of the roof panel-sidewall panel arrangement 483, includes a roof panel mounting extension 488 that extends into interior structure space 27 from interior roof panel side 207. Roof panel mounting extension 488 is fixedly attached to interior roof panel side 207 of roof panel 26. Roof panel-sidewall panel arrangement 483 further includes a retainer 491 that extends tensionally between and is attached to sidewall mounting extension 485 and roof panel mounting extension 488. Retainer 491 extending tensionally between and being attached to sidewall mounting extension 485 and roof panel mounting extension 488 thus serves to maintain roof panel-sidewall panel arrangement 483 in abutting relationship.

Retainer 491 may have a form selected from, but not limited to, a chain, a strap, an intertwined material such as rope and combinations thereof. The retainer may be fabricated from materials selected from, but not limited to, plastics (such as, thermoplastic and/or thermoset plastic materials, including elastomeric polymeric materials), metals, natural fiber materials (e.g., hemp as used in hemp based rope), and combinations thereof. In an embodiment, retainer 491 is in the form of a strap fabricated from nylon material (e.g., KEVLAR nylon material).

Sidewall mounting extension 485 and roof panel mounting extension 488 may have any suitable form, provided that retainer 491 may be tensionally attached thereto. For example, the sidewall and roof mounting extensions may each independently have a form selected from, but not limited to, rigid looped structures (e.g., eye bolts), shaped rigid mounts (e.g., ball mounts) and combinations thereof. The sidewall and roof mounting extensions may be fabricated from materials selected from, but not limited to, plastics (such as thermoplastic and/or thermoset plastic materials), metals and combinations thereof. The sidewall and roof mounting extensions may be separate from or continuous with the sidewall and/or roof panels. For example, the mounting extensions may be metal eye bolts that are mounted on the interior side of the sidewall and/or roof panels. If the sidewall and/or roof panels are fabricated from plastic material, the mounting extensions associated there-with may be formed from plastic and as part of the panel during the molding process, in which case the mounting extensions are continuous with the respective panel.

Alternatively or in addition to the combination of retainer 491, roof panel mounting extension 488 and sidewall panel mounting extension 485, the roof panel-sidewall panel arrangement 483 may be maintained in abutting relationship by fasteners (not shown) passing through aligned apertures in lower roof panel portion 188 and upper sidewall edge 164. With reference to FIGS. 9, 10, 12, 14 and 19, lower roof panel portion 188 may include apertures 494, and chamfered edge portion 237 of upper sidewall edge 164 may include apertures 497. When interior side 207 of lower roof panel portion 188 abuts chamfered edge portion 237 of upper sidewall edge 164, at least some of apertures 494 of lower roof panel portion 188 and apertures 497 of chamfered edge portion 237 of upper sidewall edge 164 are aligned, and a fastener (e.g., screw, rivet and/or bolt) may be passed through the so-aligned apertures (no shown), thereby maintaining (or further maintaining) the roof panel-sidewall panel arrangement 483 (FIG. 20) in abutting relationship.

The various components (e.g., base plates, sidewall panels, roof panels, top cap elements, sidewall and roof mounting extensions and/or gable panels) of the enclosed structure of the present invention may each be independently fabricated from numerous materials, provided the components possess sufficient rigidity, such that the enclosed structure is at a minimum self-supporting, and further capable of withstanding external forces and stresses resulting from, for example, wind, rain and/or snow. For example, the various components (e.g., base plates, sidewall panels, roof panels, top cap elements, sidewall and roof mounting extensions and gable panels) of the enclosed structure may each be fabricated from a material selected independently from wood, metals (e.g., ferrous based metals, titanium, copper and/or aluminum), ceramic materials, plastic materials and combinations thereof.

In an embodiment of the present invention, the components (e.g., base plates, sidewall panels, roof panels, top cap elements, gable panels and/or sidewall and roof mounting extensions) of the enclosed structure are each independently fabricated from plastic material selected independently from the group consisting of thermoset plastic material, thermoplastic material and combinations thereof. As used herein and in the claims, the term "thermoset plastic material" and similar terms, such as "thermosetting or thermosetable plastic materials" means plastic materials having or that form a three dimensional crosslinked network resulting from the formation of covalent bonds between chemically reactive groups, e.g., active hydrogen groups and free isocyanate groups, or between unsaturated groups.

Thermoset plastic materials from which the plastic material of the components of the enclosed structure may be independently selected, include those known to the skilled artisan, e.g., crosslinked polyurethanes, crosslinked polyepoxides, crosslinked polyesters and crosslinked polyunsaturated polymers. The use of thermosetting plastic materials typically involves the art-recognized process of reaction injection molding. Reaction injection molding typically involves, as is known to the skilled artisan, injecting separately, and preferably simultaneously, into a mold, for example: (i) an active hydrogen functional component (e.g., a polyol and/or polyamine); and (ii) an isocyanate functional component (e.g., a diisocyanate such as toluene diisocyanate, and/or dimers and trimers of a diisocyanate such as toluene diisocyanate). The filled mold may optionally be heated to ensure and/or hasten complete reaction of the injected components.

As used herein and in the claims, the term "thermoplastic material" and similar terms, means a plastic material that has a softening or melting point, and is substantially free of a three dimensional crosslinked network resulting from the formation of covalent bonds between chemically reactive groups, e.g., active hydrogen groups and free isocyanate groups. Examples of thermoplastic materials from which the plastic material of the components (e.g., base plates, sidewall panels, roof panels, top cap elements, gable panels and/or sidewall and roof mounting extensions) of the enclosed structure may be independently selected include, but are not limited to, thermoplastic polyurethane, thermoplastic polyurea, thermoplastic polyimide, thermoplastic polyamide, thermoplastic polyamideimide, thermoplastic polyester, thermoplastic polycarbonate, thermoplastic polysulfone, thermoplastic polyketone, thermoplastic polyolefins, thermoplastic (meth) acrylates, thermoplastic acrylonitrile-butadiene-styrene, thermoplastic styrene-acrylonitrile, thermoplastic acrylonitrile-styrene-acrylate and combinations thereof (e.g., blends and/or alloys of at least two thereof).

In an embodiment of the present invention, the thermoplastic material of the various components of the enclosed structure is independently selected in each case from thermoplastic polyolefins. As used herein and in the claims, the term "polyolefin" and similar terms, such as "polyalkylene" and "thermoplastic polyolefin", means polyolefin homopolymers, polyolefin copolymers, homogeneous polyolefins and/or heterogeneous polyolefins. For purposes of illustration, examples of polyolefin copolymers include those prepared from ethylene and one or more $C_3$-$C_{12}$ alpha-olefin, such as 1-butene, 1-hexene and/or 1-octene.

The polyolefins, from which the thermoplastic material of the components of the enclosed structure, may in each case be independently selected include, but are not limited to, heterogeneous polyolefins, homogeneous polyolefins, and combinations thereof. The term "heterogeneous polyolefin" and similar terms means polyolefins having a relatively wide variation in: (i) molecular weight amongst individual polymer chains (i.e., a polydispersity index of greater than or equal to 3); and (ii) monomer residue distribution (in the case of copolymers) amongst individual polymer chains. The term "polydispersity index" (PDI) means the ratio of $M_w/M_n$, where $M_w$ means weight average molecular weight, and $M_n$ means number average molecular weight, each being determined by means of gel permeation chromatography (GPC) using appropriate standards, such as polyethylene standards. Heterogeneous polyolefins are typically prepared by means of Ziegler-Natta type catalysis in heterogeneous phase.

The term "homogeneous polyolefin" and similar terms means polyolefins having a relatively narrow variation in: (i) molecular weight amongst individual polymer chains (i.e., a polydispersity index of less than 3); and (ii) monomer residue distribution (in the case of copolymers) amongst individual polymer chains. As such, in contrast to heterogeneous polyolefins, homogeneous polyolefins have similar chain lengths amongst individual polymer chains, a relatively even distribution of monomer residues along polymer chain backbones, and a relatively similar distribution of monomer residues amongst individual polymer chain backbones. Homogeneous polyolefins are typically prepared by means of single-site, metallocene or constrained-geometry catalysis. The monomer residue distribution of homogeneous polyolefin copolymers may be characterized by composition distribution breadth index (CDBI) values, which are defined as the weight percent of polymer molecules having a comonomer residue content within 50 percent of the median total molar comonomer content. As such, a polyolefin homopolymer has a CDBI value of 100 percent. For example, homogenous polyethylene/alpha-olefin copolymers typically have CDBI values of greater than 60 percent or greater than 70 percent. Composition distribution breadth index values may be determined by art recognized methods, for example, temperature rising elution fractionation (TREF), as described by Wild et al, Journal of Polymer Science, Poly. Phys. Ed., Vol. 20, p. 441 (1982), or in U.S. Pat. No. 4,798,081, or in U.S. Pat. No. 5,089,321. An example of homogeneous ethylene/alpha-olefin copolymers are SURPASS polyethylenes, commercially available from NOVA Chemicals Inc.

The plastic material of the various components (e.g., base plates, sidewall panels, roof panels, top cap elements, gable panels and/or sidewall and roof mounting extensions) of the enclosed structure may in each case independently and optionally include a reinforcing material selected, for example, from glass fibers, glass beads, carbon fibers, metal flakes, metal fibers, polyamide fibers (e.g., KEVLAR polyamide fibers), cellulosic fibers, nanoparticulate clays, talc and mixtures thereof. If present, the reinforcing material is typically present in a reinforcing amount, e.g., in an amount of from 5 percent by weight to 60 or 70 percent by weight, based on the total weight of the plastic material. The reinforcing fibers, and the glass fibers in particular, may have sizings on their surfaces to improve miscibility and/or adhesion to the plastic materials into which they are incorporated, as is known to the skilled artisan.

In an embodiment of the invention, the reinforcing material is in the form of fibers (e.g., glass fibers, carbon fibers, metal fibers, polyamide fibers, cellulosic fibers and combinations of two or more thereof). The fibers typically have lengths (e.g., average lengths) of from 0.5 inches to 4 inches (1.27 cm to 10.16 cm). The components of the enclosed structure may each independently include fibers having lengths that are at least 50 or 85 percent of the lengths of the fibers that are present in the feed materials from which the components are prepared, such as from 0.25 inches to 2 or 4 inches (0.64 cm to 5.08 or 10.16 cm). The average length of fibers present in the components of the enclosed structure may be determined in accordance with art recognized methods. For example, the various components of the enclosed structure may be pyrolyzed to remove the plastic material, and the remaining or residual fibers microscopically analyzed to determine their average lengths, as is known to the skilled artisan.

Fibers are typically present in the plastic materials of the components of the enclosed structure in amounts selected independently from 5 to 70 percent by weight, 10 to 60 percent by weight, or 30 to 50 percent by weight (e.g., 40 percent by weight), based on the total weight of the plastic material (i.e., the weight of the plastic material, the fiber and any additives). Accordingly, components of the enclosed structure of the present invention may each independently include fibers in amounts of from 5 to 70 percent by weight, 10 to 60 percent by weight, or 30 to 50 percent by weight (e.g., 40 percent by weight), based on the total weight of the particular component.

The fibers may have a wide range of diameters. Typically, the fibers have diameters of from 1 to 20 micrometers, or more typically from 1 to 9 micrometers. Generally each fiber comprises a bundle of individual filaments (or monofilaments). Typically, each fiber is composed of a bundle of 10,000 to 20,000 individual filaments.

Typically, the fibers are uniformly distributed throughout the plastic material of the component(s) of the enclosed structure. During mixing of the fibers and the plastic material, the fibers generally form bundles of fibers typically comprising at least 5 fibers per fiber bundle, and preferably less than 10 fibers per fiber bundle. While not intending to be bound by theory, it is believed, based on the evidence at hand, that fiber bundles containing 10 or more fibers may result in a molded component (e.g., sidewall panels) having undesirably reduced structural integrity. The level of fiber bundles containing 10 or more fibers per bundle, may be quantified by determining the Degree of Combing present within a molded article. The number of fiber bundles containing 10 or more fibers per bundle is typically determined by microscopic evaluation of a cross section of the molded article, relative to the total number of microscopically observable fibers (which is typically at least 1000). The Degree of Combing is calculated using the following equation: 100×((number of bundles containing 10 or more fibers)/(total number of observed fibers)). Generally, the molded components of the enclosed structure each independently have a Degree of Combing of less than or equal to 60 percent, and typically less than or equal to 35 percent.

In addition or alternatively to reinforcing material(s), the plastic materials of the components of the enclosed structure may in each case independently and optionally include one or more additives. Additives that may be present in the plastic materials of the various components of the enclosed structure include, but are not limited to, antioxidants, colorants, e.g., pigments and/or dyes, mold release agents, fillers, e.g., calcium carbonate, ultraviolet light absorbers, fire retardants and mixtures thereof. Additives may be present in the plastic material of each component of the enclosed structure in functionally sufficient amounts, e.g., in amounts independently from 0.1 percent by weight to 10 percent by weight, based on the total weight of the particular component.

The components (e.g., base plates, sidewall panels, roof panels, top cap elements, gable panels and/or sidewall and roof mounting extensions) of the enclosed structure of the present invention may be prepared by art-recognized methods, including, but not limited to, injection molding, reaction injection molding, compression molding and combinations thereof. The components of the enclosed structure may be fabricated by a compression molding process that includes: providing a compression mold comprising a lower mold portion and an upper mold portion; forming (e.g., in an extruder) a molten composition comprising plastic material and optionally reinforcing material, such as fibers; introducing, by action of gravity, the molten composition into the lower mold portion; compressively contacting the molten composition introduced into the lower mold portion with the interior surface of the upper mold portion; and removing the molded component (e.g., a roof panel) from the mold. The lower mold portion may be supported on a trolley that is reversibly moveable between: (i) a first station where the molten composition is introduced therein; and (ii) a second station where the upper mold portion is compressively contacted with the molten composition introduced into the lower mold portion.

The lower mold portion may be moved concurrently in time and space (e.g., in x-, y- and/or z-directions, relative to a plane in which the lower mold resides) as the molten composition is gravitationally introduced therein. Such dynamic movement of the lower mold portion provides a means of controlling, for example, the distribution, pattern and/or thickness of the molten composition that is gravitationally introduced into the lower mold portion. Alternatively, or in addition to movement of the lower mold portion in time and space, the rate at which the molten composition is introduced into the lower mold portion may also be controlled. When the molten composition is formed in an extruder, the extruder may be fitted with a terminal dynamic die having one or more reversibly positionable gates through which the molten composition flows before dropping into the lower mold portion. The rate at which the molten composition is gravitationally deposited into the lower mold portion may be controlled by adjusting the gates of the dynamic die.

If different plastic compositions are used to form a particular component of the enclosed structure, the different plastic compositions may be introduced sequentially or concurrently into a particular portion of the lower mold that corresponds to a particular portion of the component to be formed/molded. For example, in the case of a sidewall panel, a first molten plastic composition may be introduced, at a first station, into that portion of the lower mold which defines those portions of the sidewall panel that are other than the sidewall tabs (e.g., the central or body portion of the sidewall panel), followed by moving the trolley and lower mold to a second station where a second molten plastic composition is introduced into that portion of the lower mold which defines the first sidewall tab, and then moving the trolley to a third station where a third molten plastic composition is introduced into that portion of the lower mold which defines the second sidewall tab. The lower mold, so sequentially filled with first, second and third molten plastic compositions, is then moved, via the trolley, to a fourth station where the upper mold portion is compressively contacted with the plastic materials within the lower mold. Alternatively, the first, second and third molten plastic compositions may be introduced substantially concurrently into those portions of the lower mold that define the body, and the first and second sidewall tabs of the sidewall panel, for example, by moving the lower mold beneath the terminal ports of three separate extruders.

The compressive force applied to the molten plastic composition introduced into the lower mold portion is typically from 25 psi to 550 psi (1.8 to 38.7 Kg/cm$^2$), more typically from 50 psi to 400 psi (3.5 to 28.1 Kg/cm$^2$), and further typically from 100 psi to 300 psi (7.0 to 21.1 Kg/cm$^2$). The compressive force applied to the molten plastic material may be constant or non-constant. For example, the compressive force applied to the molten plastic material may initially be ramped up at a controlled rate to a predetermined level, followed by a hold for a given amount of time, then followed by a ramp down to ambient pressure at a controlled rate. In addition, one or more plateaus or holds may be incorporated into the ramp up and/or ramp down during compression of the molten plastic material. The various components of the enclosed structure of the present invention may, for example, be prepared/molded in accordance with the methods and apparatuses described in U.S. Pat. Nos. 6,719,551; 6,869,558; 6,900,547; and 7,208,219.

In an embodiment of the present invention, the components (e.g., base plates, sidewall panels, roof panels, top cap elements, gable panels and/or sidewall and roof mounting extensions) of the enclosed structure are each independently a molded article formed from a molten composition comprising fibers (e.g., glass fibers, carbon fibers, metal fibers, polyamide fibers and/or cellulosic fibers). As used with regard to this particular embodiment of the invention herein and in the claims, the term "molded article" means at least one of the base plates, sidewall panels, roof panels, top cap elements, gable panels, sidewall mounting extensions, and roof mounting extensions. The molten composition is formed from plastic material and feed fibers. The molten composition may be formed by introducing the plastic material and feed fibers sequentially or concurrently into, and optionally at multiple points along the length of, an extruder. The feed fibers have a length of 1.27 cm (0.5 inches) to 10.16 cm (4 inches). The fibers are present in the molded article (e.g., one or more of the base plates, sidewall panels, roof panels, top cap elements, gable panels and/or sidewall and roof mounting extensions) in an amount of from 5 percent by weight to 70 percent by weight, based on the total weight of the particular molded article (or portion). The fibers of the molded article (e.g., one or more of the base plates, sidewall panels, roof panels, top cap elements, gable panels and/or sidewall and roof mounting extensions) have lengths (e.g., average lengths) that are at least 60% of the lengths (e.g., average lengths) of the feed fibers. In addition, less than 20 percent of the fibers of the molded article are oriented in the same direction.

The enclosed structure of the present invention may have a wide range of dimensions. Typically, the enclosed interior structure space of the enclosed structure may have a volume from 12 m$^3$ to 812 m$^3$, more typically from 50 m$^3$ to 600 m$^3$, and further typically from 75 m$^3$ to 500 m$^3$. In an embodiment, the enclosed interior structure space of the enclosed structure has a volume of 100 m$^3$. The enclosed structure typically has a perimeter (i.e., as defined relative to base perimeter channel 74) of from 15 m to 60 m, more typically from 20 m to 50 m, and further typically from 25 m to 40 m.

The enclosed structure of the present invention may be used in numerous applications including, but not limited to, as a storage facility (e.g., for equipment, food, and/or medicine), dwellings for people, stables for animals, and battlefield medical facilities (e.g., battlefield triage and/or operating facilities). The enclosed structure may be used, more generally, as a temporary or permanent structure. A particularly advantageous use of the enclosed structure is as a temporary emergency shelter that may be efficiently shipped to and quickly erected in response to a disaster, such as a natural disaster (e.g., tornado, hurricane or earth quake), or a military conflict. Since the enclosed structure of the present invention comprises substantially flat components (e.g., the sidewall, roof and gable panels, and base plates), the components thereof may be packaged and stowed in a relatively small space and accordingly economically shipped to a point of assembly (e.g., a disaster area). In addition, when the components of the enclosed structure are fabricated from plastic materials, such as reinforced polyethylene, the shipping weight may be reduced relative to other materials, such as wood and/or metal, thus providing additional reductions in shipping costs, and allowing for improved ease of handling at the point of assembly.

The present invention has been described with reference to specific details of particular embodiments thereof. It is not intended that such details be regarded as limitations upon the scope of the invention except insofar as and to the extent that they are included in the accompanying claims.

What is claimed is:

1. An enclosed structure comprising:

a. a base perimeter structure comprising a plurality of base plates, each base plate comprising:

i. a base;

ii. an interior flange extending upwardly from said base;

iii. an exterior flange extending upwardly from said base, said interior flange, said exterior flange and a channel base portion of said base extending between said exterior flange and said interior flange together defining a channel;

said base having an exterior base portion extending outwardly from said exterior flange, said exterior base portion having an upper exterior surface that slopes downwardly and outwardly from said exterior flange, said base having a first side base edge and a second side base edge;

said plurality of base plates being arranged with said first side base edge adjacent to the second side base edge of a neighboring base plate, and each channel being aligned so as to form a base perimeter channel;

wherein said exterior base portion of each base plate has at least one anchor hole therethrough, and said enclosed structure further comprising at least one anchor extending through said anchor hole, thereby fixedly securing said base perimeter structure to an underlying support;

b. an exterior wall structure comprising a plurality of sidewall panels, each comprising an upper sidewall edge, a lower sidewall portion, a first sidewall edge, a second sidewall edge, an interior sidewall side and an exterior sidewall side;

each sidewall panel having at least one first sidewall tab extending outwardly from said first sidewall edge, and at least one second sidewall tab extending outwardly from said second sidewall edge;

said lower sidewall portion of each sidewall panel being received within said base perimeter channel, each sidewall panel extending upwardly from said base perimeter channel;

said plurality of sidewall panels being arranged such that said first sidewall tab of each sidewall panel and the second sidewall tab of a neighboring sidewall panel overlappingly abut and are fixedly attached to each other; and c. a roof structure comprising a plurality of roof panels each having an upper roof panel portion, a lower roof panel portion, a first roof panel side edge, a second roof panel side edge, an interior roof panel side and an exterior roof panel side;

each roof panel having at least one first roof panel tab extending outwardly from said first roof panel side edge, and at least one second roof panel tab extending outwardly from said second roof panel side edge;

said plurality of roof panels being arranged such that said first roof panel tab of each roof panel and the second roof panel tab of a neighboring roof panel overlappingly abut and are fixedly attached to each other;

a portion of said interior roof panel side of said lower roof panel portion of each roof panel abuts the upper sidewall edge of at least one sidewall panel of said plurality of sidewall panels, and each roof panel extends upwardly from at least one sidewall panel of said plurality of sidewall panels and independently has a roof gradient angle that is greater than 0° and less than 90°;

wherein said interior sidewall side of each sidewall panel and said interior roof panel side of each roof panel together define a substantially enclosed interior structure space.

2. The enclosed structure of claim 1 wherein said exterior base portion of each base further comprises at least one support rib extending outwardly from said exterior flange, said support rib being continuous with said upper exterior surface of said exterior base portion and said exterior flange.

3. The enclosed structure of claim 1 wherein said upper exterior surface of said exterior base portion of said base forms a base gradient angle that is greater than 0° and less than 90°.

4. The enclosed structure of claim 1 wherein said exterior base portion of each base plate further comprises:

a. a raised lip extending upwardly from said upper exterior surface and along at least a portion of said first side base edge, and b. an interlock structure extending outwardly from said upper exterior surface and along at least a portion of said second base edge, said interlock structure having an interlock channel that is dimensioned for interlocking receipt of said raised lip therein, said interlock channel being downwardly facing;

c. further wherein, said plurality of base plates are arranged such that said raised lip of each base plate is interlockingly received within the interlock channel of said interlock structure of said neighboring base plate, thereby interlocking said plurality of base plates together, and said base perimeter structure being an interlocked base perimeter structure.

5. The enclosed structure of claim 1 wherein said channel base portion of each base plate has a plurality of seep holes extending therethrough, said seep holes being dimensioned to allow liquid to escape from said channel.

6. The enclosed structure of claim 1 wherein for each base plate:

a. said exterior flange has at least one aperture, and b. said interior flange has at least one aperture;

c. said aperture of said exterior flange being aligned with said aperture of said interior flange;

d. said enclosed structure further comprising a plurality of sidewall-base plate fasteners, each sidewall-base plate fastener extending through said aperture of said exterior flange, the lower sidewall portion residing within said channel, and said aperture of said interior flange, thereby fixedly securing said sidewall panel and said base plate together.

7. The enclosed structure of claim 1 wherein each base plate further comprises a support flange extending inwardly into said substantially enclosed interior space from at least one of (i) said interior flange, and (ii) said base, said support flange providing support for a floor structure.

8. The enclosed structure of claim 1 wherein at least one of said sidewall panels further comprises a plurality of extensions extending upward from said upper sidewall edge, and said interior roof panel side of said lower roof panel portion of at least one roof panel of said plurality of roof panels has a plurality of lower notches, said lower notches being dimensioned and positioned to receive said extensions therein, receipt of said extensions within said lower notches maintaining said roof gradient angle of said at least one roof panel.

9. The enclosed structure of claim 8 wherein the upper sidewall edge of said at least one sidewall panel has an exterior chamfered edge portion extending outward and downward from said extensions, said exterior chamfered edge portion having an exterior chamfered edge portion gradient angle that is equivalent to said roof gradient angle; further wherein, a portion of said interior roof panel side of said lower roof panel portion of said at least one roof panel abuts said exterior chamfered edge portion of said upper sidewall edge.

10. The enclosed structure of claim 9 wherein each extension of said at least one sidewall panel comprises a forward extension surface and a rear extension surface;

said forward extension surface facing said exterior sidewall side of said at least sidewall panel and having a forward extension surface gradient angle of 90°;

said rear extension surface facing said interior sidewall side of said at least sidewall panel and having a rear extension surface gradient angle as determined by the following equation:

(90°−said roof gradient angle).

11. The enclosed structure of claim 10 wherein each lower notch of said roof panel is defined by a forward notch surface and a rear notch surface;

said forward notch surface having a forward notch surface gradient angle as determined by the following equation:

(90°−said roof gradient angle)

said rear notch surface having a rear notch surface gradient angle of 90°, and further wherein at least a portion of said rear notch surface of said lower notch abuts at least a portion of said rear extension surface of said extension of said at least one sidewall panel.

12. The enclosed structure of claim 11 wherein at least a portion of said forward notch surface of said lower notch abuts at least a portion of said forward extension surface of said extension of said at least one sidewall panel.

13. The enclosed structure of claim 8 wherein said at lest sidewall panel further comprises an extension support rib extending between at least two of said extensions.

14. The enclosed structure of claim 1 wherein said first sidewall tab is a substantially unitary first sidewall tab, which extends outwardly from and substantially longitudinally along said first sidewall edge;

said second sidewall tab is a substantially unitary second sidewall tab, which extends outwardly from and substantially longitudinally along said second sidewall edge.

15. The enclosed structure of claim 14 wherein said first sidewall edge has an outer portion, a middle portion and an inner portion, said second sidewall edge has an outer portion, a middle portion and an inner portion;

said substantially unitary first sidewall tab extends from said middle portion of said first sidewall edge, and said substantially unitary second sidewall tab extends from one of said outer portion of said second sidewall edge, and said inner portion of said second sidewall edge.

16. The enclosed structure of claim 1 wherein said sidewall panels have an upper sidewall portion extending upward from said lower sidewall portion, said upper sidewall portion having an exterior upper sidewall surface and a width, said exterior flange of said base plate having an exterior flange surface, and said lower sidewall portion has a width that is less than said width of said upper sidewall portion;

further wherein one of, a. said exterior upper sidewall surface extends out beyond said exterior flange surface, and b. said exterior upper sidewall surface is substantially flush with said exterior flange surface.

17. The enclosed structure of claim 1 wherein said interior sidewall side comprises a plurality of intersecting ribs, and said exterior sidewall side comprises a substantially continuous surface.

18. The enclosed structure of claim 1 wherein each roof panel further comprises:

a. a first raised roof lip extending outwardly from said exterior roof panel side and being substantially parallel with said first roof panel side edge, and b. a second raised roof lip extending outwardly from said exterior roof panel side and being substantially parallel with said second roof panel side edge, and c. further wherein, said interior roof panel side comprises a plurality of intersecting ribs, and said exterior roof panel side comprises a substantially continuous surface.

19. The enclosed structure of claim 1 wherein said roof structure is a gable roof structure, said gable roof structure further comprising a top cap structure comprising a plurality of top cap elements each comprising:

a. an elongated central spine having an upper portion, a lower portion, a first side and a second side;

b. a first exterior cap flange extending outwardly and downwardly from and along said first side and said upper portion of said elongated spine;

c. a first interior cap flange extending outwardly and downwardly from said first side and along said lower portion of said elongated spine, said first exterior cap flange and said first interior cap flange together defining a first cap channel;

d. a second exterior cap flange extending outwardly and downwardly from and along said second side and said upper portion of said elongated spine;

e. a second interior cap flange extending outwardly and downwardly from and along said second side and said lower portion of said elongated spine, said second exterior cap flange and said second interior cap flange together defining a second cap channel;

f. wherein said first cap channel of each top cap element receives therein at least a portion of the upper roof panel portion of at least one of said roof panels, and the second cap channel of each top cap element receives therein at least a portion of the upper roof panel portion of at least one of said roof panels, and at least two top cap elements are arranged abuttingly end to end;

g. further wherein:

i. said first exterior cap flange has a first exterior cap flange gradient angle that is substantially equivalent to said roof gradient angle;

ii. said first interior cap flange has a first interior cap flange gradient angle that is substantially equivalent to said roof gradient angle;

iii. said second exterior cap flange has a second exterior cap flange gradient angle that is substantially equivalent to said roof gradient angle, and iv. said second interior cap flange, has a second interior cap flange gradient angle that is substantially equivalent to said roof gradient angle.

20. The enclosed structure of claim 1 further comprising:

a. at least one first corner sidewall panel and at least one second corner sidewall panel, said first corner sidewall panel and said second corner sidewall panel each being defined with regard to said sidewall panels, and b. at least one corner structure, each corner structure comprising:

i. an elongated center member having an upper portion and a lower portion;

ii. a first corner flange extending outward from said elongated center member, and iii. a second corner flange extending outward from said elongated center member, said first corner flange and said second corner flange together having an internal angle there-between that is greater than 0° and less than 180°, iv. wherein said lower portion of said elongated center member resides within a portion of said base perimeter channel and said upper portion of said elongated center member extends upwardly from said portion of said base perimeter channel, said first corner flange and one of the first sidewall tab and the second sidewall tab of said first corner sidewall panel overlappingly abut and are fixedly attached to each other, and said second corner flange and one of the first sidewall tab and the second sidewall tab of said second corner sidewall panel overlappingly abut and are fixedly attached each other.

21. The enclosed structure of claim 1 wherein:

a. abutment between said portion of said interior roof panel side of said lower roof panel portion and the upper sidewall edge of said at least one sidewall panel defines a roof panel-sidewall panel arrangement, said enclosed structure comprising a plurality of said roof panel-sidewall panel arrangements;

b. further wherein for at least one of said roof panel-sidewall panel arrangements: arrangement:

i. said at least one sidewall panel further comprises a sidewall mounting extension extending into said interior structure space from said interior sidewall side, and ii. at least one of said roof panels further comprises a roof panel mounting extension extending into said interior structure space from said interior roof panel side, c. said at least one roof panel-sidewall panel arrangement further comprising:

i. a retainer extending tensionally between and being attached to said sidewall mounting extension and said roof panel mounting extension, thereby maintaining said at least one roof panel-sidewall panel arrangement in abutting relationship.

22. An enclosed structure comprising:

a. a base perimeter structure comprising a plurality of base plates, each base plate comprising:

i. a base;

ii. an interior flange extending upwardly from said base;

iii. an exterior flange extending upwardly from said base, said interior flange, said exterior flange and a channel base portion of said base extending between said exterior flange and said interior flange together defining a channel;

said base having an exterior base portion extending outwardly from said exterior flange, said exterior base portion having an upper exterior surface that slopes downwardly and outwardly from said exterior flange, said base having a first side base edge and a second side base edge;

said exterior base portion of each base plate further comprising;

1. a raised lip extending upwardly from said upper exterior surface and along at least a portion of said first side base edge, and 2. an interlock structure extending outwardly from said upper exterior surface and along at least a portion of said second base edge, said interlock structure having an interlock channel that is dimensioned for interlocking receipt of said raised lip therein, said interlock channel being downwardly facing;

said plurality of base plates being arranged with said first side base edge of each base plate adjacent to the second side base edge of a neighboring base plate, and such that said raised lip of each base plate is interlockingly received within the interlock channel of said interlock structure of said neighboring base plate, thereby interlocking said plurality of base plates together, and said base perimeter structure being an interlocked base perimeter structure, and each channel being aligned so as to form a base perimeter channel;

b. an exterior wall structure comprising a plurality of sidewall panels each comprising an upper sidewall edge, a lower sidewall portion, a first sidewall edge, a second sidewall edge, an interior sidewall side and an exterior sidewall side;

i. each sidewall panel having at least one first sidewall tab extending outwardly from said first sidewall edge, and at least one second sidewall tab extending outwardly from said second sidewall edge;

ii. said lower sidewall portion of each sidewall panel being received within said base perimeter channel, each sidewall panel extending upwardly from said base perimeter channel;

iii. said plurality of sidewall panels being arranged such that said first sidewall tab of each sidewall panel and the second sidewall tab of a neighboring sidewall panel overlappingly abut and are fixedly attached to each other; and c. a roof structure comprising a plurality of roof panels each having an upper roof panel portion, a lower roof panel portion, a first roof panel side edge, a second roof panel side edge, an interior roof panel side and an exterior roof panel side;

i. each roof panel having at least one first roof panel tab extending outwardly from said first roof panel side edge, and at least one second roof panel tab extending outwardly from said second roof panel side edge;

ii. said plurality of roof panels being arranged such that said first roof panel tab of each roof panel and the second roof panel tab of a neighboring roof panel overlappingly abut and are fixedly attached to each other;

iii. a portion of said interior roof panel side of said lower roof panel portion of each roof panel abuts the upper sidewall edge of at least one sidewall panel of said plurality of sidewall panels, and each roof panel extends upwardly from at least one sidewall panel of said plurality of sidewall panels and independently has a roof gradient angle that is greater than 0° and less than 90°;

iv. wherein said interior sidewall side of each sidewall panel and said interior roof panel side of each roof panel together define a substantially enclosed interior structure space, and v. further wherein at least one sidewall panel of said plurality of sidewall panels further comprises a plurality of extensions extending upward from said upper sidewall edge, and said interior roof panel side of said lower roof panel portion of at least one roof panel of said plurality of roof panels has a plurality of lower notches, said lower notches being dimensioned and positioned to receive said extensions therein, receipt of said extensions within said lower notches maintaining said roof gradient angle of said at least one roof panel.

* * * * *